US011365037B2

(12) United States Patent
Afif et al.

(10) Patent No.: US 11,365,037 B2
(45) **Date of Patent: *Jun. 21, 2022**

(54) SUPPLEMENT SAFE AND METHODS OF USE

(71) Applicant: Store It Safe, LLC., Beverly Hills, CA (US)

(72) Inventors: Patrick Simon Afif, Spokane Valley, WA (US); Anthony Wayne Parrish, Los Angeles, CA (US)

(73) Assignee: Store It Safe, LLC., Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/923,407

(22) Filed: Jul. 8, 2020

(65) Prior Publication Data

US 2020/0407135 A1 Dec. 31, 2020

Related U.S. Application Data

(63) Continuation-in-part of application No. 16/579,752, filed on Sep. 23, 2019, now abandoned, which is a (Continued)

(51) Int. Cl.

| | |
|---|---|
| ***B65D 55/14*** | (2006.01) |
| ***A61J 1/03*** | (2006.01) |
| ***B65D 23/00*** | (2006.01) |
| ***B65D 25/04*** | (2006.01) |
| ***B65D 55/02*** | (2006.01) |

(Continued)

(52) U.S. Cl.

CPC ..... *B65D 55/14* (2013.01); *A61J 1/03* (2013.01); *B65B 7/28* (2013.01); *B65D 11/04* (2013.01); *B65D 21/0209* (2013.01); *B65D 23/00* (2013.01); *B65D 25/04* (2013.01); *B65D 55/02* (2013.01)

(58) Field of Classification Search

CPC ..... B65D 55/14; B65D 55/02; A61J 1/03

See application file for complete search history.

(56) References Cited

U.S. PATENT DOCUMENTS 5,226,539 A * 7/1993 Cheng ..... B65D 83/0454 206/534

5,782,359 A * 7/1998 McAllister ..... B65D 41/06 206/1.5

(Continued)

*Primary Examiner* — J C Jacyna

(74) *Attorney, Agent, or Firm* — Acuity Law Group, P.C.; Daniel M. Chambers

(57) ABSTRACT

Described is a multi-part device for keeping consumables such as dietary supplements in separate, non-contaminatable, individually accessible container compartments. The device of the invention can also be used for storage of other items, as well. The top of the device is removable, has several interconnected lids that are attached and retained to the container portion of the device by a rotable cap, the position of which selects which lid, if any, can be opened by a user. The compartment lids separate the contents stored in the various compartments so as to keep the contents of each compartment from being contaminated by items or materials placed in other compartments or from the environment. The safe can be locked shut by rotating the cap to predetermined positions.

20 Claims, 50 Drawing Sheets

Related U.S. Application Data continuation of application No. 15/024,842, filed as application No. PCT/US2014/060540 on Oct. 14, 2014, now Pat. No. 10,442,592.

(60) Provisional application No. 61/890,939, filed on Oct. 15, 2013.

(51) Int. Cl.

| | |
|---|---|
| ***B65B 7/28*** | (2006.01) |
| ***B65D 21/02*** | (2006.01) |
| ***B65D 8/00*** | (2006.01) |

(56) References Cited

U.S. PATENT DOCUMENTS 7,147,127 B2 * 12/2006 Lepke ..... B65D 83/0454 221/4
7,156,226 B1 * 1/2007 Van Sickle ..... A45C 11/20 206/1.5

* cited by examiner

SUPPLEMENT SAFE AND METHODS OF USE

RELATED APPLICATIONS

This application is a continuation-in-part of U.S. non-provisional patent application Ser. No. 16/579,752, filed 23 Sep. 2019, which is a continuation of U.S. national stage patent application Ser. No. 15/024,842, filed on 24 Mar. 2016, now U.S. Pat. No. 10,442,592, issued 15 Oct. 2019, which is a national stage of PCT patent application no. PCT/US14/60540, international filing date 14 Oct. 2014, now WO 2015/057744, published 23 Apr. 2015, and claims benefit of U.S. provisional patent application No. 61/890,939, filed on 15 Oct. 2013, the specification(s) and drawings of each which is/are incorporated by reference herein in their entirety for any and all purposes.

FIELD OF THE INVENTION

This invention relates to containers for consumable products. More specifically, this invention relates to containers for keeping consumables that are primarily directed to use in the health, exercise, and sports activities. Even more specifically, this invention relates to multi-compartmented containers for measuring and keeping ingredients such as foods and other metabolic and powder supplements separate from one another without the ability of the compartments to open accidentally due to a novel locking mechanism that is applicable to uses other than the disclosed safe.

BACKGROUND OF THE INVENTION

The following description in this Background section includes information that may be useful in understanding the present invention. It is not an admission that any such information is prior art, or relevant, to the presently claimed inventions, or that any publication specifically or implicitly referenced is prior art.

The use of dietary supplements has been a cultural phenomenon for many years. Body builders, runners, gymnast, swimmers, athletes of all sorts including professional sportsman and women have commonly taken dietary supplements to increase physical size and abilities at performing in their chosen sports activities.

However, it has only been in the recent past that sportsmen and women alike have seriously adopted dietary programs as a health conscious and consistent lifestyle wherein they practice regimented dietary routines that include not only a healthy lifestyle, and exercising and eating healthy food, but also taking a multiplicity of dietary supplements to keep their physical status toned at peak performance.

With the knowledge of the benefit of dietary supplements and the many ways in which they affect the body, a field of sports medicine relating to the use and effect of dietary supplements has developed such that knowledgeable sports enthusiasts have learned to self-administer dietary supplement products of all sorts for all reasons. For example, an athlete may take a particular series of supplements during hard workout periods and completely change the type of supplement during low stress periods. Alternatively, if an athlete experiences a minor injury or sickness, he/she will specifically alter their supplement routine to accommodate the present perceived nutritional needs for that particular health challenge. With many supplement routines today, the amounts of the various substances to be used has evolved to taking supplements that are precisely measured and dispensed like a medical prescription program proscribed by a doctor.

With the constantly varying landscape of which supplement is on the menu for the day or week, supplement users have experienced a need for ways to organize the products used in their dietary regimens. Since the world of supplements comprises such things as pills, powders, liquids, solid foods such as candy bar-like nutrition bars, etc., athletes have had to maintain each kind of supplement in different places and containers. For example, the pills, which often include a plurality of pills to be taken over a period of hours, would have to be kept in a pill box of some sort while powders such as protein powders have had to be dispensed from large containers and mixed with water, and liquid form supplements have had to be kept in yet a different carrier, typically the manufacturer's packaging for premade protein and the like drinks. Further, currently the only easy options for supplement enthusiasts are to fill a zip-lock bags with protein and meal replacement powders according to the number and size of servings needed per day. Where multiple servings are required the body builder will have to place the baggies in plastic ware containers. Pill form supplements still must be kept in separate pill boxes. This multiple component situation to taking supplements has resulted in the athlete having to jostle around with the varying resources and subsequent difficulty maintaining carrying through with their supplement programs.

Thus, there is substantial need in the arts for methods and devices for organizing and maintaining supplements and for improving the organization and measurement of the dosages required in a supplement routine. The present invention has industrial applicability in that it provides for measurement of the amount of supplements to be administered and maintains said supplements in a single device in a safe and uncontaminated environment and capable of containing a variety of supplement products including pills, powders and liquids and capable of locking or unlocking container tops on demand.

SUMMARY OF THE INVENTION

In a first embodiment, the current invention comprises a supplement safe wherein the safe is a closable container. In a related embodiment as a safe, the container is lockable via a novel arrangement of a locking cap and container lid elements.

In a second embodiment, the container can have a multiplicity of compartments that accommodate specifically defined volumes for measurement of precise amounts of content. In preferred embodiments, the current invention can comprise any number of lockable containers including a single compartment, a double compartment container, a triple compartment, a four, five, six or even seven compartment safe.

In a third embodiment, the container has the capability of keeping different supplements from contaminating one another by using separate openings for pouring and filling the compartments with such as liquids and powders. In a related embodiment, the compartments are sized to accommodate a standard sized powder scoop that can be stored in said compartment.

In fourth embodiment, the container of the invention comprises a locking system comprising a rotatable dial within a housing that can, depending upon the position to which the cap is rotated, allow any one, or all of the plurality of compartment lids to be opened, or alternatively all compartment lids locked and unable to open. In preferred embodiments, the ability of the invention to either keep the lids locked or open arises from the novel arrangements of tabs which are placed on the rotatable dial (locking cap ridges) and on the inner body of the container itself (locking cap keepers). For example, for a three compartment embodiment, the dial can be rotated such that there are two positions wherein the lids are locked shut, three positions wherein the lids can be opened one at a time, and one position wherein all lids can be opened, the dial removed, and the lid removed from the body of the container. Similarly, for embodiments with any other number of compartments, there will be one dial position wherein the dial can be removed, a position in which each individual compartment can be opened, and at least one position in which no compartment lid can be opened. The set positions of the dial to open or keep shut any compartment(s) can preferably be semi-permanently held in place by ratchet bumps aligning with depressions formed in the locking cap ridges. By semi-permanently is meant that the position will be maintained unless external force is applied to rotate the dial, such as by turning the dial with finger pressure, it being understood that there is enough frictional contact between the dial ridges and the ratchet bumps, and/or the locking cap keepers as herein disclosed to keep the dial maintained in a particular position unless the cap is made to turn by force to a next position wherein the dial ridges and ratchet bumps align so that any particular ratchet bump will abut a dimple in the dial ridges (see below). Positioning of the locking cap keepers and their respective arc lengths about the inner circumference of the main body depend upon the number of divisions between compartments. For example, for a three compartment safe there will be three sets of tabs or locking cap keepers equidistant around the center of the safe while there will be five sets of keepers associated with the inner circumference of the housing for a five compartment version. In a related embodiment, the keepers are positioned along the dividing line between separate compartments. Such geometry is continued to each successive smaller or larger compartment number versions as will be readily understood by one of ordinary skill in the mathematic arts. The tabs comprising the keepers can possess a variety of shapes and arc lengths, such as for example two tab projections spaced apart by between 1 to 20 degrees of arc without a projection between said tabs while the tabs themselves can each be of varying arc length of between 1 and 20 degrees of arc. Further still, the arc sets comprising the tabs need not be constructed so as to have a space with no tab lying in between the tabs but rather can be one arc length spanning an arc length of between 1 and 60 degrees of a 360 degree circle. Moreover, even though the tab set is aligned with the dividing line between compartments, it can be off set with respect to the dividing line. Similarly, the locking cap ridges can be of varying arc length and the plurality thereof can be at least in number the same as number of compartments, i.e., a ridge for each compartment spanning an arc length of between 2 and 90 degrees (depending upon the number of compartments). The locking cap ridges can include both short arc length ridges and longer arc length ridges depending on the number of divided containers. For example, for a three compartment embodiment, there can be three ridges of a longer arc length symmetrically spaced around the dial and two ridges of shorter arc length spaced between the longer arc length ridges. There are only two shorter ridges because the cut out section of the dial is positioned in the area where a short arc ridge would be. For a five compartment version there could be five longer ridges and four that are shorter, each generally arranged symmetrically about the circle. Finally, the ratchet bump recesses are placed at locations that will correspond with the geometry of the ratchet bump placement, generally at the medial line between compartments. As one of skill in the art will recognize, there must be at least one positioning of the dial such that the keeper tabs align with the spaces between the locking cap ridges allowing for the cap to be removed from the housing.

In a fifth embodiment, the dial is capable of being attached to and removed from the container only if it is rotated in a specific alignment relative to the container. The specific configuration of alignment for removal of the lid is dependent upon the number of compartments (one to seven, for example) found in any particular embodiment. In a further preferred embodiment, the lids will not detach from the container body despite the proper alignment without additional prying force, such as by hand power, applied to the lids. In a further preferred embodiment, the prying force is ameliorated by resilient finger/thumb tabs formed into the lid shape.

In another embodiment, the safe can optionally comprise a second container portion which itself can comprise a multiplicity of compartments. The number of second container compartments can be the same number of compartments as the main body but can vary as desired. In preferred embodiments, this second container can be used to store supplements in pill, powder, or other form. In related embodiments, this second "pill tray" comprises attachment elements that provide for the capability to connect the pill tray to the main container body using a twist motion.

In still further embodiments, the safe is shaped with ergonomic hand grip features that allow the holding or carrying the safe in either the right or left hand of the user. With respect to an embodiment comprising one compartment, the shape is somewhat triangular to support griping of the container. In the two container embodiment, the compartments are back to back and each of generally triangular shape. With respect to a three compartment version for example, the overall shape can be a triangular design wherein each compartment comprises a triangular shape with an outer facing corner of said triangle that forms a natural pouring spout. Regardless of number of compartments, whether 1, 2, 3, 4, 5, 6, or 7, the individual containers are designed such that they possess a useful corner shape to assist the pouring of supplement via a corner that is rounded or bull-nose in design as are all inside and outside corners of each container which provide as well for easy cleaning.

In additional embodiments, the invention is designed so as to be able to stack, one upon the other due to fin elements on the bottom end of the container as well as indentions on the lids that accommodate said fins. Further, the stacking is supported by the locking cap being able to fit within the recess of the bottom of the safe resting on top of the other.

In yet further embodiments, the invention lids comprise a pliable material, such as rubber, plastic, etc., and comprises thumb and finger grips.

Other features and advantages of the invention will be apparent from the following drawings, detailed description, and appended claims.

BRIEF DESCRIPTION OF THE DRAWINGS

These and other aspects will now be described in detail with reference to the following drawings. Unless otherwise indicated, it is understood that the drawings are not to scale, as they are intended merely to facilitate understanding of the invention as opposed to specific dimensions, etc. In the drawings, like numbers in two or more drawings represent like elements.

FIG. 34 shows the locking cap in position to disengage the main chamber body.

DETAILED DESCRIPTION OF THE INVENTION

As those in the art will appreciate, the following description describes certain preferred embodiments of the invention in detail, and is thus only representative and does not depict the actual scope of the invention. Before describing the present invention in detail, it is understood that the invention is not limited to the particular device arrangements, systems, and methodologies described, as these may vary. It is also to be understood that the terminology used herein is for the purpose of describing particular embodiments only, and is not intended to limit the scope of the invention defined by the appended claims.

Figure 1:
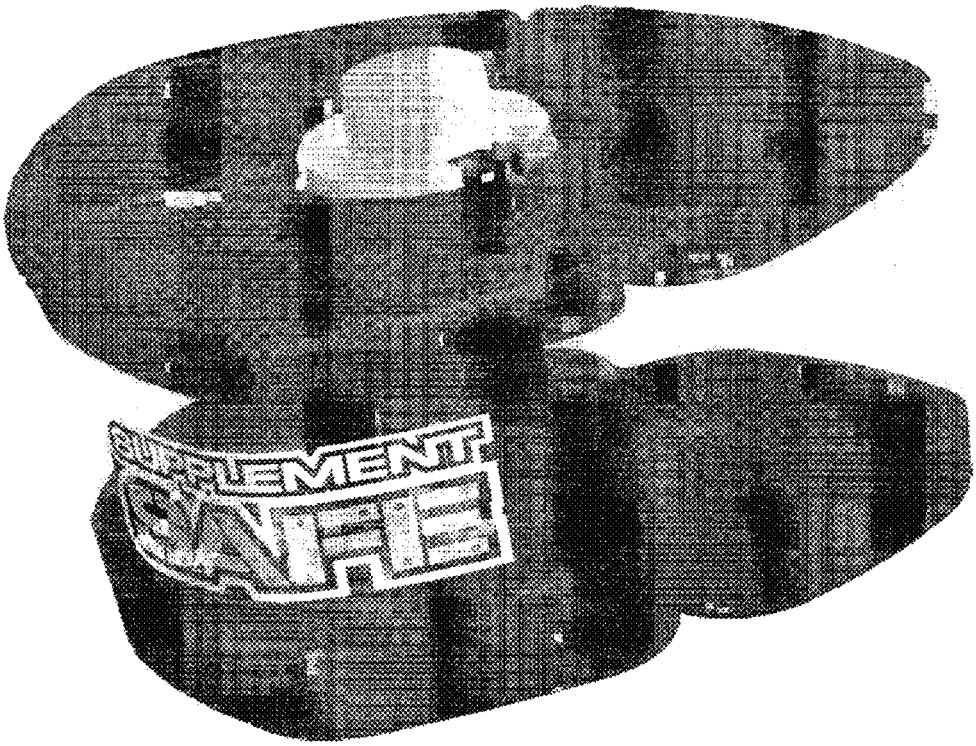
FIG. 1 is a three dimensional rendering of a triple container version of said supplement safe.
Figure 2:
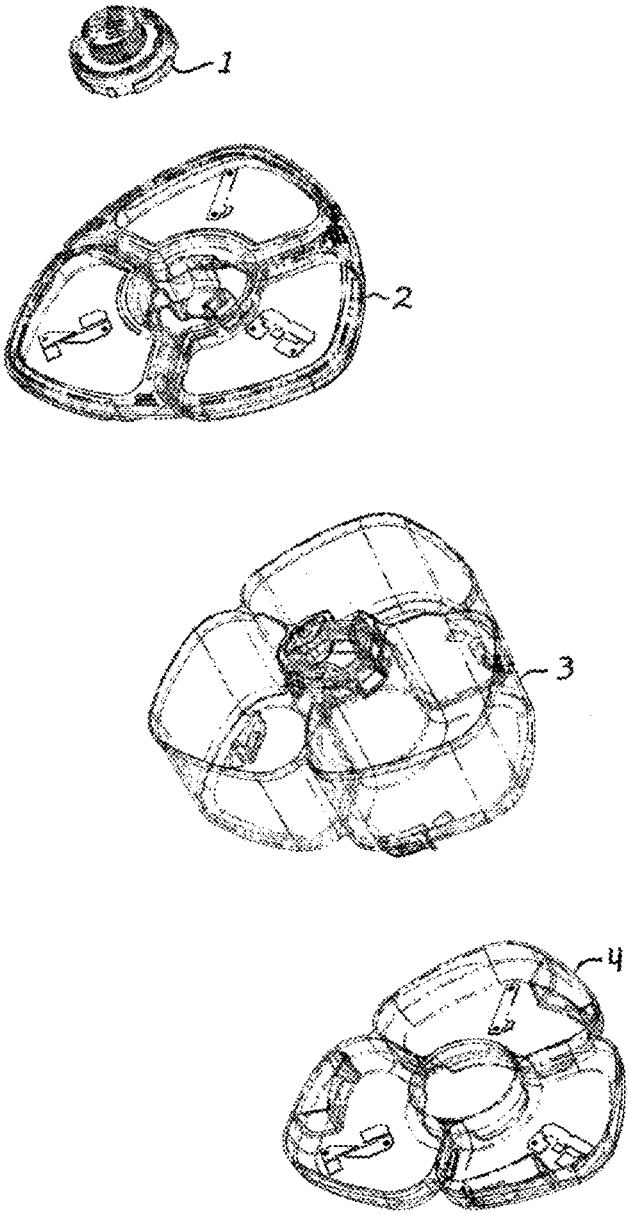
FIG. 2 is a drawing showing an exploded view of a triangular embodiment, the apparatus parts comprising a rotary locking cap 1, multi lid element 2, main body comprising individual compartments 3, and bottom supplement tray 4.

Turning now to one example of the invention which is exemplary of the various invention safe styles comprising different numbers of individual compartments, namely the three container embodiment of the supplement safe 10 as disclosed in FIG. 1, the invention comprises a lockable multi-compartmented and multi-purpose container designed to achieve multiple functions. The supplement safe, whether the design is for a single compartment, double, triple, four, five, six or seven chamber version, includes each of the following elements, as generally shown in FIG. 2, namely a locking cap 1, multiple lid element 2 (excepting the single compartment version), main container body 3, and optionally, a multiple compartmented lower tray 4 (the single compartment version can have a single compartment lower tray or multi compartment). As will become clear, each of these elements work together to form a complete closed supplement container as a whole of which the main container compartments can be locked or unlocked by a novel locking mechanism comprising interconnecting spaced tabs on both the lock dial and container body that function by sliding alignment of the tabs of each of said dial and body to respective positions that allow for one or another locking arrangement as between the different compartments.

Figure 3:
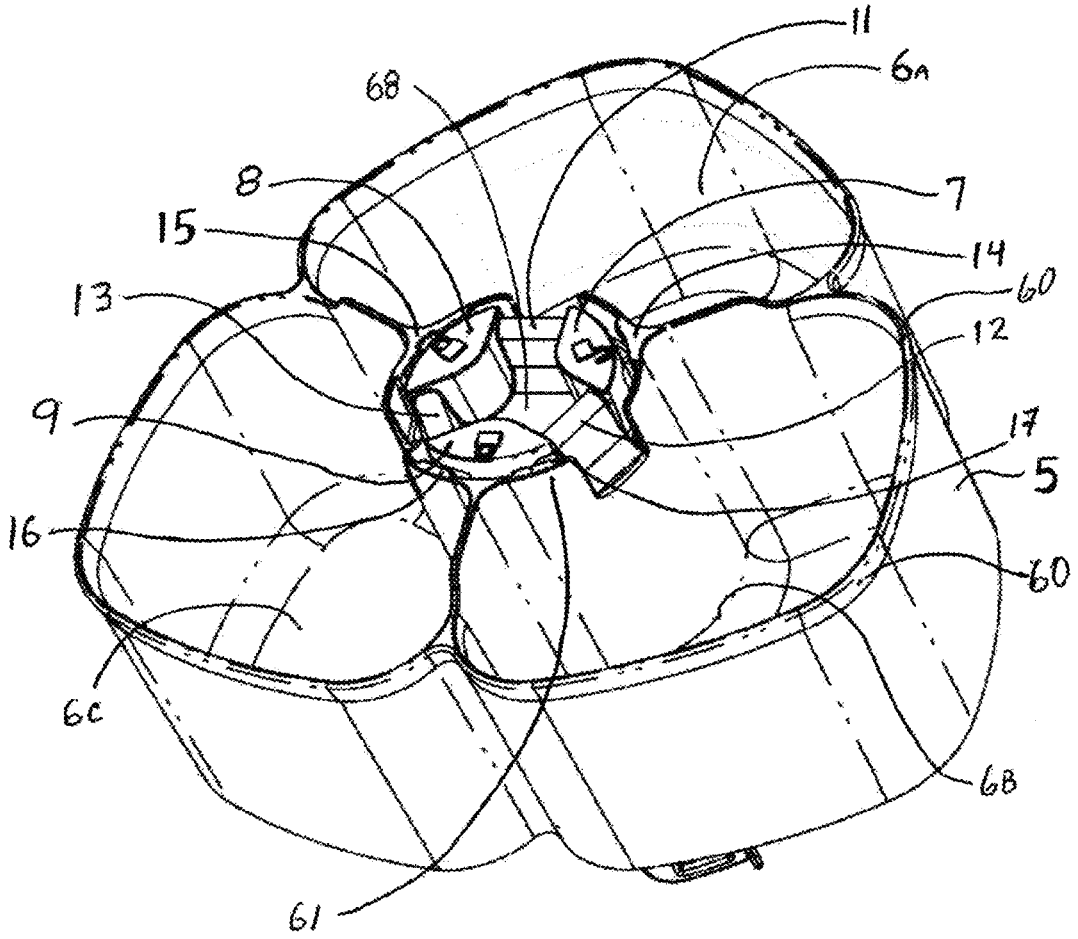
FIG. 3 is a three dimensional view looking at the main body of the triple compartment embodiment style from the top looking into the inside. Also depicted are elements in the central portion of the device that comprise part of the locking mechanism and lid retention.

As shown in FIG. 3, the main body of the container 5 has several preferred features, specifically, the designed shape of the overall container being generally triangular with, in the presently displayed embodiment, three separate chambers 6A, B, and C for storing dietary supplement materials such as protein powders and the like. In particularly preferred embodiments, the separate chambered portions are further shaped in respect to the overall triangularity, each with rounded outer corners 60, including the outer corners of abutting chambers that provide an ergonomic benefit to the user in that the outer corners are providing for a direct cross-sectional grip pressure application of the hand and placed so that either a left or a right handed person can grip and hold the container or grip and rotate the locking cap and/or the lower tray without difficulty. The outer facing corners of each compartment of the container further are shaped with rounded corners to provide a natural pouring spout that is easy as well to clean. These features are also consistent with the single chamber, double chamber, four, five, six and seven chambered embodiments. As one of skill in the geometric arts, it is clear that the overall shape of the four chambered embodiment will be square-like with requisite rounded corners, the five chambered embodiment will be pentagonal-like, the six chambered will be hexagonal-like, and the seven chambered will take on a heptagon-like shape, each with common features that assist ergonomic utility.

Additionally, for each compartment section of the container, numbering can be molded, etched or otherwise notated into at least one outer surface to identify each chamber which can be used for denoting the supplement in that compartment. The numbers can also be used directly as indicating the sequence in which each supplement is to be taken.

Examining the invention in yet more detail, as further shown in FIG. 3 for the three chambered version, the main body comprises a multiplicity of chambers. As depicted in FIG. 3, there can be, for example, three separate chambers. In this embodiment as well as embodiments with other numbers of chambers, each of the chambers are designed to have a set volume. In particularly preferred embodiments, the set volume can be one half cup measurement. In alternate embodiments, the volume can be one cup or more, or any measurement in between. Further, the design size of one half or one cup with a cylinder of a set diameter allows the compartment division walls to be sized to accommodate a standard scoop used in the powdered supplement industry. Specifically, when filling the container with a powder, the multi-lid element is dislodged from the main container body and an appropriate amount of powder is dispensed into the chamber using the standard scoop. With the scoop size set at a particular diameter, the powder can easily be poured into the chamber without powder spilling into adjacent chambers. Sized in this way, the compartments can accommodate an industry standard sized scoop to be stored in said compartment. Further, the compartments are designed so as to have rounded internal corners. This rounded or bull-nose structure provides for easy cleaning of the interior of the compartments as well as mixing of contents, if desired.

In other alternate embodiments, the supplement safe can be made with more or less than three compartments such as one, two, four, five, six, or even seven separate compartments wherein each or any one of the chambers, such as the three chambered version depicted in FIG. 3 are, for example in an alternate embodiment, further divided in half by a dividing wall (not depicted). Additionally, even with each of the three chambers being divided in half, the overall shape is not affected, such as for example, the triangularity can be maintained in the three chambered version with the corners between the newly divided chambers also being rounded leaving the outer triangular shape made for gripping with the hand. Where there are more than three chambers, it will be understood by one of skill in the art that the main cylinder can be increased in diameter so that the resulting chambers will maintain the measured sizes of one half or one cup and allow for use of the standard measuring cup to be used. It will also be understood that to increase the volume from one half to one cup, without an increase in cylinder diameter or number of chambers greater than three, the length of the cylinder can be increased to accommodate the doubling in volume. Further, the respective geometric shapes (square, pentagonal, hexagonal, and heptagonal) can be maintained with the outer corners of each compartment being rounded for easier handling.

As further illuminated in FIG. 3, the main body is designed at its upper central area to comprise, for the three chambered version as depicted, three support towers 7, 8, and 9, that rise from a flooring 25 (FIGS. 5, 6) that spans the central core 24 (FIG. 4) of the main container body. The three support towers are situated so as to span and be aligned symmetrically with the division walls between the three separated chambers. This positioning and spacing arrangement is similar for each of the other embodiments of lesser or greater number of chambers. For example, the single chambered version will have a tower on each chamber wall that abuts the dial and a cylindrical core structure that surrounds the dial with requisite tabs that hold the dial in place. The two chambered version will have two towers also, the four chambered version having four towers, etc. The towers are separated from the inner container walls by a gap sufficient to insert the locking cap as further explained below. The towers further function by their positioning to either provide for locking the container or completely opening and disassembling the locking cap and multi-lid element from the main container body, depending upon its rotated position. Further still, each of the top of the towers can have molded therein symbols, such as closed and opened lock icons, to indicate positioning of the locking cap for locking or said disassembly.

Situated between each of said three towers in the three compartment version and connected therewith are lid-band tensioning risers 11, 12, and 13. The lid-band tensioning risers also rise up from flooring 25 but are designed to terminate their height below the tops of the three support towers. In the single compartment embodiment, there is one lid-band tensioning riser, two risers in the two chamber, four risers in the four compartment embodiment, five risers in the pentagonal, six risers in the hexagonal, and seven in the seven compartment embodiment. In preferred embodiments, the tensioning risers force the lid-bands 50, 51, and 52 (FIG. 14) of the multi-lid element 46, as depicted for the three compartment version, when assembled into the main container body 5, to travel from their respective connections to the central king post 53 up and over the top of the tensioning riser and when the locking cap is also in place, the lid-bands will, depending upon the positioning of the locking cap, either be forced to bend down around the bottom of the locking cap, or be free from contact with the locking cap bottom. The net effect of the lid-band risers 11, 12 and 13 is to cause each of the lids 47, 48, and 49 to be restricted in the ability to be removed from the main container body by causing a net "shortening" effect on the lengths of each lid band. With the lid bands restricted underneath the locking cap, the lid cannot be removed from the compartment opening of the main container because the band is holding the lid tight. Alternatively, when the locking cap is rotated such that the lid band is exposed, the lid can be opened and lifted up and out of the way of the compartment opening. Each embodiment comprising the different number of compartments has the same or similar feature regarding the lid-bands, their construction and their manner of being bent down over the lid-band tensioning risers by the locking cap. In the single container version, the central end of the lid-band can be removably affixed to the central core bottom 68 (FIG. 3) or to a central king post which would fit into the underside of the locking cap, for examples. In the two compartment and higher, the lid-bands are constructed similar to that of the three compartment version with lid-bands connected centrally with a king post element.

In additional features of the main container body, there are spaced projections (locking cap keepers), as shown for the three compartment embodiment, 14, 15, 16, and 17 (FIGS. 3, 5) that in a first aspect function to keep the locking cap in place by the undersurface of said keepers engaging the upper surface of spaced projections designed about the cap circumference, and second, are designed asymmetrically with respect to one another (in conjunction with their matching asymmetrically placed cap projections) so as to provide for maintaining the locking cap in place except for a single rotational positioning of said locking cap wherein said cap will disengage from the main container body. More detailed explanation of the locking cap and keeper alignment are provided below for the three compartment version but the same or similar arrangement is intended for each of the one, two, four, five, six and seven compartment versions, though the spacing arrangement of the keepers are unique for each version as one of ordinary skill in the mechanical arts will readily understand. Positioning of the locking cap keepers and their respective arc lengths about the inner circumference of the main body depend upon the number of divisions between compartments. For example, for a three compartment safe there will be three sets of tabs or locking cap keepers equidistant around the center of the safe while there will be five sets of keepers associated with the inner circumference of the housing comprising the main container, each set positioned along the dividing line between separate compartments. Such geometry is continued to each successive smaller or larger compartment number versions as will be readily understood by one of ordinary skill in the mathematic arts. Further, such organization allows for the spacing and number of ratchet bumps which generally can be formed at the dividing line between compartments, and their interaction with the ratchet recesses formed into the locking cap ridges.

Figure 4:
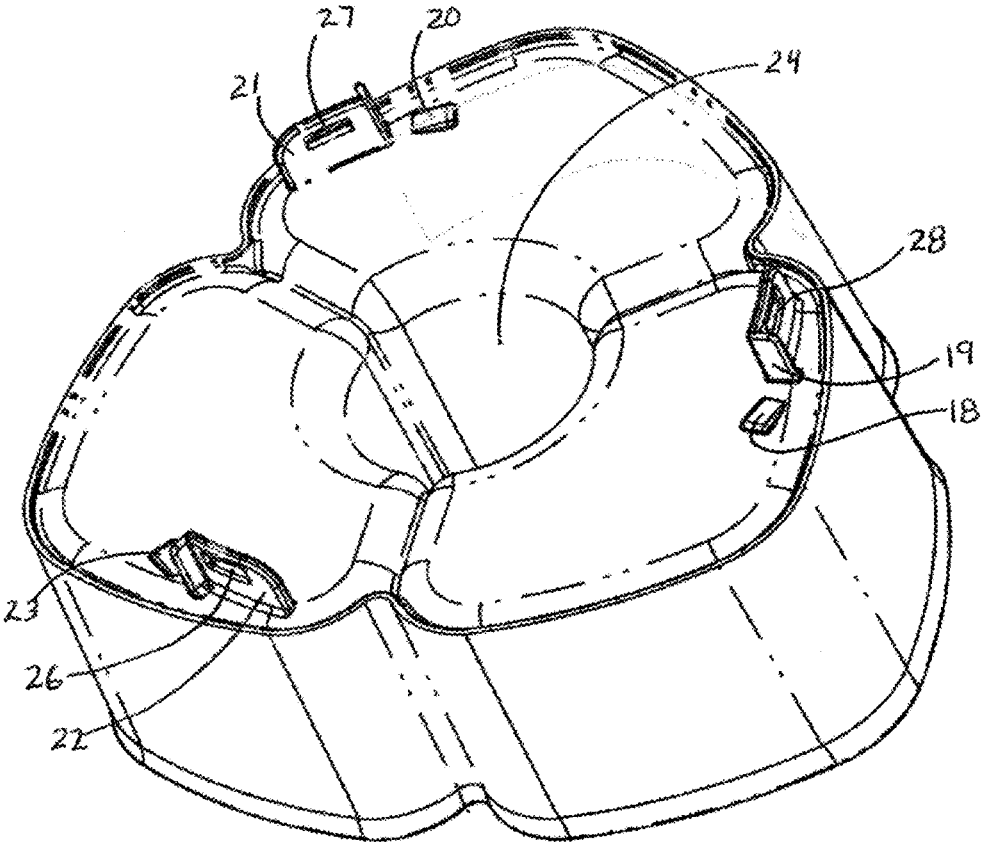
FIG. 4 is a three dimensional bottom view of the triple compartment embodiment showing tab features that are used for attaching the pill tray.
Figure 11:
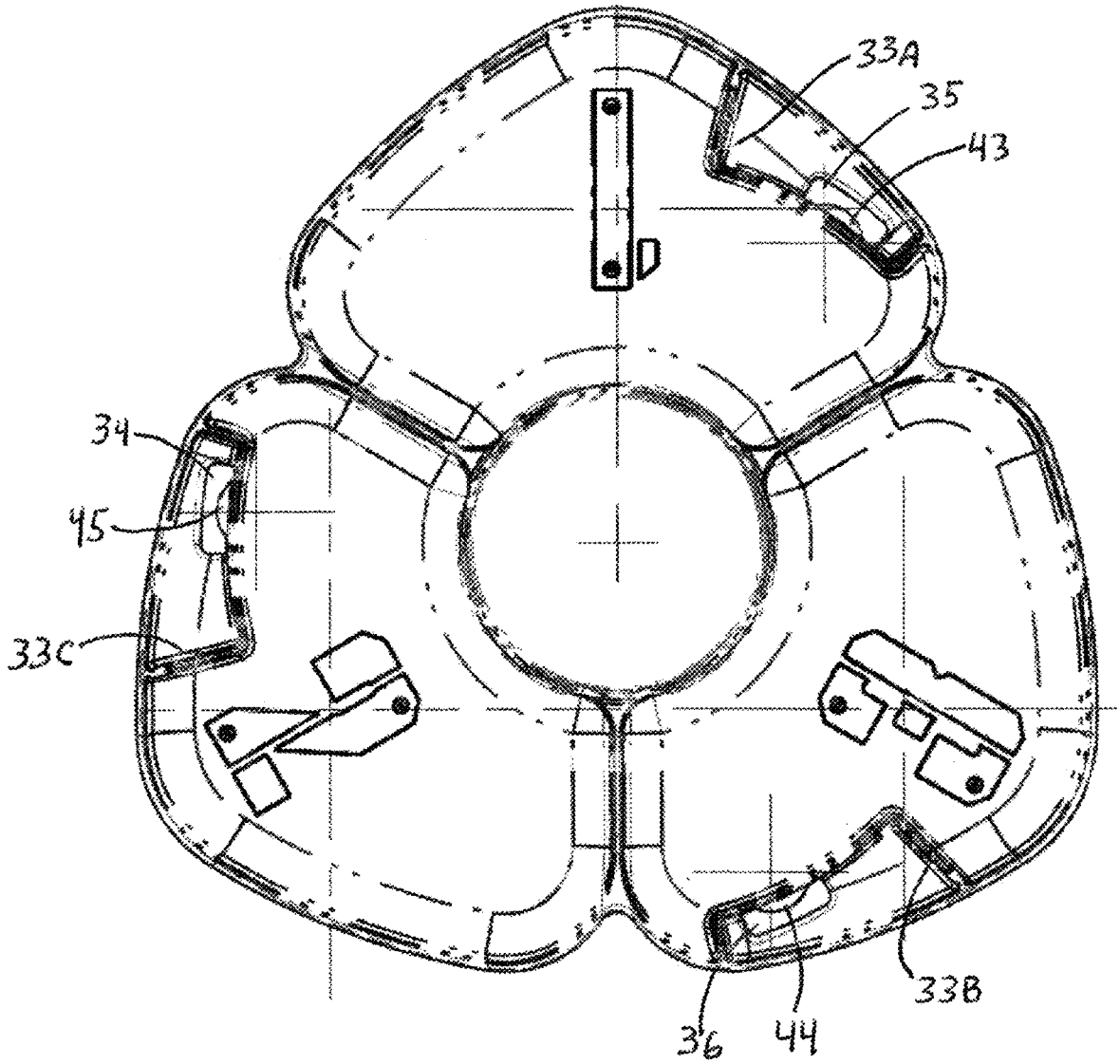
FIG. 11 is a cross sectional top view of the lower supplement tray of a triple compartment embodiment.

Turning now to FIG. 4, the underside of the main container body 5 comprises spaced lower tray 4 securing tabs 19, 21, and 22 that work in conjunction with friction wedges 18, 20, and 23. Each version can possess the same number and spacing of said elements but there can be more if desired. The securing tabs 19, 21, and 22 comprise slots 26, 27, and 28 that function to hold the lower tray to the main container body 5 via the lower tray slot tabs 43, 44, and 45 (FIG. 11). In operation the lower tray is attached to and removed from the main container body by first aligning the securing tabs 19, 21, and 22 with lower tray securing tab boxes 33A, 33B, and 33C (FIG. 9), followed by abutting the tray to the main body and slightly twisting the tray against the bottom of the main body. By this motion the lower tray slot tabs 43, 44, and 45 slip into securing tab slots 26, 27, and 28, and the friction wedges 18, 20, and 23 provide for tightening pressure of the lower tray slot tabs against the securing tab slots by their sliding against a portion of securing tab boxes top edge as will be readily understood by one of skill in the mechanical arts. Further, the tray is actually twisted on just enough so that the friction wedge end slips past the edge of the securing tab boxes and locks the tray in place such that enough rotational pressure must be applied to reverse twist the tray to slip past the friction wedge to remove the lower tray from the main container.

Figure 5:
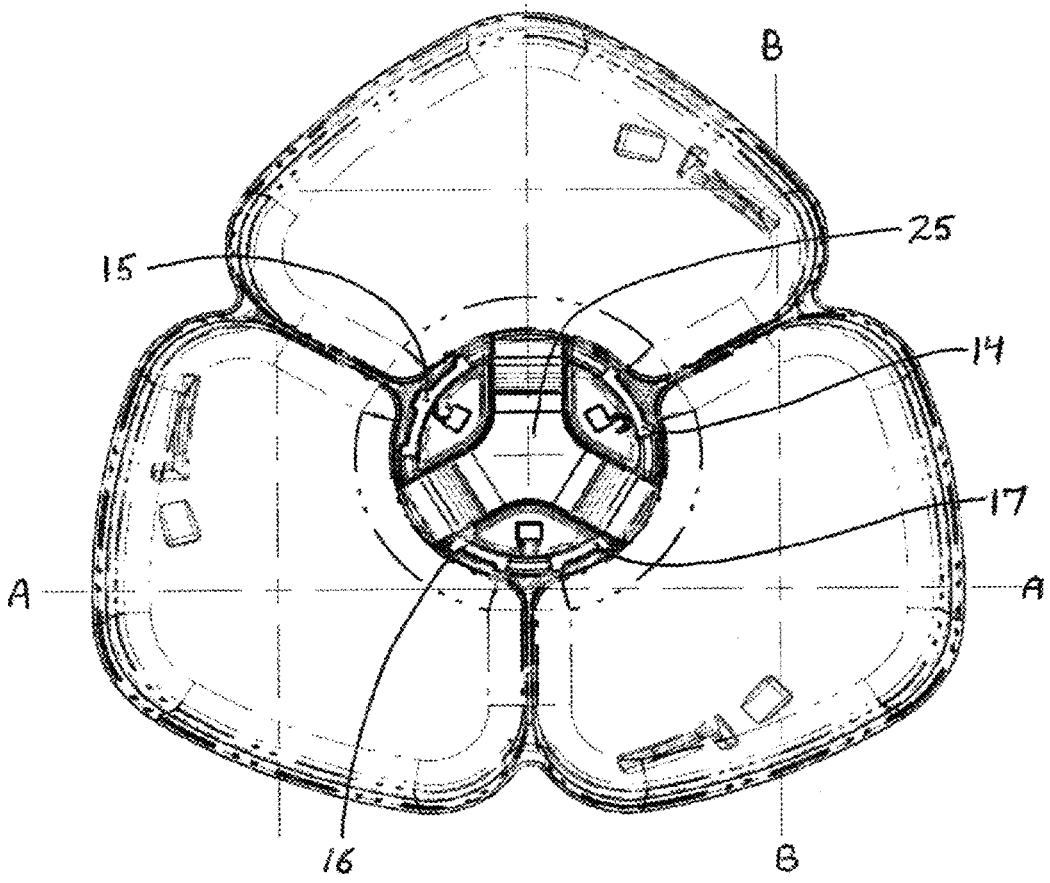
FIG. 5 is a cross sectional top view of the main compartment body of a triple compartment embodiment showing positioning of spaced keeper elements that secure the rotary locking cap.
Figure 6:
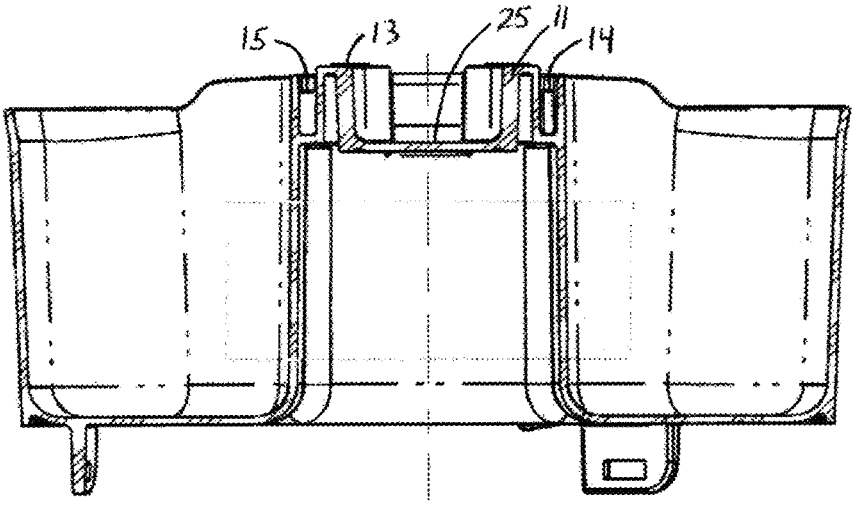
FIG. 6 is a cross sectional view from perspective A-A shown on FIG. 5 showing the inside rounded bottom corners of the compartments.
Figure 7:
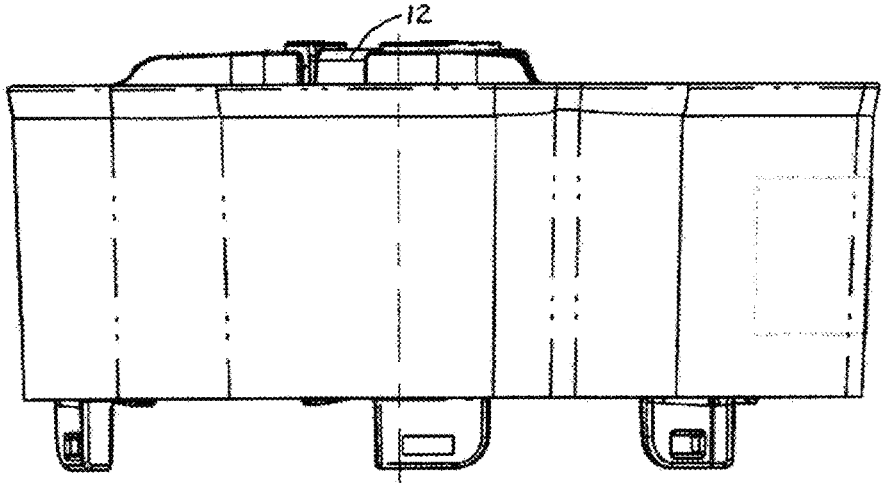
FIG. 7 is a cross sectional view of the main compartment body from perspective B-B shown on FIG. 5.
Figure 8:
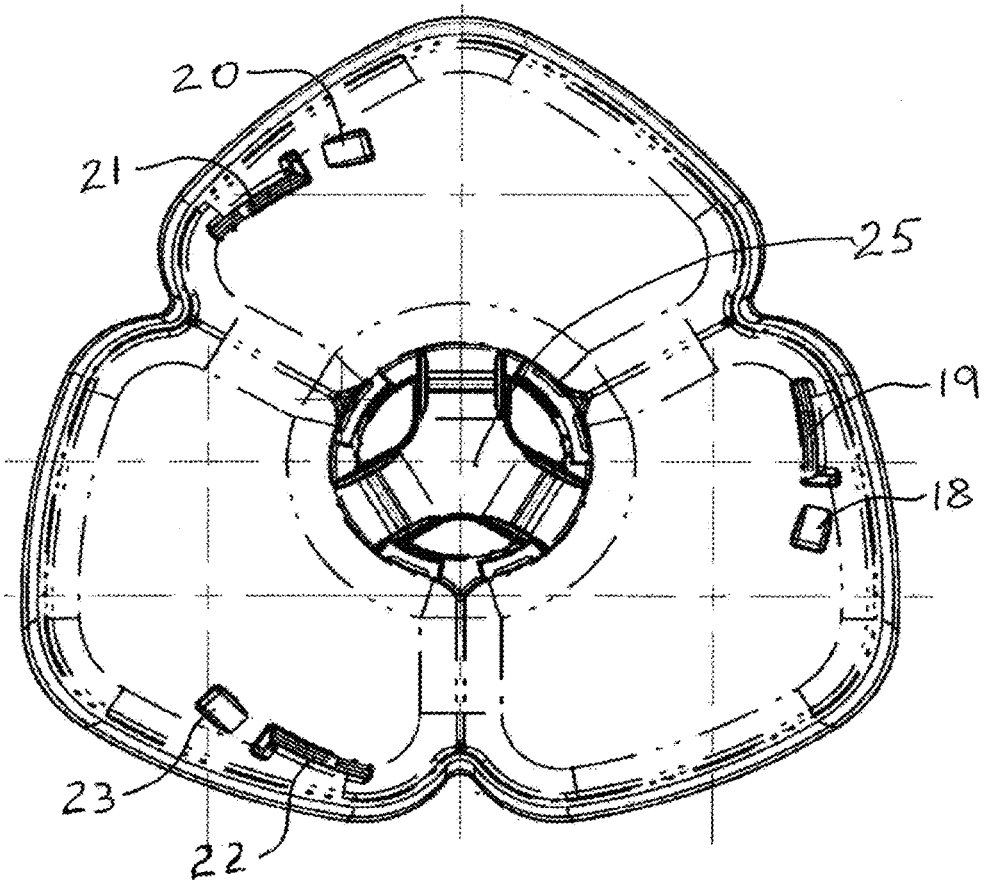
FIG. 8 is a cross sectional view from the bottom of the main compartment body of a triple compartment embodiment showing among other features the central elements comprising the underside of the rotary cap keepers and positioning of the lock elements for connecting the lower supplement tray.

A top view of the main container body for the three compartment version is provided in FIG. 5. As is visible, the locking cap keepers 14, 15, 16, and 17 are asymmetrically spaced about the inner circumference of the individual compartment sides. FIGS. 6 and 7 reveal two aspects of the main container body from perspectives A-A and B-B of FIG. 5, respectively, and showing relative positioning of elements such as locking cap keepers 14 and 15, and lid band risers 11, 12, and 13, and further still flooring 25 that supports the towers and risers. Similarly, FIG. 8 is a bottom view of the main container body showing relative positioning of the securing tabs 19, 21, and 22 and friction wedges 18, 20, and 23.

Figure 9:
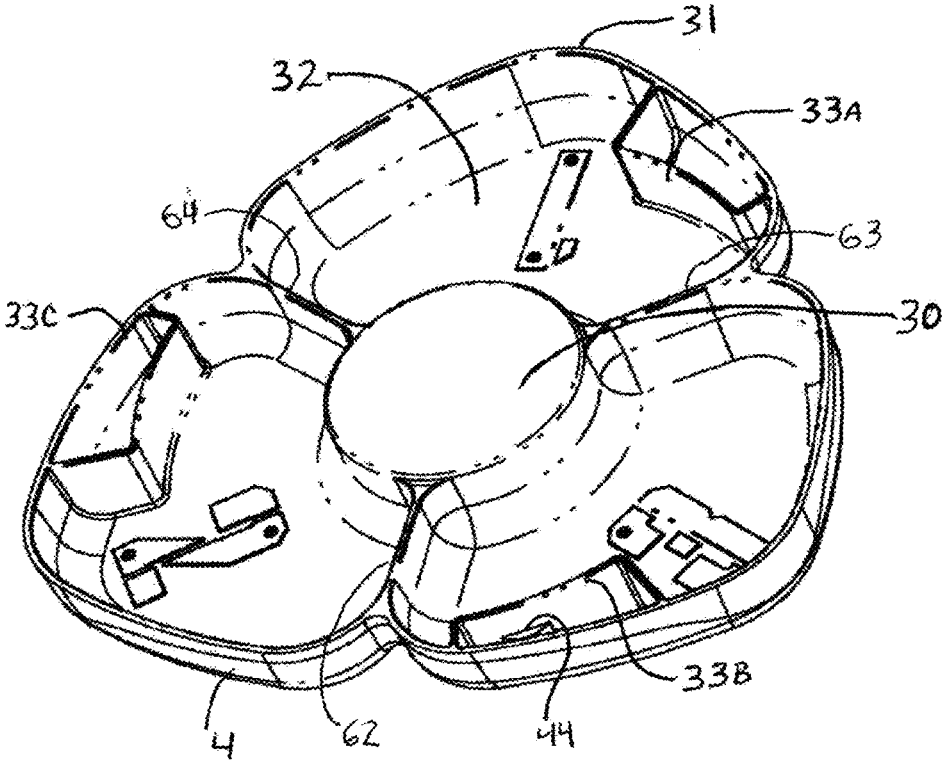
FIG. 9 is a three dimensional view of the lower supplement tray of a triple compartment embodiment showing that the compartments possess rounded corners.

Turning now to the lower tray 4, as depicted in FIG. 9, the bottom section comprises a multi-chambered interior by dividing walls 62, 63, and 64 and wherein each chamber is numbered. For supplement safe versions with one, two, four, five, six and seven compartments, the same attributes can be included. Additionally, each tray section for the three compartment version comprises a securing tab box (33A, 33B, and 33C) into which securing tabs 19, 21, and 22 loosely fit such that as the tray is rotated slightly, the lower tray slot tabs 43, 44, and 45 slip into securing tab slots 26, 27, and 28, and the friction wedges 18, 20, and 23 provide for tightening pressure of the lower tray and locking against the bottom of the main container body. Such tab boxes and securing tabs can be associated with each chamber for the one, two, four, five, six and seven compartment embodiments or can be lesser in number for each of said embodiments but in any case they are intended to be spaced symmetrically. Generally, in use, the bottom section is intended for keeping pill form supplements. Thus, when the user wants to access the pills from one of the chambers, they only need to apply slight muscle pressure to twist the tray portion relative to the main compartment body and the tray will disengage from the main body.

Figure 10:
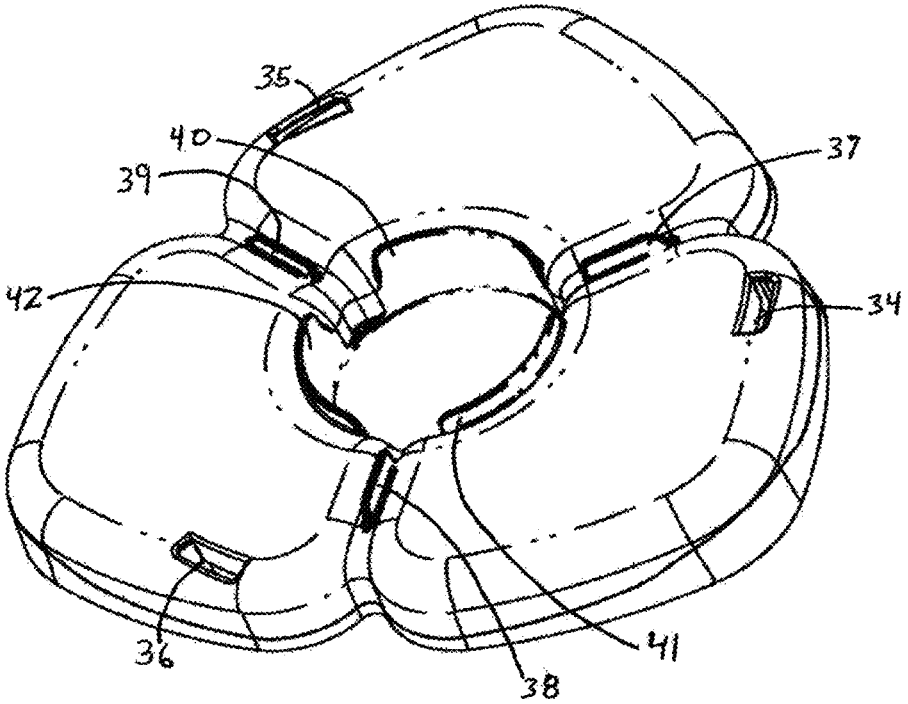
FIG. 10 is a three dimensional view of the underside of the lower supplement tray of a triple compartment embodiment.
Figure 12:
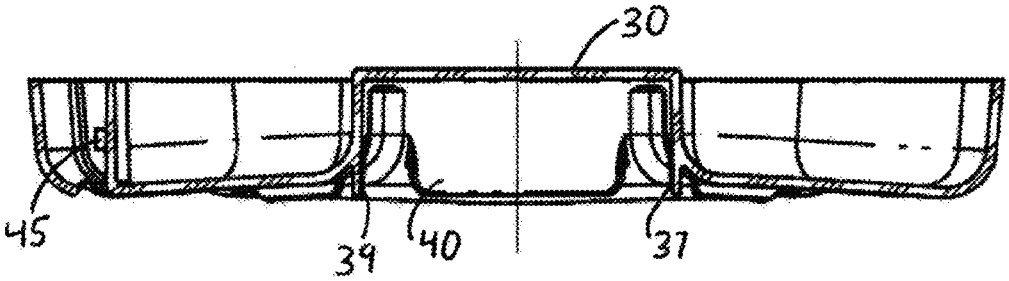
FIG. 12 is a cross section of the lower supplement tray showing fin elements that function to enable stacking of the supplement safes upon one another.
Figure 13:
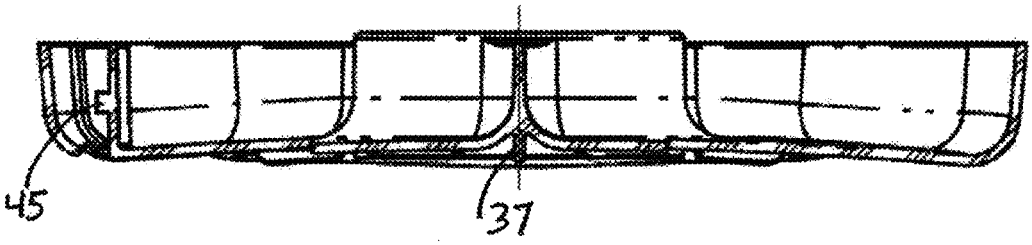
FIG. 13 is a cross section of the lower supplement tray showing arrangement of one fin element situated between tray compartments.

In still further embodiments, the bottom tray 4 further comprises, for the three compartment embodiment, as depicted in FIG. 10, fins 37, 38, and 39 situated between each compartment protruding from the underside of the tray, as well as arc projections 40, 41, and 42, protruding from the inner circumference of the container walls. Both the fins and arc projections are designed to assist the vertical stacking of completed supplement safes. In operation the fins align into the spacing between adjacent compartment lids while circumferential projections fit into the spacing between the locking cap and the inner circumference of the lids. Other features of the bottom tray comprise a central surface 30 that has a diameter dimensioned sufficient to span the diameter of main container body central cavity 24 (see FIG. 29) thus maintaining the isolation of contents of each tray compartment. FIGS. 12 and 13 show further aspects of said fins and circumferential projections. Such projections can be formed in similar locations for each other embodiment of different numbers of compartments.

Figure 14:
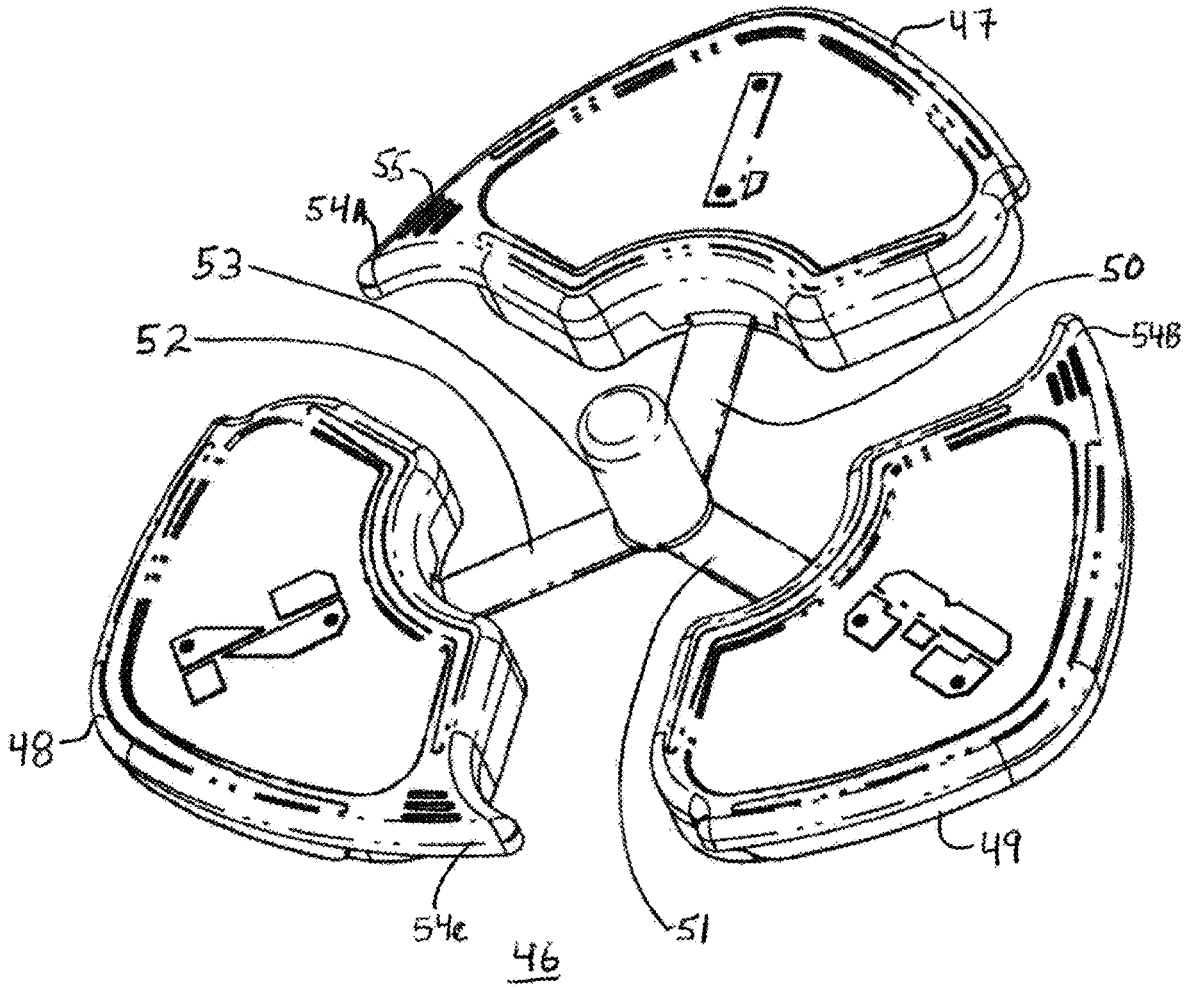
FIG. 14 is a three dimensional view of the multi lid element for a three compartment safe showing resilient lid bands connected to a central king post.
Figure 15:
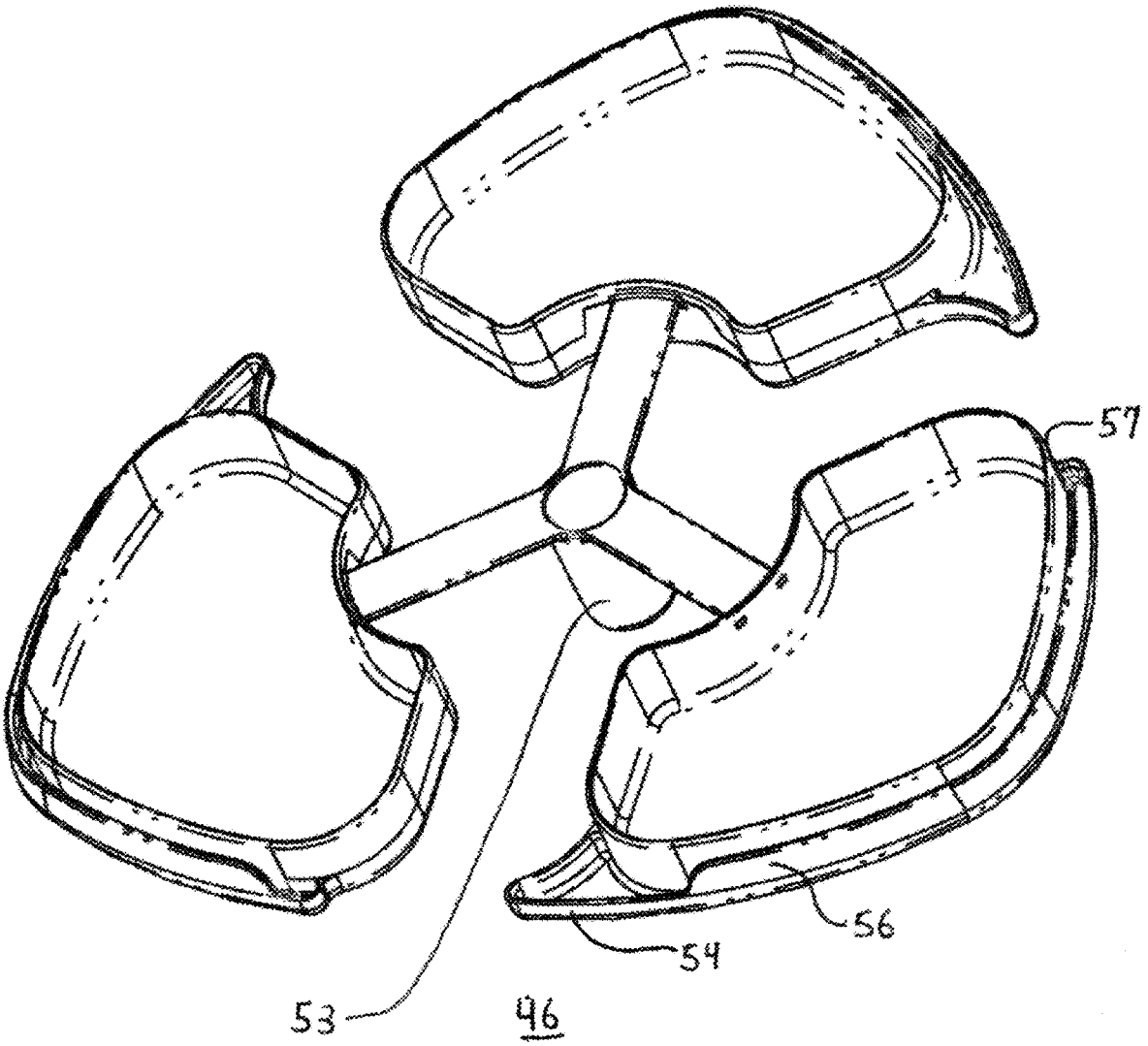
FIG. 15 is a three dimensional view of the underside of the multi-lid element showing arrangement of lid edge seal for a triple compartment embodiment.

Regarding multi-lid element 46 as shown in FIG. 14, the lid element comprises a central king post 53 comprising a height from its base sufficient to contact the undersurface of the locking cap when the lid element is seated into the main container central core 68 (FIG. 3). Such contact provides for, in part, for forcing lid bands 50, 51, and 52 to be fixed as to their centrally oriented position and aligned to run parallel to and up and over the top of the lid band risers 11, 12, and 13. In further embodiments, the lid band lids 47, 48, and 49 are formed so as to provide for at least one seal and preferably a double seal meaning that the lid lip edges can, depending upon embodiment combination employed, push onto the top open edge of the container compartment from one side (such as the inner top surface or outer top surface), or preferably be able to push onto both the inside and outside lip of the compartment opening. For example, as shown in FIG. 15, the underside of the multi-lid element 46 is shown wherein each lid comprises inner seal 57 and outer seal 56. Preferably, the lid comprises a double seal around the complete circumference of each isolated compartment. Further novel features of the lids includes thumb/finger grip wings 54A, B, and C which provide for not only easy leverage to work open the lid from the compartment but is symmetric with the triangular design in that the grips are tucked into the architecture of said triangle so as to not be easily snagged by a foreign object and resist opening inadvertently. As one of skill in the art will recognize, the multi-lid element can be constructed of any useful resilient material which resiliency can range from rigid plastic to soft pliable rubber like materials. The king post, inner and outer seals, and grip wings all can be similarly designed into one, two, four, five, six, and seven compartment versions as is easily understood by one of skill in the arts.

Figure 16:
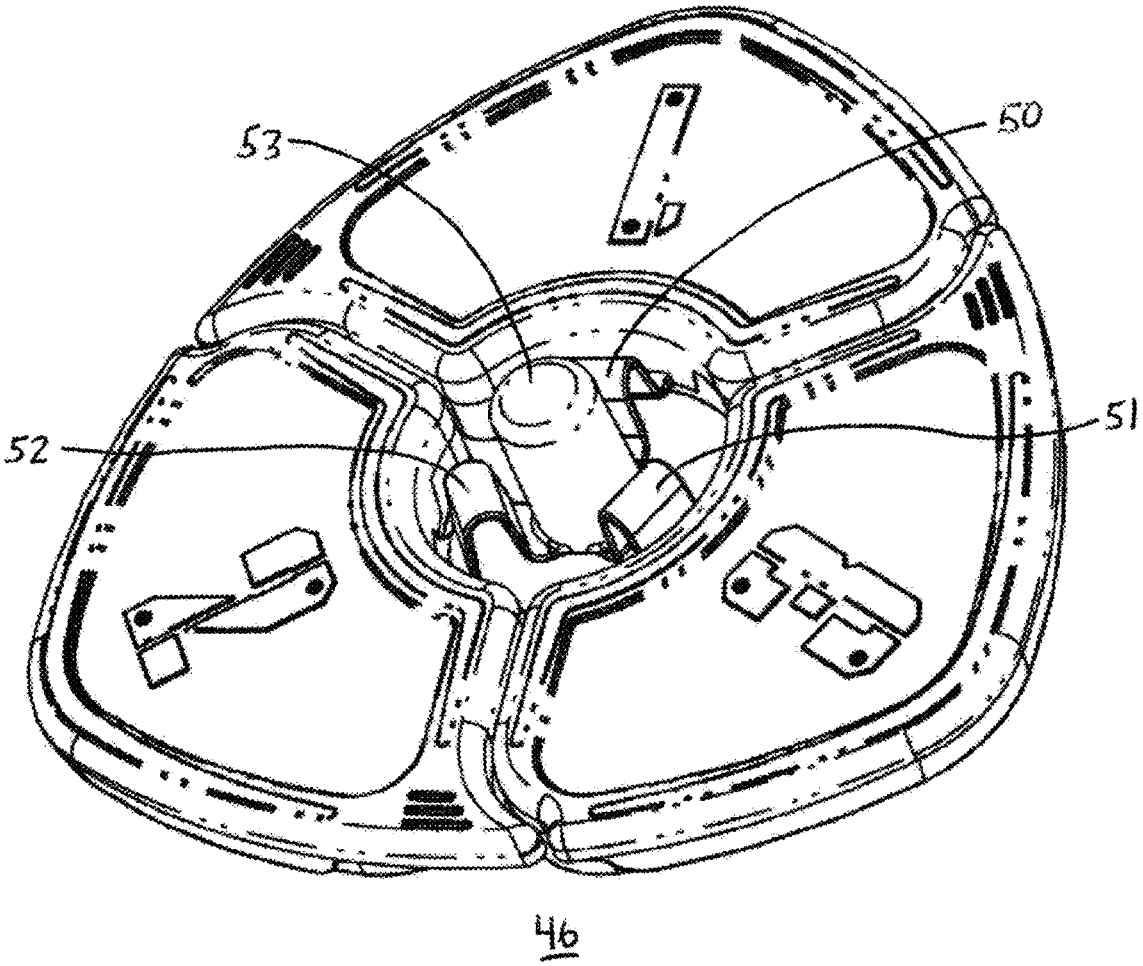
FIG. 16 is a top cross sectional view showing the relative lengths of the resilient lid bands before instillation on to the main compartment body for a triple compartment embodiment.
Figure 17:
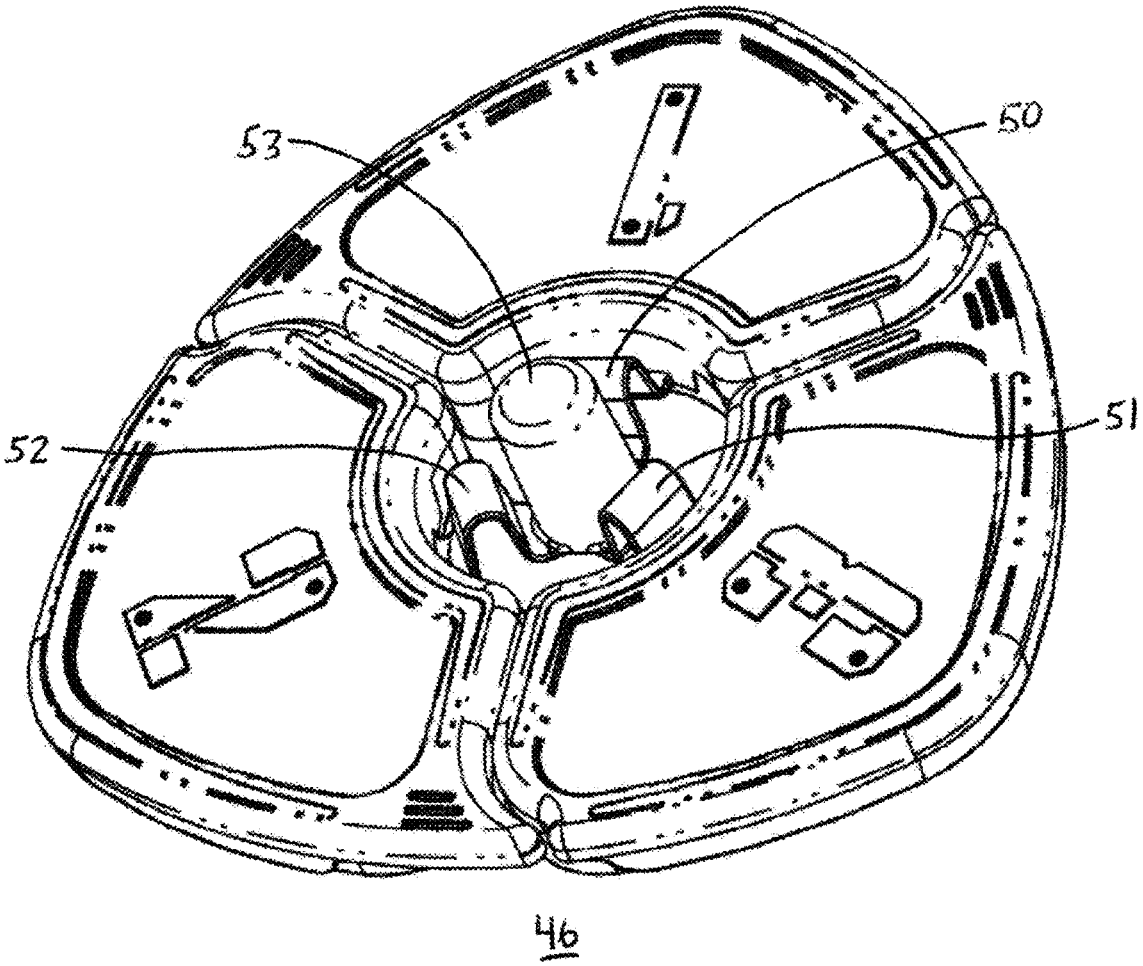
FIG. 17 is a three dimensional view of the multi-lid element arrangement as installed onto the main compartment body. As shown, the resilient lid-bands bend up and over central elements of the main compartment body. This is a triple compartment embodiment but this lid-band feature is the same with respect to safes comprising one, two, three, four, five, six or even seven compartments wherein each lid band connects at a central position with a king post.

FIGS. 16 and 17 depict essential features of the multi-lid element 46 for the three compartment embodiment. Specifically, lid bands 50, 51, and 52 are manufactured to a length spanning between king post 53 and inner edge of each lid element such that when the multi-lid element 46 is seated into the main container body, the lid bands will be able to run up and over the lid-band risers down the outer surface of the lid band risers and around the bottom of the locking cap's outer circumference and back up to the band's connecting point to the inner portion of the lid. FIG. 17 depicts the idealized curvature or folding of the lid bands with the locking cap and risers not shown as will be for any embodiment of a particular numbers of compartments. The natural outcome of this arrangement is that the lids are forced to be kept close to the main container body. Only if the locking cap is rotated to an appropriate opening position will the lid band be exposed from under the locking cap and be free to allow the lid to be pushed off of the compartment and moved up and away from the compartment opening.

In alternate embodiments, the main container body can be designed so as to allow for means to attach the center facing end of the lid-band to the inner bottom of the lid-band risers instead of a king post 53. Thus, as is understandable to one of ordinary skill in the arts, the safe can be constructed in numerous ways to effect the same outcome of straps connected to the lids to hold them in place with respect to the compartment top openings.

Figure 18:
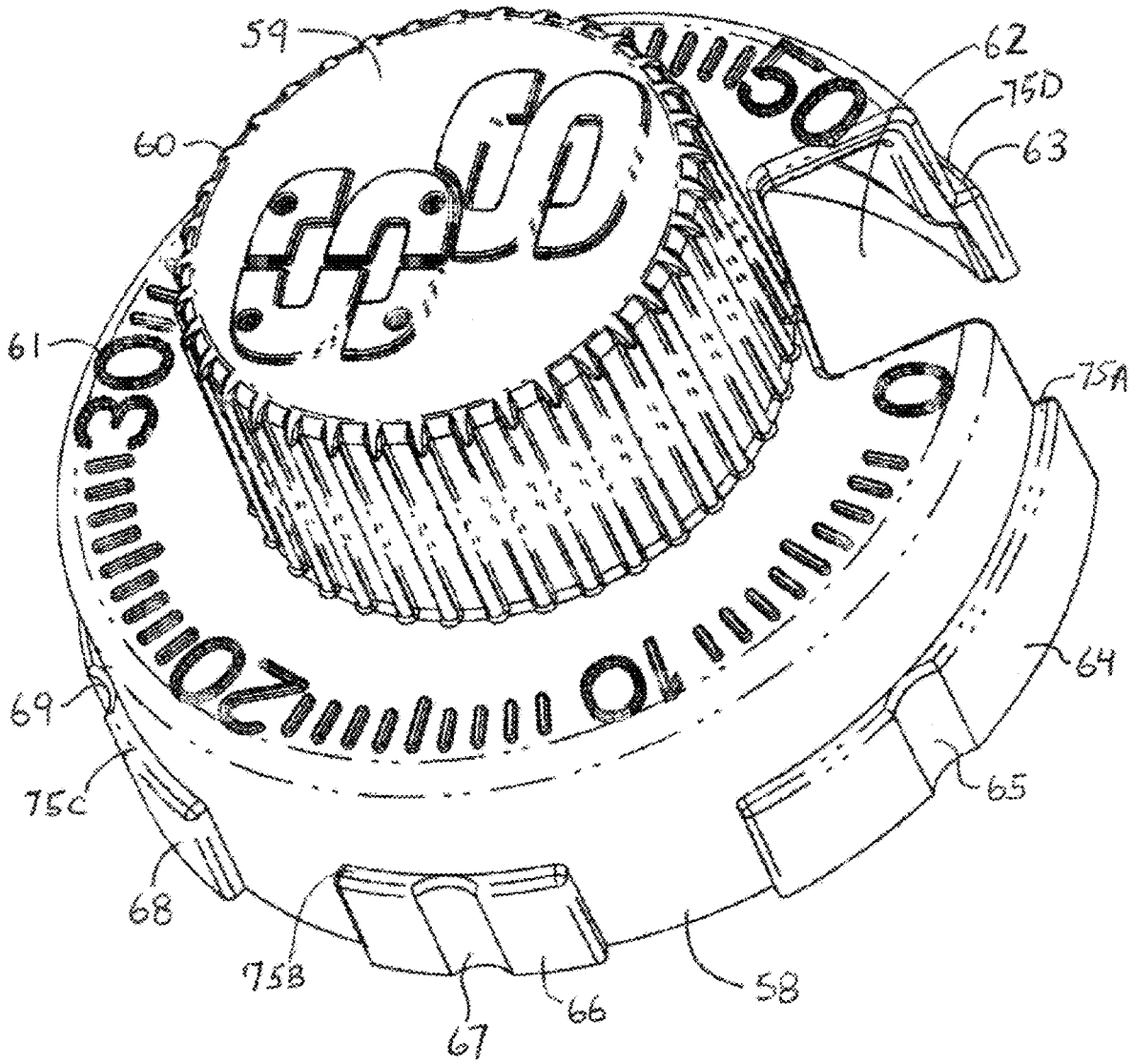
FIG. 18 is a three dimensional view of the rotary locking cap for a three compartment embodiment showing cut out for allowing singular opening of any one of the main compartment body lids, depending upon the positioning of the cut out portion as the cap is rotated.
Figure 34:
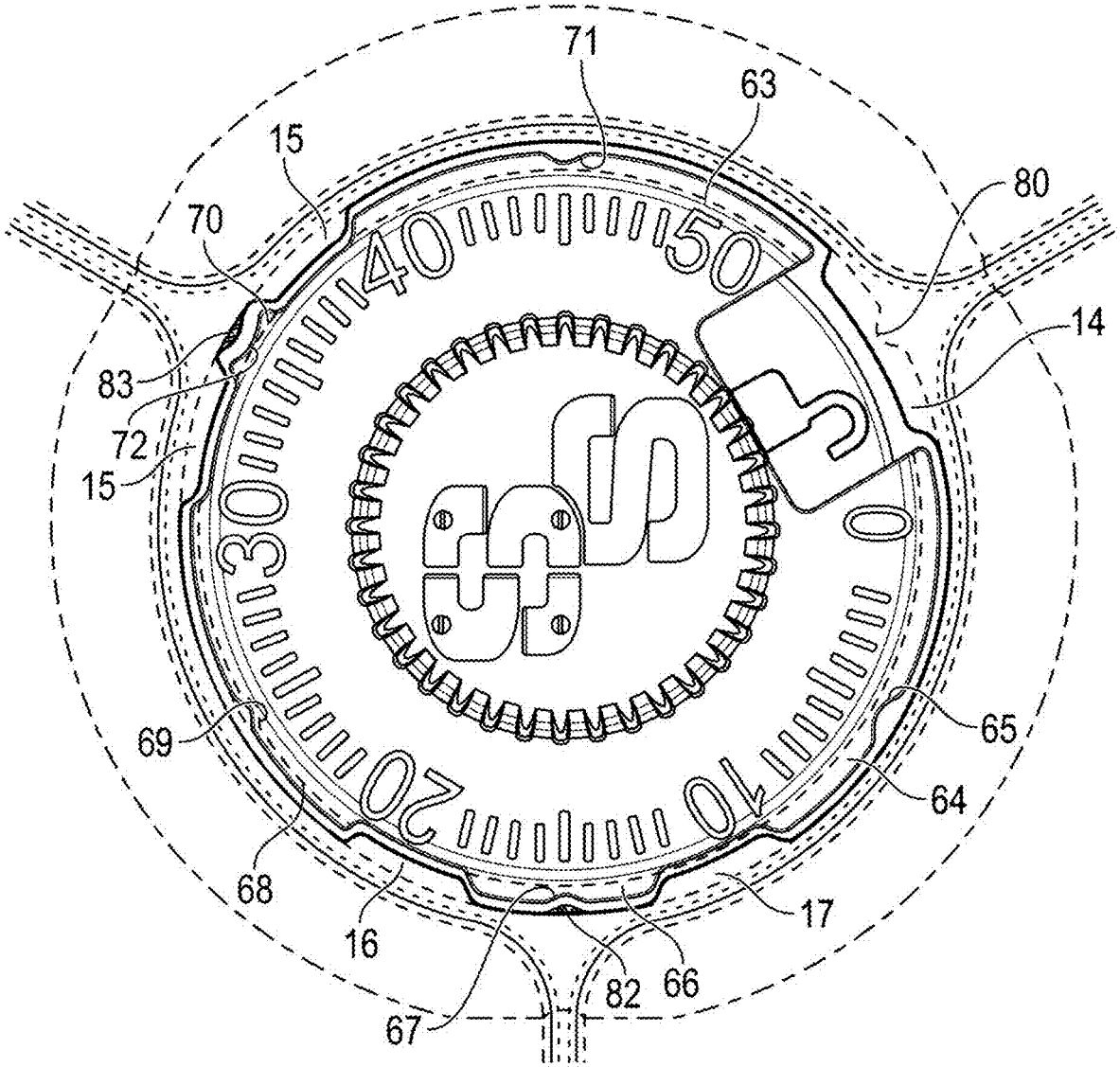
FIG. 34 is a top view of the locking cap for a triple compartment embodiment with its spaced projections about its circumference and their relation to the locking cap keeper projections located on the inner walls of the compartments.

Returning to the locking cap 1 features and functions, FIG. 18 shows a three dimensional view of the locking cap for the three compartment embodiment that can comprise a dial 59 with friction ridges 60 to assist gripping of the dial for rotating it, icons and a faux number scale 61 representing the motif of the invention, namely a safe with combination locking means. The locking cap further comprises a diameter designed to complement both the support towers and lid band risers for each embodiment of different numbers of compartments, but also interact with elements on the main container body to keep the locking cap in place. In particularly preferred embodiments, the locking cap comprises spaced ridges 63, 64, 66, 68, and 70 riding at predetermined arcs about the circumference of the cap. These ridges have upper surfaces 75A, B, C, D, and E (FIGS. 18, 19) that contact the under surface of locking cap keeper elements 14, 15, 16, and 17. In further embodiments, the ridges 63, 64, 66, 68, and 70 each possess a ratchet recess 65, 67, 69, 71, and 72 that interact with spaced singular bumps or ratchet-like ridges 80, 82, and 83 (FIG. 34) formed or otherwise associated with the inside or center facing side of the container walls on the medial line between each of the three compartments. As depicted in FIG. 34, bumps 80, 82, and 83 lie below the overhang of the asymmetrically sized and spaced locking cap keepers 14, 15, 16, and 17. Each embodiment of different numbers of compartments will possess similarly arranged ridges on their respective locking caps and inside or center facing side of the container walls.

Figure 19:
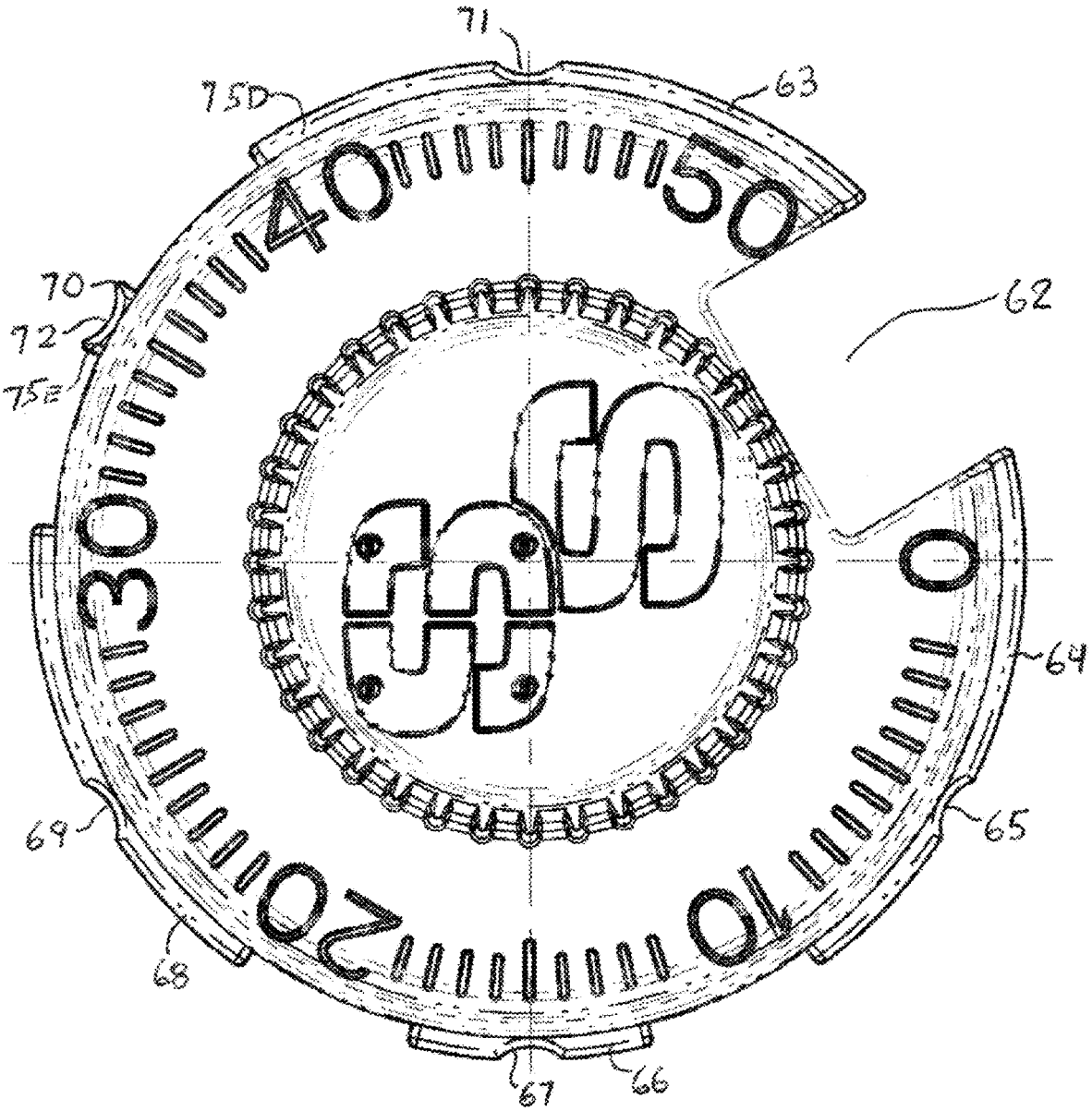
FIG. 19 is a top view of the rotary locking cap showing the arrangement of side projection elements that function in the locking and unlocking mechanism of the invention for a triple compartment embodiment.
Figure 20:
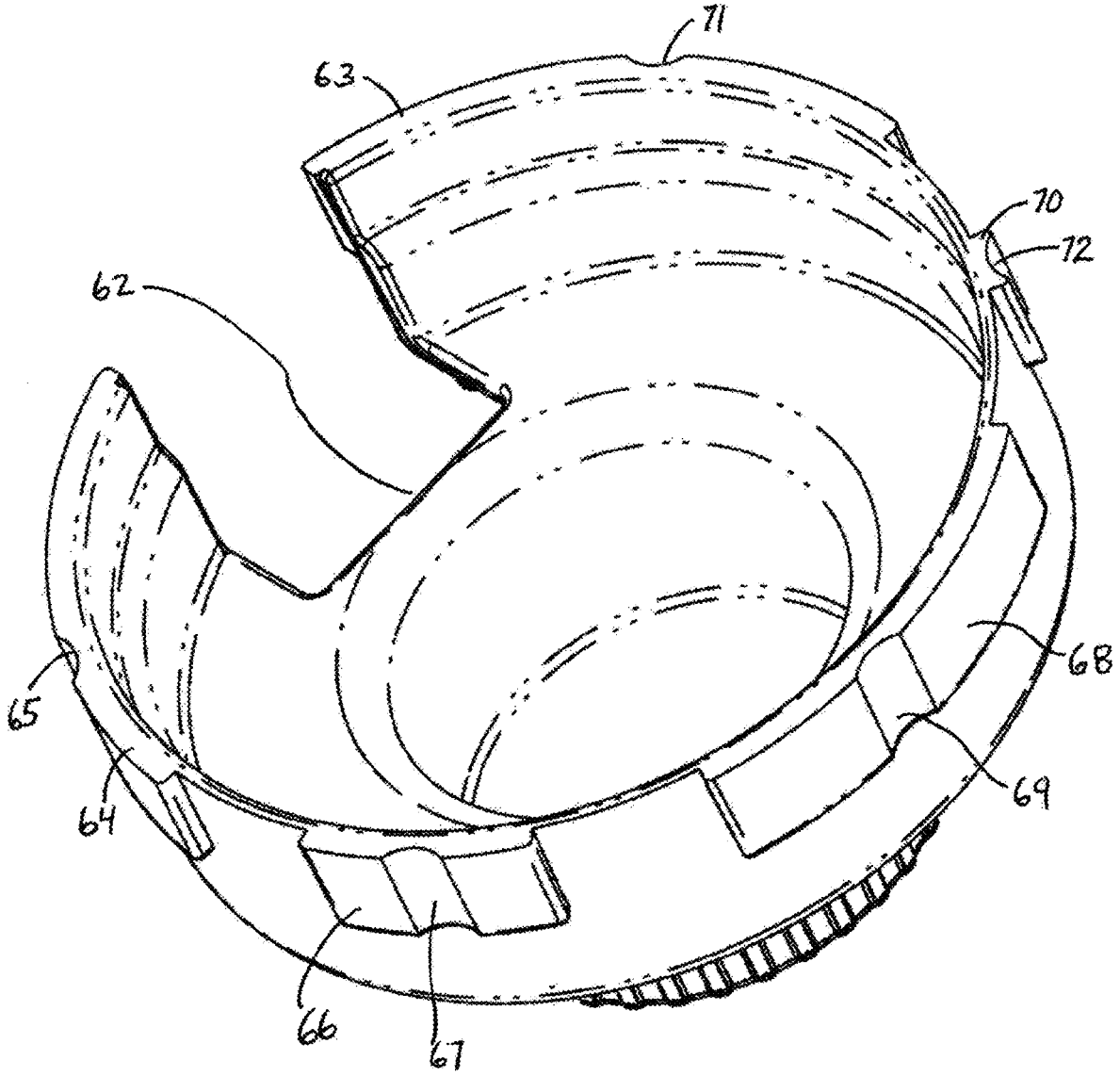
FIG. 20 is a three dimensional view of the underside of the rotary locking cap for a triple compartment embodiment.
Figure 21:
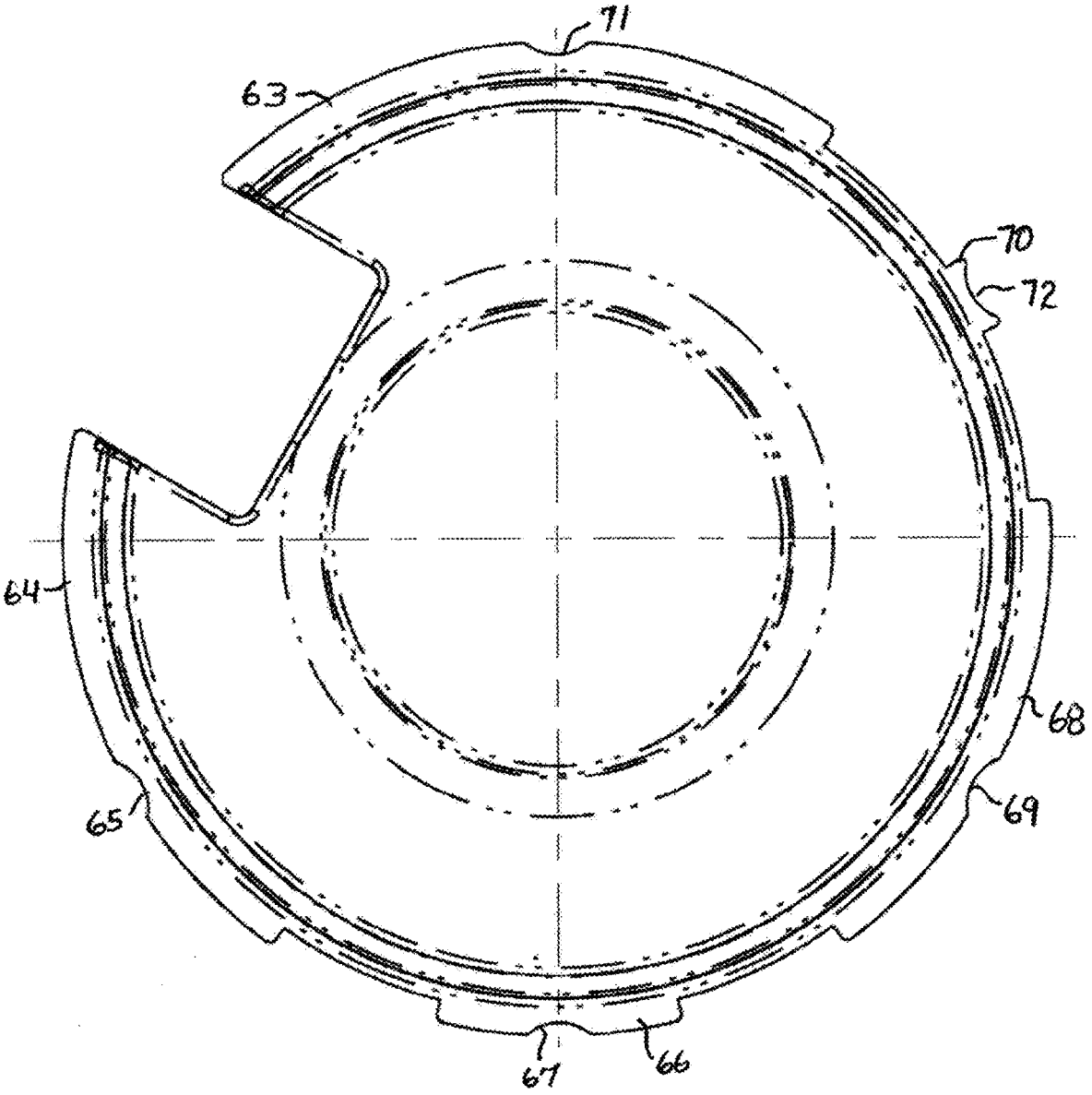
FIG. 21 is a cross sectional view of the underside of the rotary locking cap for a triple compartment embodiment.
Figure 22:
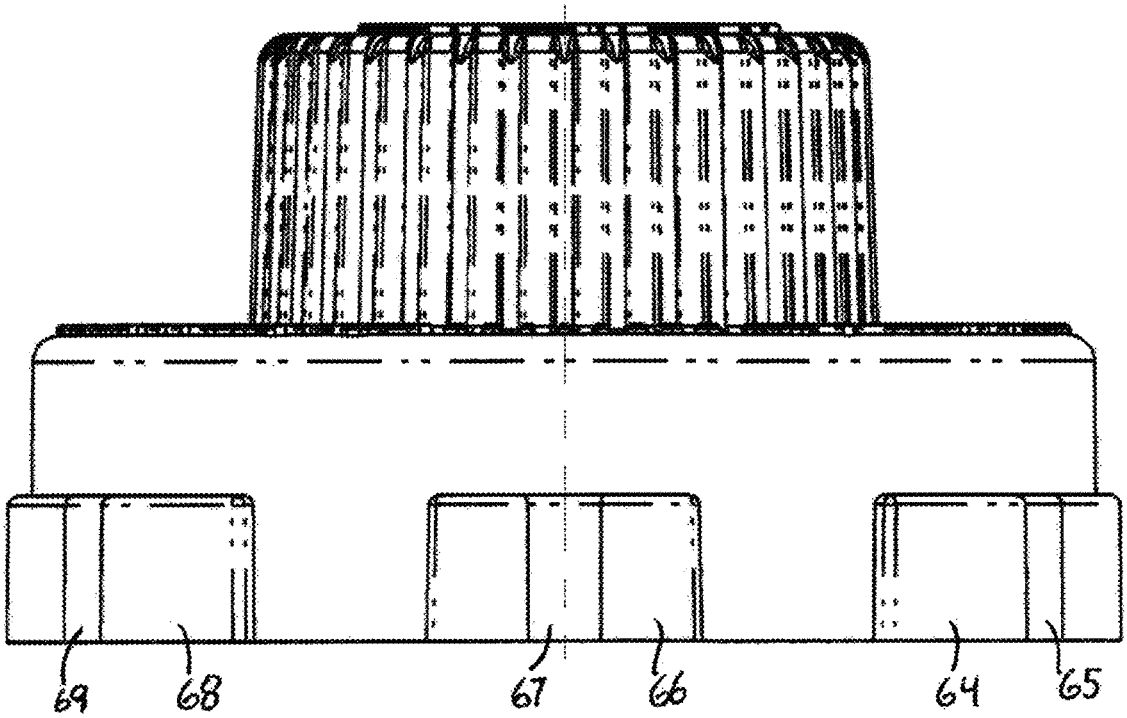
FIG. 22 is a side view of the rotary cap profile for a triple compartment embodiment.
Figure 23:
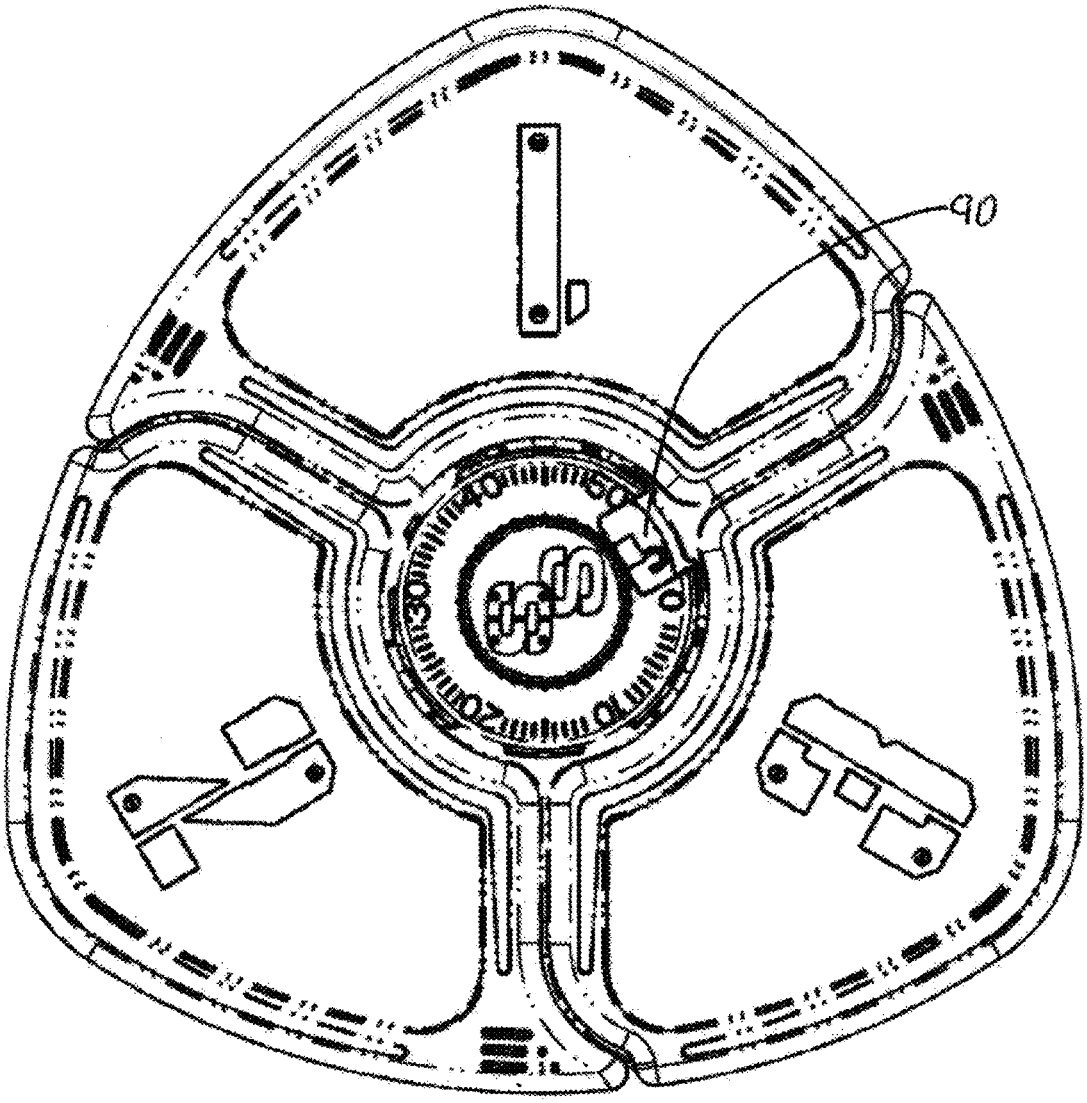
FIG. 23 is a top view of the invention wherein the rotary cap is positioned in the unlock position for disassembling the rotary cap from the main compartment body as well as removal of the multi lid element for a triple compartment embodiment.

In additional features of the locking cap, said cap is specifically designed to comprise a cut out section 62. FIGS. 19-22 provide further visual aspects of the locking cap including its profile (FIG. 22), underside (FIG. 20), and top and bottom views (FIGS. 19, 20 and 21). As stated earlier, the cut out section functions to allow for the lid bands to become exposed and able to move so as to allow the lids to be removed from the compartment tops. Generally, the cut out section is missing the outer circumference and has with the cut out section a shorter radius than the outer circumference. In a particularly preferred embodiment, and as depicted in top down view of the supplement safe, for the three compartment embodiment, FIGS. 23 to 28, there are six formal positions to which the locking cap can be rotated for functionality. A first position is denoted in FIG. 23 wherein the cut out section 62 is in position 90 wherein the top of the tower 7 supporting an unlocked lock icon is exposed due to the cut out 62. In this position, the cap can be pushed into and/or removed from the main container body. As shown in close up FIG. 34, the asymmetrically sized and spaced locking cap ridges 63, 64, 66, 68, and 70 align, not under, but adjacent to, the locking cap keeper projections 14, 15, 16, and 17. Further, ratchet recess 67, and 72 on the locking cap ridges 66 and 70, respectively, align with ratchet bumps 82 and 83, respectively. Additionally, as depicted in FIG. 34, the overhang nature of locking cap keepers 14, 15, 16 and 17 can be seen as the dotted lines adjacent each of these denotes said overhang feature. Note that there is a ratchet bump 80 underneath the overhanging locking cap keeper 14. It should be understood by one of skill in the art that said ratchet bumps, locking cap keeper projections, locking cap ridges, and cut out section are present in each of the embodiments with one, two, four, five, six, and seven compartments, it further being understood that the exact positioning of these features on the locking cap and main container body depends on the number of compartments and diameter of the locking cap. Further still, given the need for equivalent space for the lid bands, it is contemplated that the embodiments with greater number of compartments will have greater diameter of the locking cap.

Figure 24:
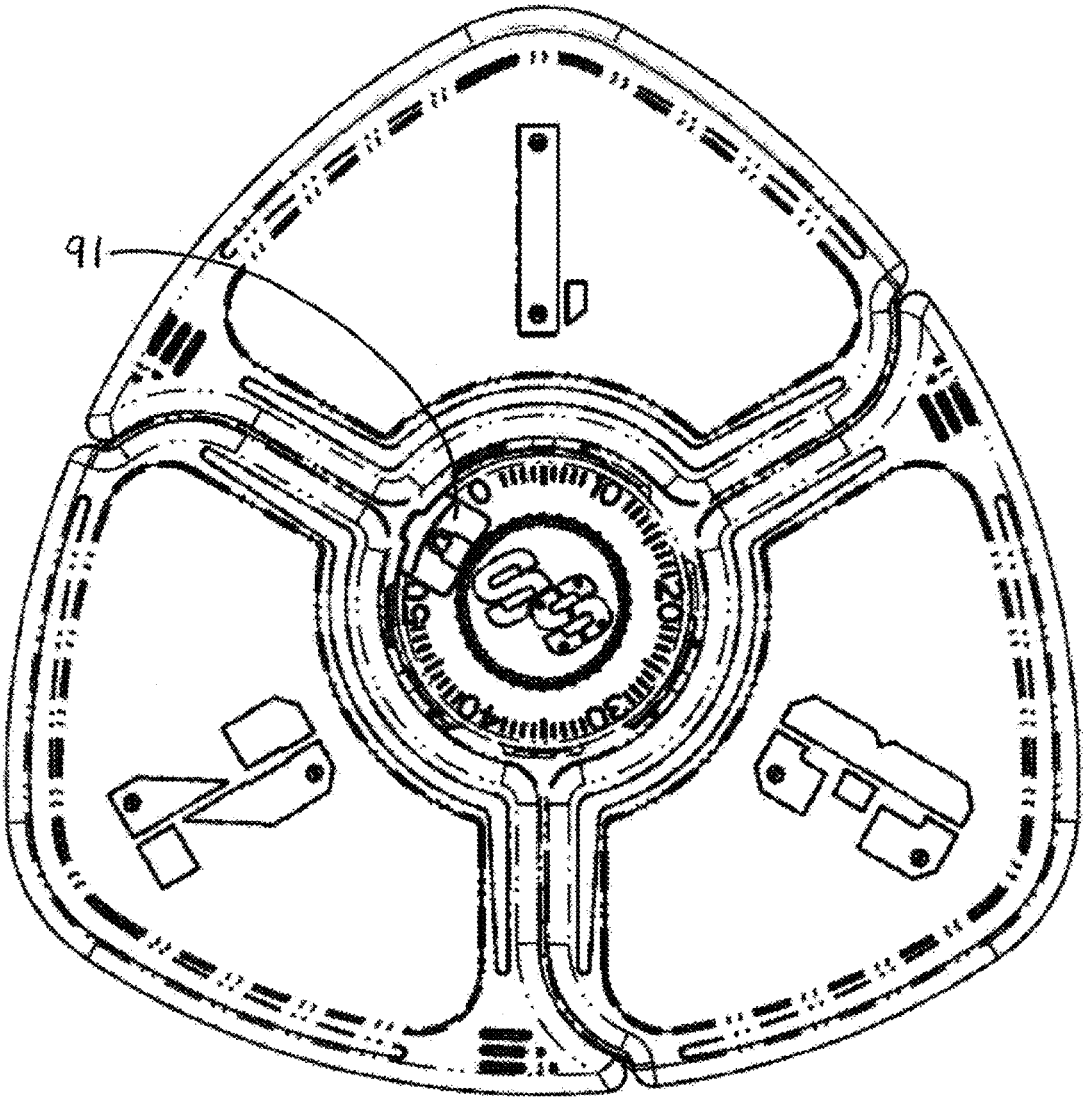
FIG. 24 is a top view of the invention wherein the rotary cap is positioned in a first 'lock' position wherein no lid element can be opened for a triple compartment embodiment.
Figure 25:
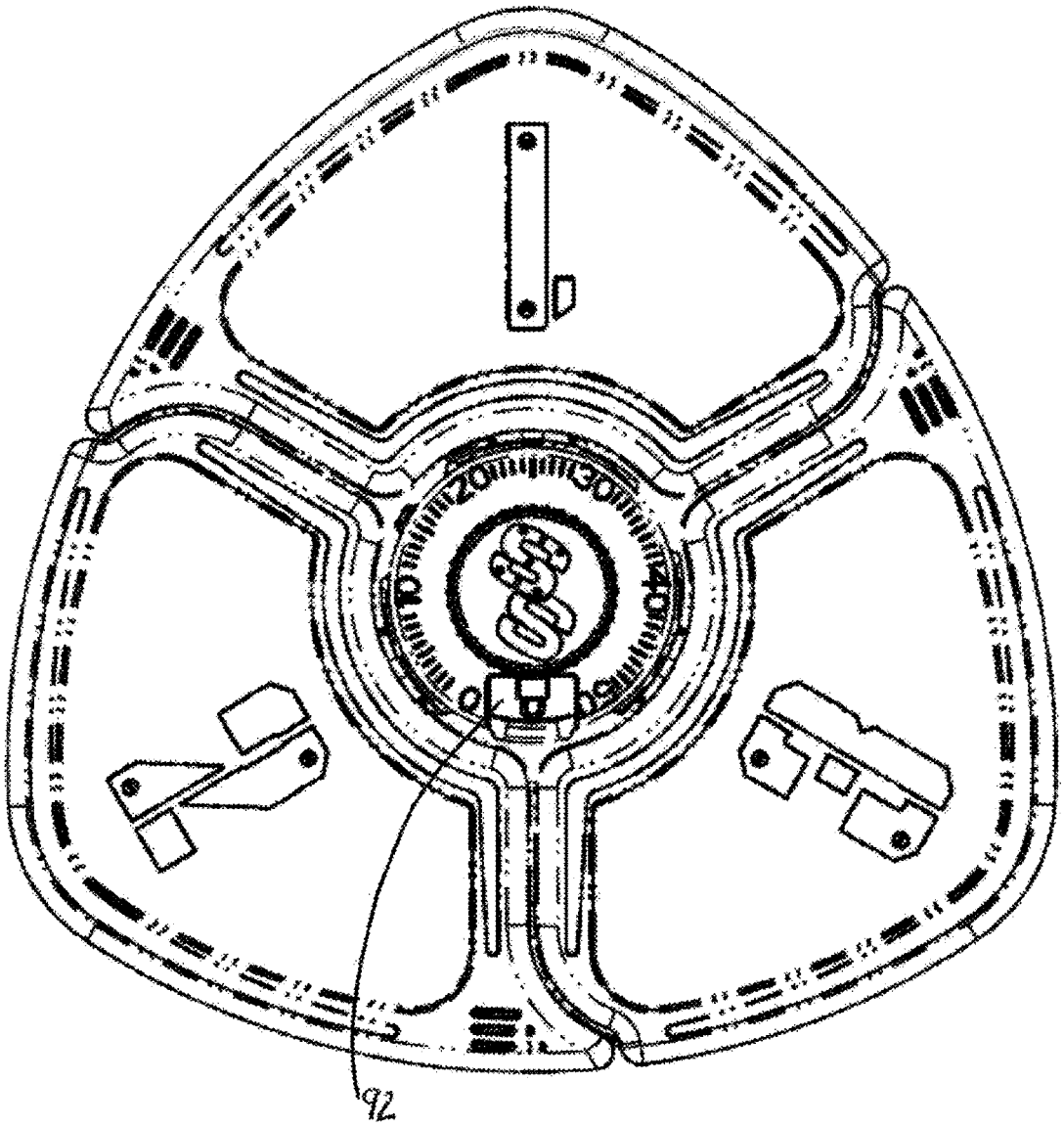
FIG. 25 is a top view of the invention wherein the rotary cap is positioned in a second 'lock' position wherein no lid element can be opened for a triple compartment embodiment.
Figure 35:
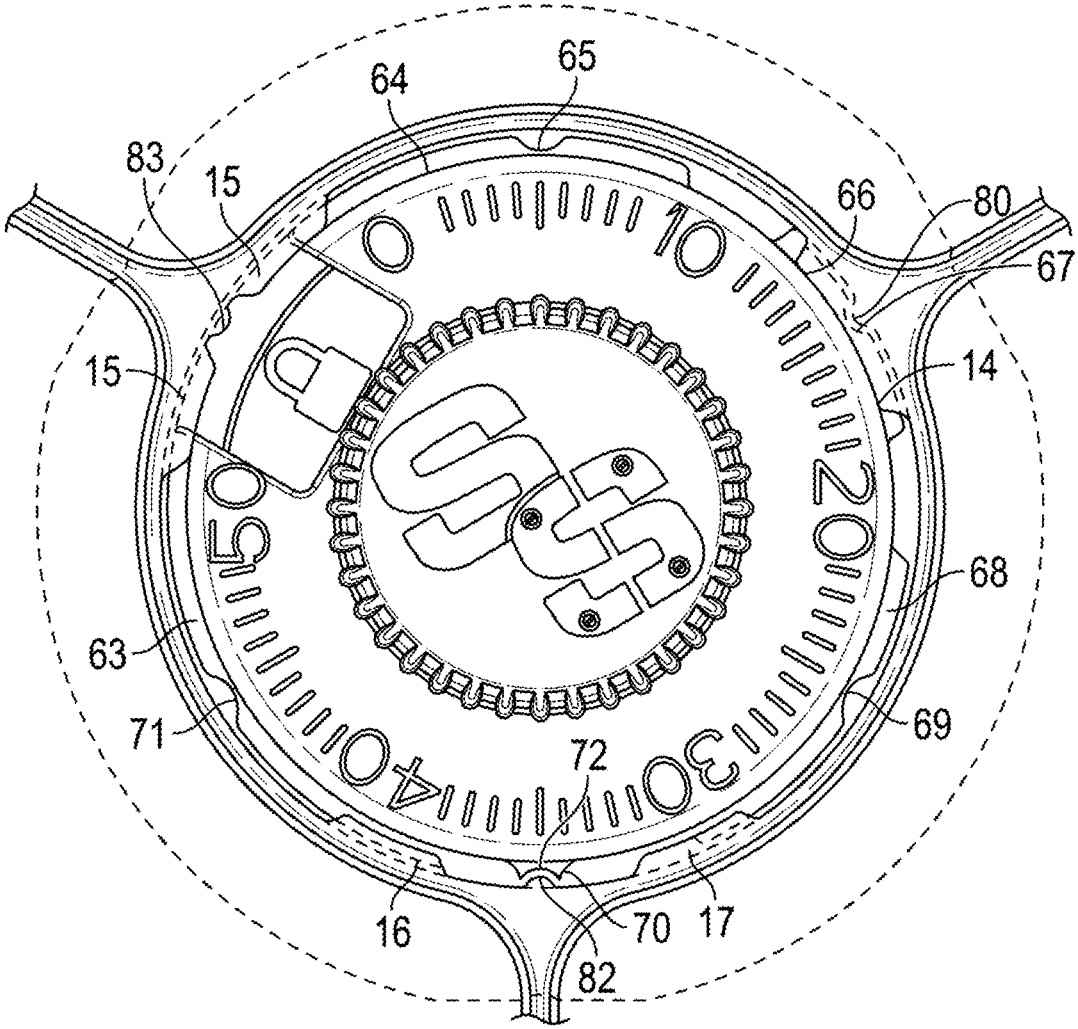
FIG. 35 is a top view close up for a triple compartment embodiment, the locking cap in a first lock position wherein no lid can be opened. As shown some portion of the locking cap circumference spaced projections ride underneath the locking cap keepers.
Figure 36:
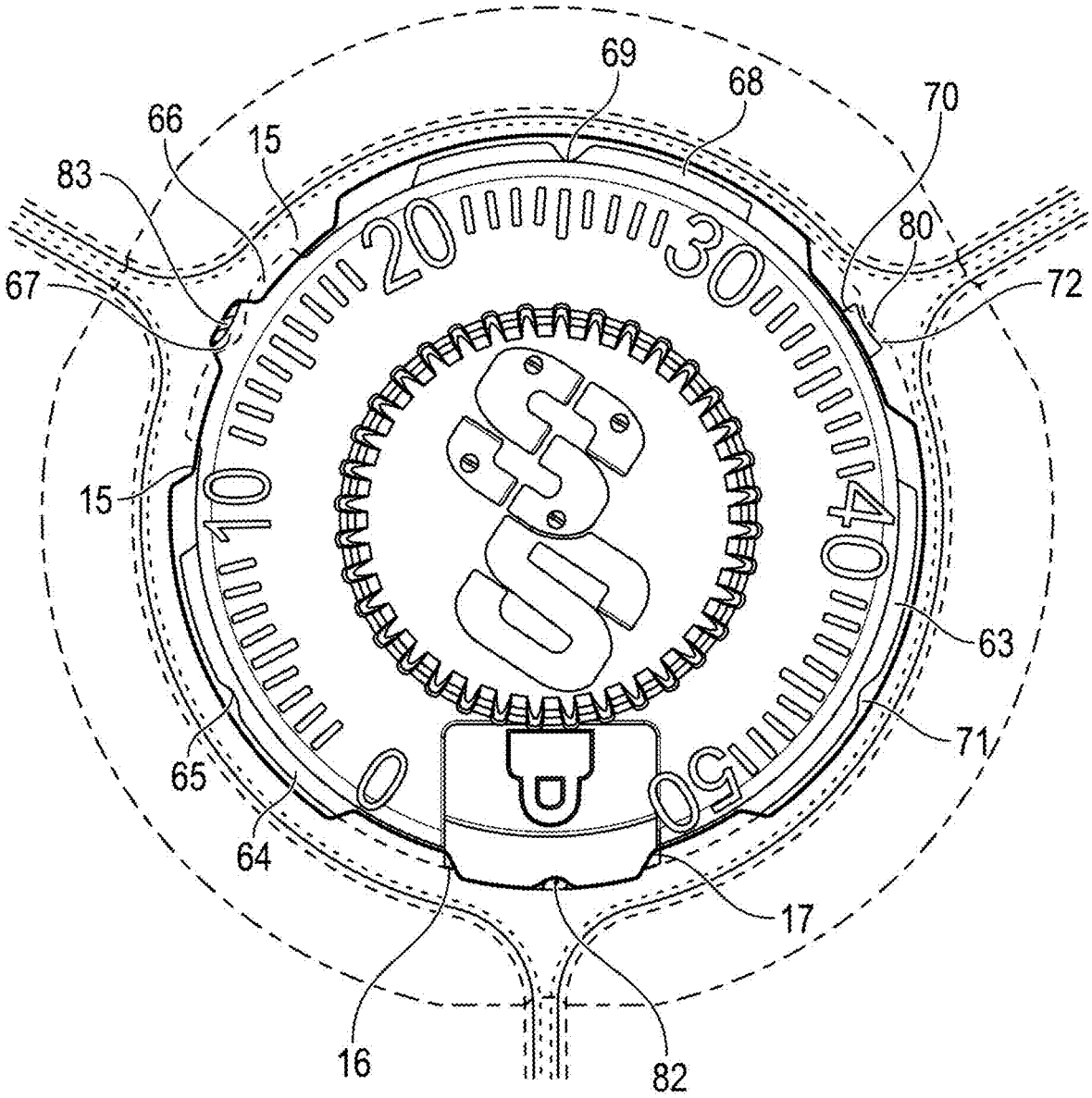
FIG. 36 is a top view close up for a triple compartment embodiment of the locking cap in a second lock position wherein no lid can be opened.

In FIGS. 24 and 25, the cut out 62 is positioned over position 91 and 92, i.e., over towers 8 and 9, respectively. These positions, like the full unlock position just described, are located in between the container compartments aligning with their respective inner walls. The two positions wherein the cut out is positioned over towers 8 and 9 are full lock positions meaning that none of the container lids can be opened when the locking cap is in either of those positions. As shown in close up FIG. 35 the locking cap is held in place by a portion of locking cap ridge 64 riding under locking cap keeper 15, a portion of locking cap ridge 66 is held in place by locking cap keeper 14, a portion of locking cap ridge 68 is under locking cap keeper 17 and part of locking cap ridge 63 is under locking cap keeper 16. Meanwhile, locking cap ridge 72 aligns with ratchet bump 82 and ratchet recess 67 aligns with ratchet bump 80. Likewise, as depicted in FIG. 36, lock position number two provides for a portion of locking cap ridge 63 to ride under locking cap keeper 17, locking cap ridge 70 ride under locking cap keeper 14 and ratchet recess 72 align with ratchet bump 80, a portion of locking cap ridge 66 ride under locking cap keepers 15 and ratchet recess 67 align with ratchet bump 83, and finally a portion of locking cap ridge 64 ride under locking cap keeper 16.

Figure 26:
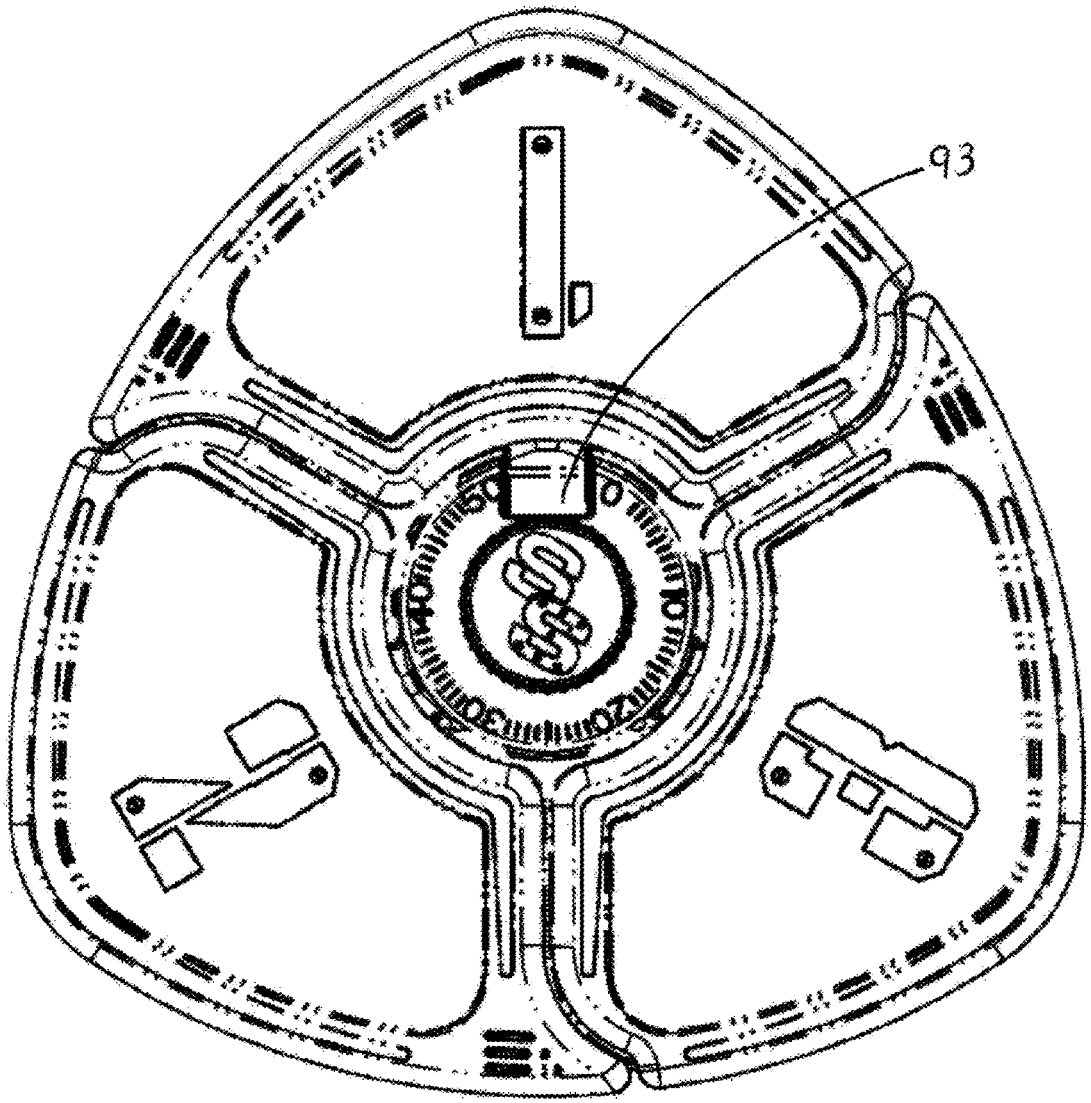
FIG. 26 is a top view of the invention wherein the rotary cap is positioned in the open position for opening the lid only to main body compartment number 1 for a triple compartment embodiment.
Figure 27:
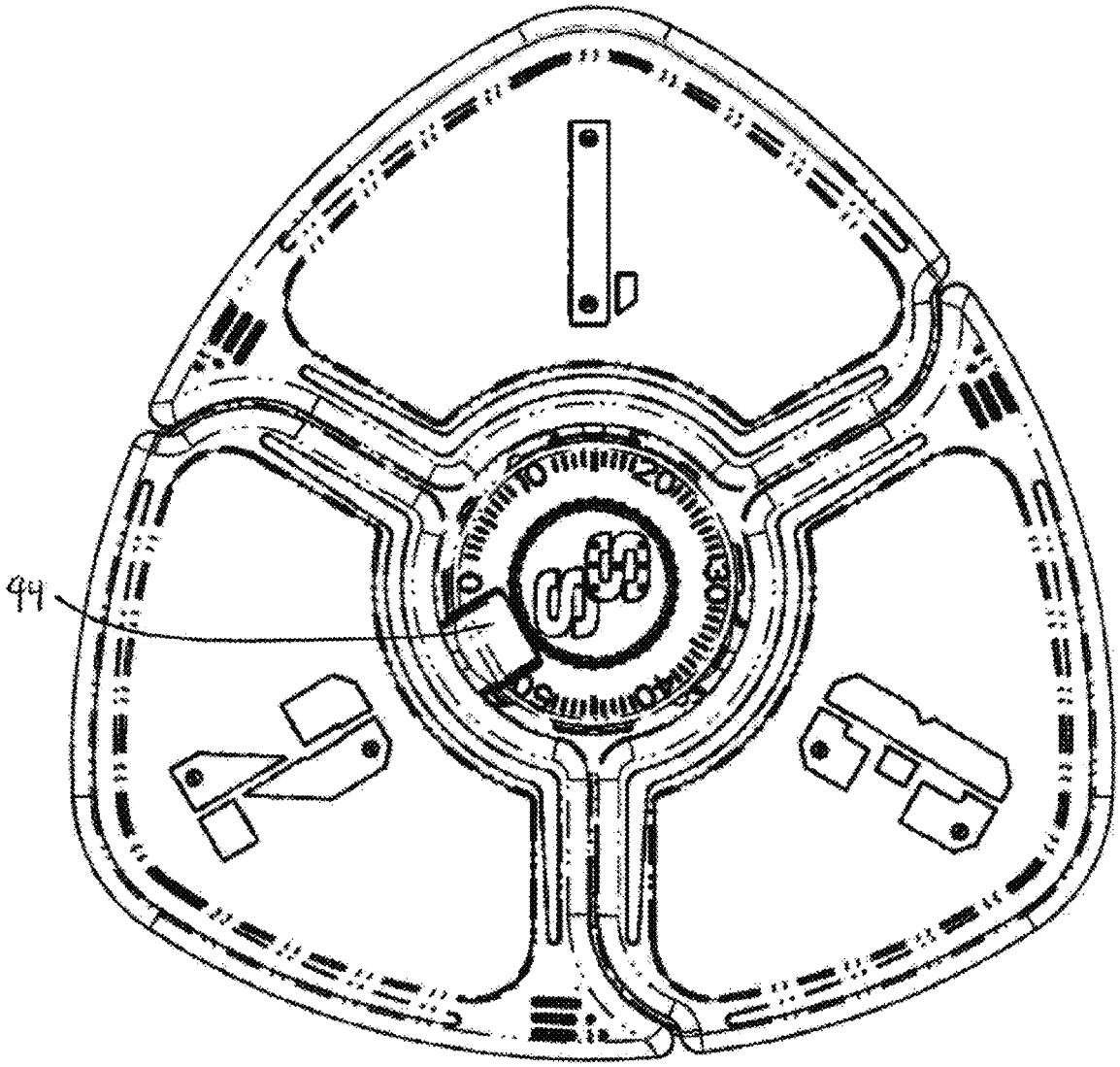
FIG. 27 is a top view of the invention wherein the rotary cap is positioned in the open position for opening the lid only to main body compartment number 2 for a triple compartment embodiment.
Figure 28:
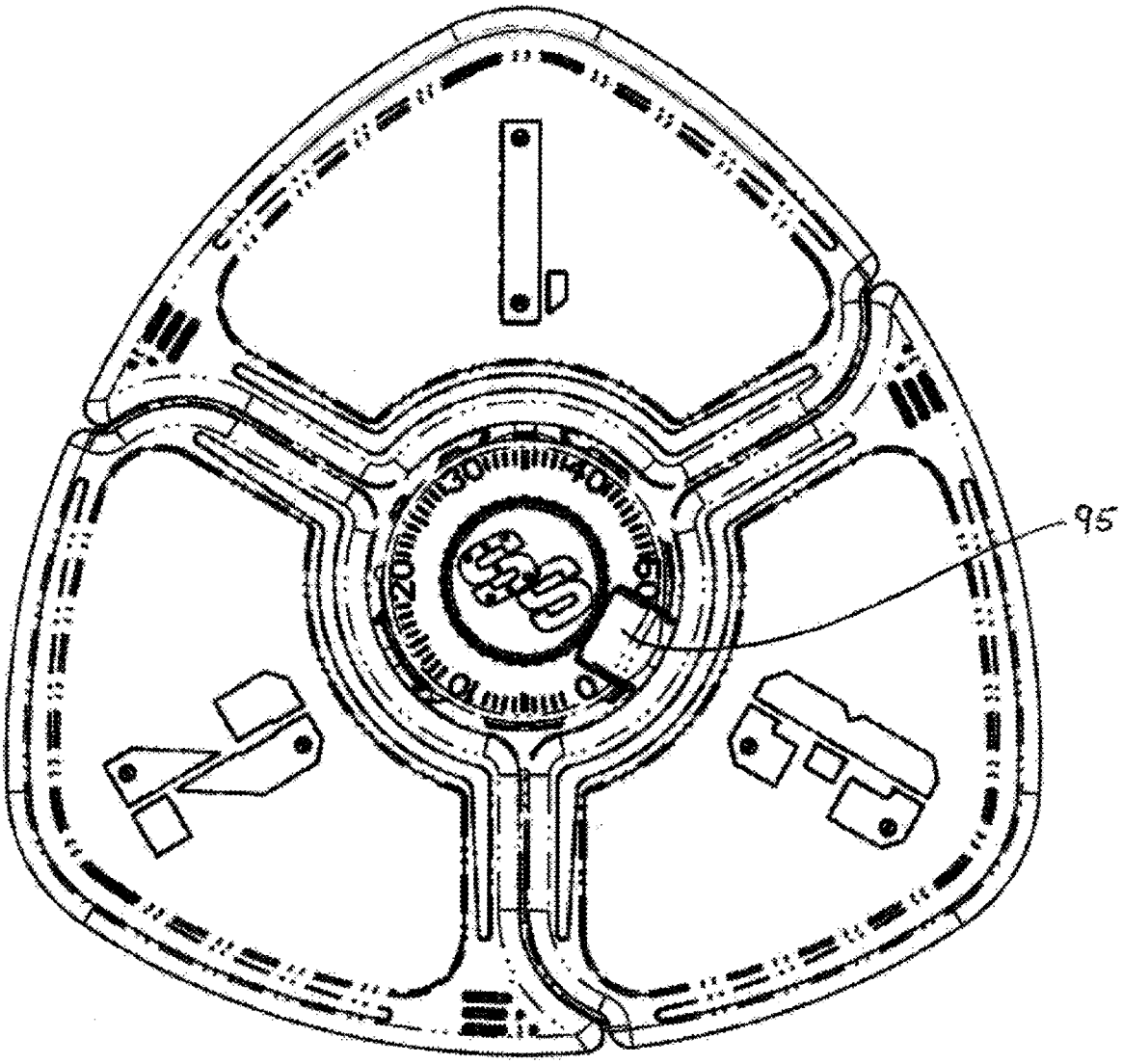
FIG. 28 is a top view of the invention wherein the rotary cap is positioned in the open position for opening the lid only to main body compartment number 3 for a triple compartment embodiment.
Figure 37:
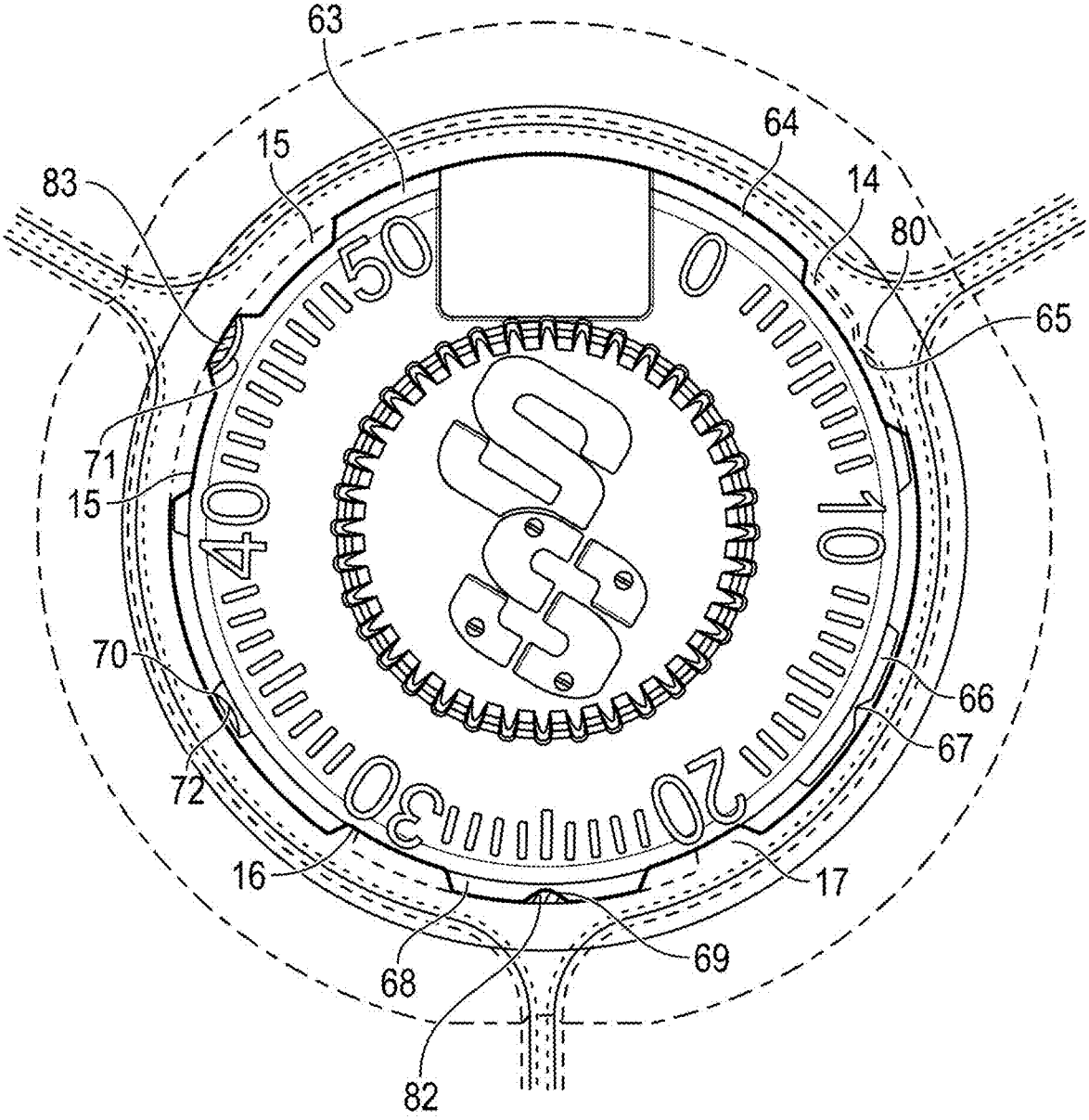
FIGS. 37, 38, and 39 are close ups for a triple compartment embodiment showing the locking cap in a first position to open exclusively compartment number 1 (FIG. 37), exclusively compartment number 2 (FIG. 38), or compartment number 3 (FIG. 39), respectively.
Figure 38:
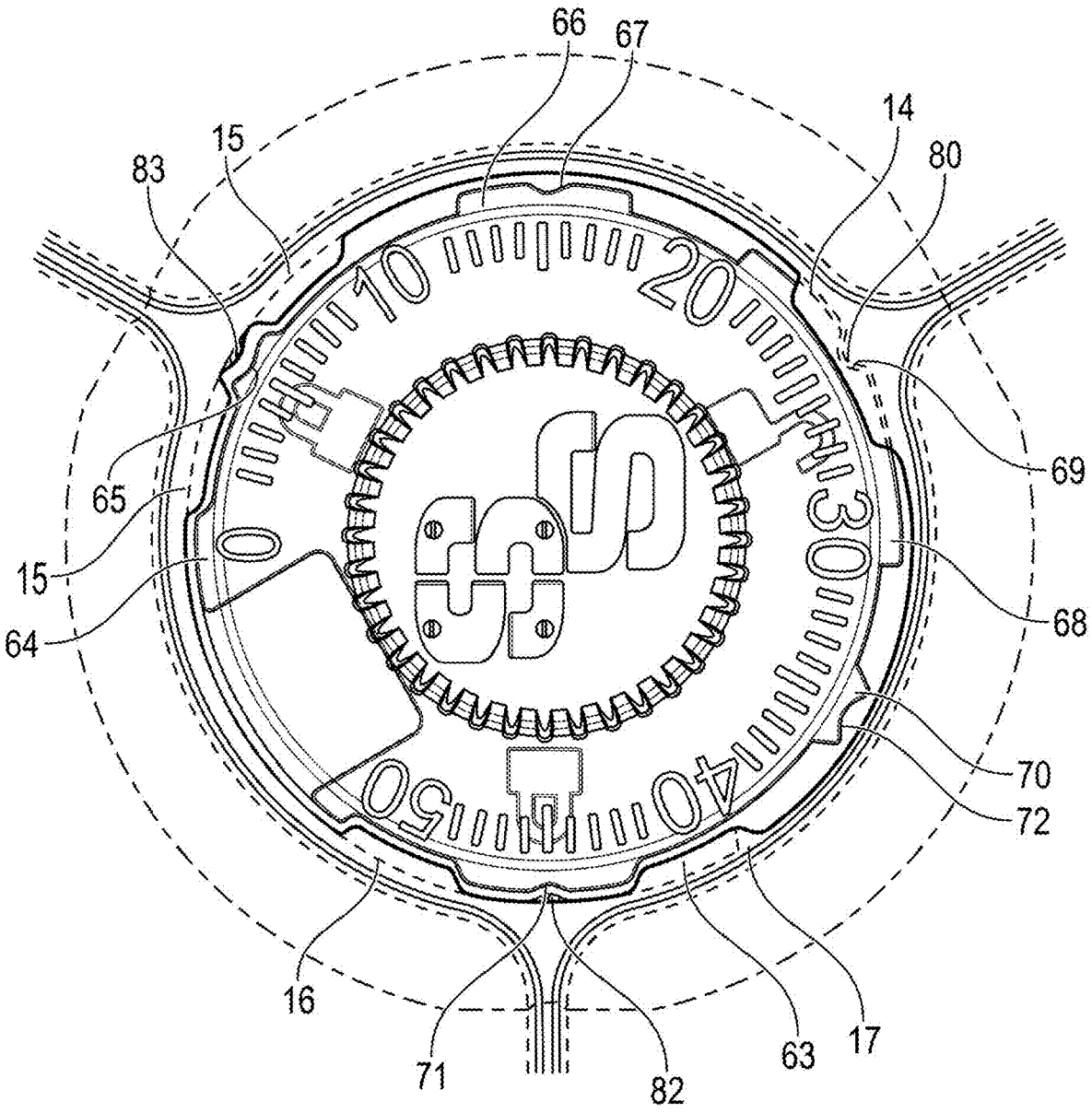
Figure 39:
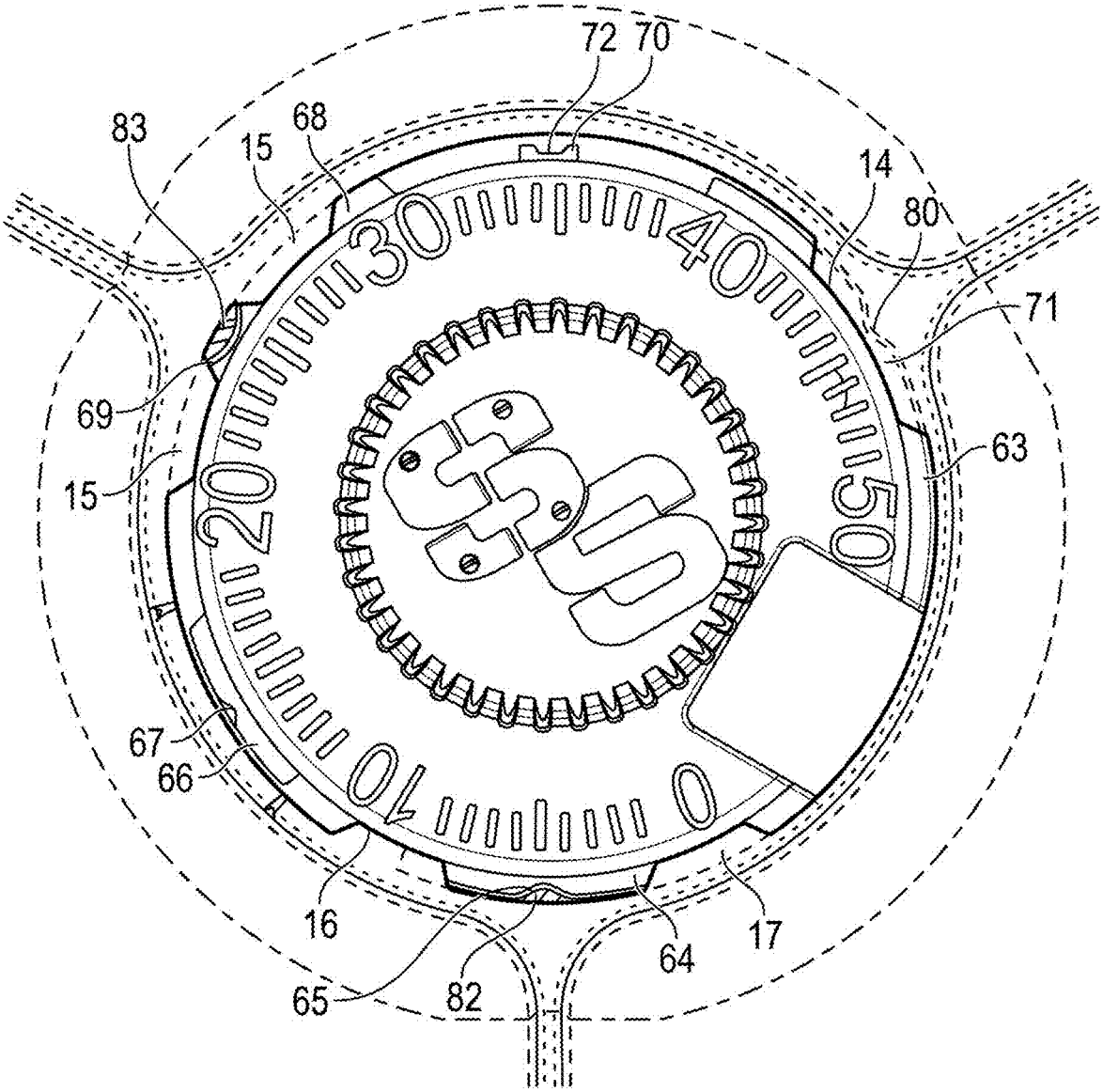
Figure 40:
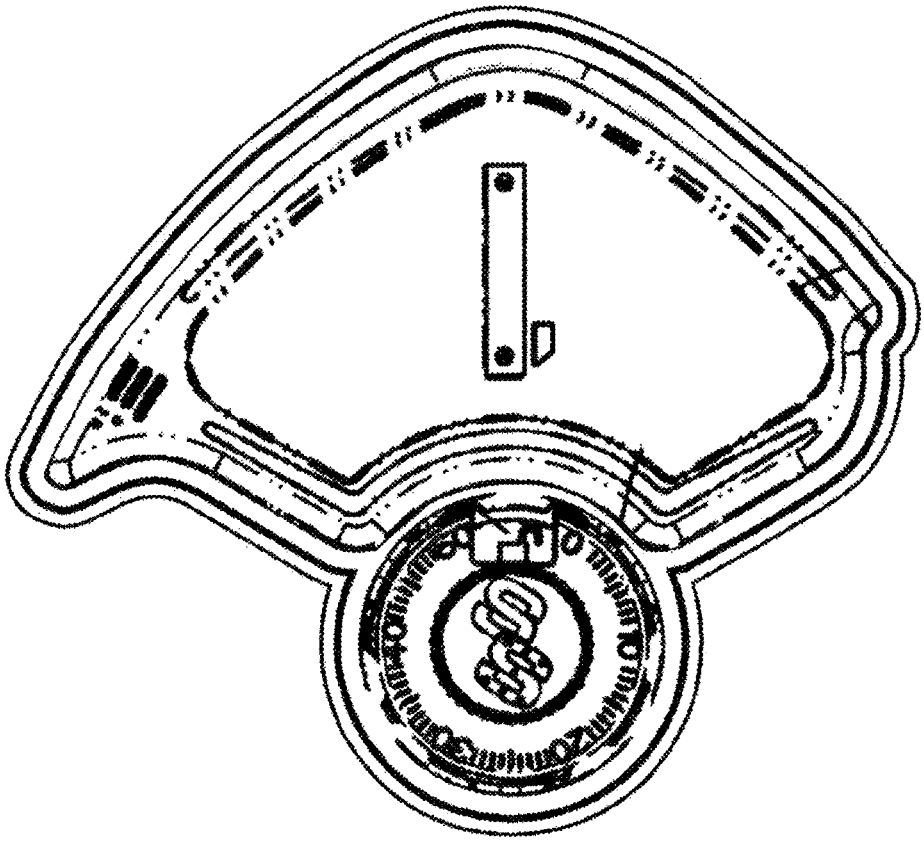
FIG. 40 is a top view of a single compartment embodiment of the supplement safe.
Figure 41:
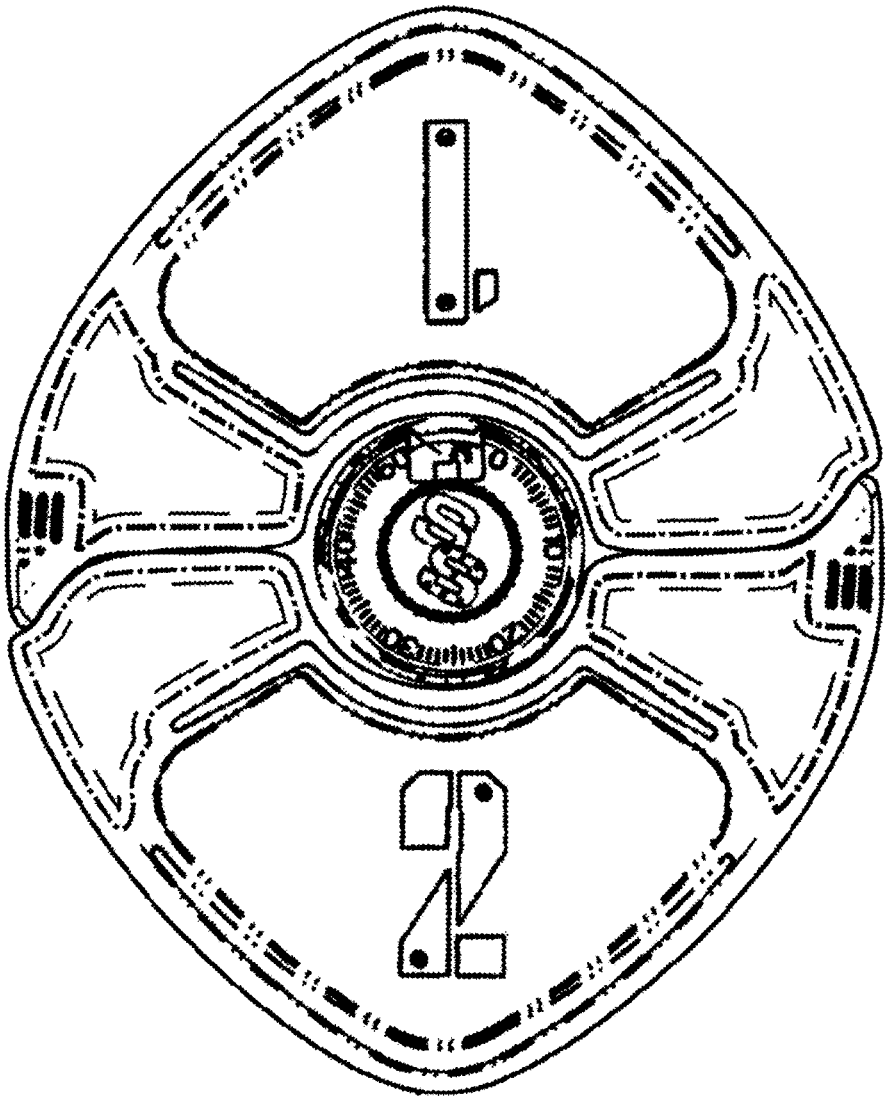
FIG. 41 is a top view of a double compartment embodiment of the supplement safe.

FIGS. 26, 27 and 28 depict a top down view of the three compartment version of the supplement safe wherein the locking cap cutout 62 is in positions 93, 94 and 95, respectively. These locking cap positions allow the lids on each compartment to be opened individually. Specifically, as depicted in FIG. 37, the locking cap is held in place by a portion of locking cap ridge 64 riding under locking cap keeper 14 and ratchet recess 65 aligning with ratchet bump 80, a portion of locking cap ridge 68 riding under locking cap keeper 16 and 17 with ratchet recess 69 aligning with ratchet bump 82, and a portion of locking cap ridge 63 riding under locking cap keepers 15 with its ratchet recess 71 aligning with ratchet bump 83. As can be well understood by the figures and this written description, the ridges and keepers and ratchet bumps are in slidably and frictionally contact with one another and when the locking cap is rotated so as to lock in lock positions 1 or 2, there are two points of alignment of a ratchet bump and a ratchet recess, namely, ratchet bumps 80 and 82 aligning with ratchet recesses 67 and 72, respectively (FIG. 35), or ratchet bumps 80 and 83 aligning with ratchet recesses 72 and 67, respectively (FIG. 36). By frictionally is meant that the ridges make physical contact with the keepers of the housing and/or the ratchet bumps placed along the inner circumference of the housing as herein described and claimed and the dial can be rotated because there is not too much friction between the upper side of the ridges against the underside of the keepers, or too much friction of the ridges against the ratchet bumps and their respective ratchet recesses of the dial ridges.

Where the locking cap is in any of the open positions 93, 94, and 95, the locking cap has three points of alignment between the ratchet bumps 80, 82, and 83 and ratchet recesses 65, 67, 69, 72, and 71. Specifically, as depicted in FIG. 37, the locking cap cutout is in position to open compartment number one. In this position, a portion of locking ridge 64 rides under locking cap keeper 14 and ratchet recess 65 aligns with ratchet bump 80, a portion of locking cap ridge 68 rides under locking cap keepers 16 and 17 while ratchet recess 69 aligns with ratchet bump 82, and a portion of locking cap ridge 63 rides under locking cap keeper 15 while ratchet recess 71 aligns with ratchet bump 83. Similarly, as shown in FIG. 38, the locking cap is in position to open compartment number 2 and wherein a portion of locking cap ridge 64 rides under locking cap keeper 15 while ratchet recess 65 aligns with ratchet bump 83, a portion of locking cap ridge 68 rides under locking cap keeper 14 while ratchet recess 69 aligns with ratchet bump 80, and a portion of locking cap ridge 63 rides under locking cap keepers 16 and 17 while ratchet recess 71 aligns with ratchet bump 82. Finally, as shown in FIG. 39, the locking cap is in position to open compartment lid number 3 wherein a portion of locking cap ridge 63 rides under locking cap keeper 14 while ratchet recess 71 is aligned with ratchet bump 80, a portion of locking cap ridge 68 rides under locking cap keeper 15 while ratchet recess 69 aligns with ratchet bump 83, and a portion of locking cap ridge 64 rides under locking cap keepers 16 and 17 while ratchet recess 65 aligns with ratchet bump 82. For supplement safe versions with other number of compartments, such as one, two, four, five, six or seven, the above features are present and work similarly to allow the locking cap to be rotated in any particular position such that there is one position where the locking cap and lid(s) can be removed, others where the lids can individually be opened, or where no lid can be opened.

Figure 29:
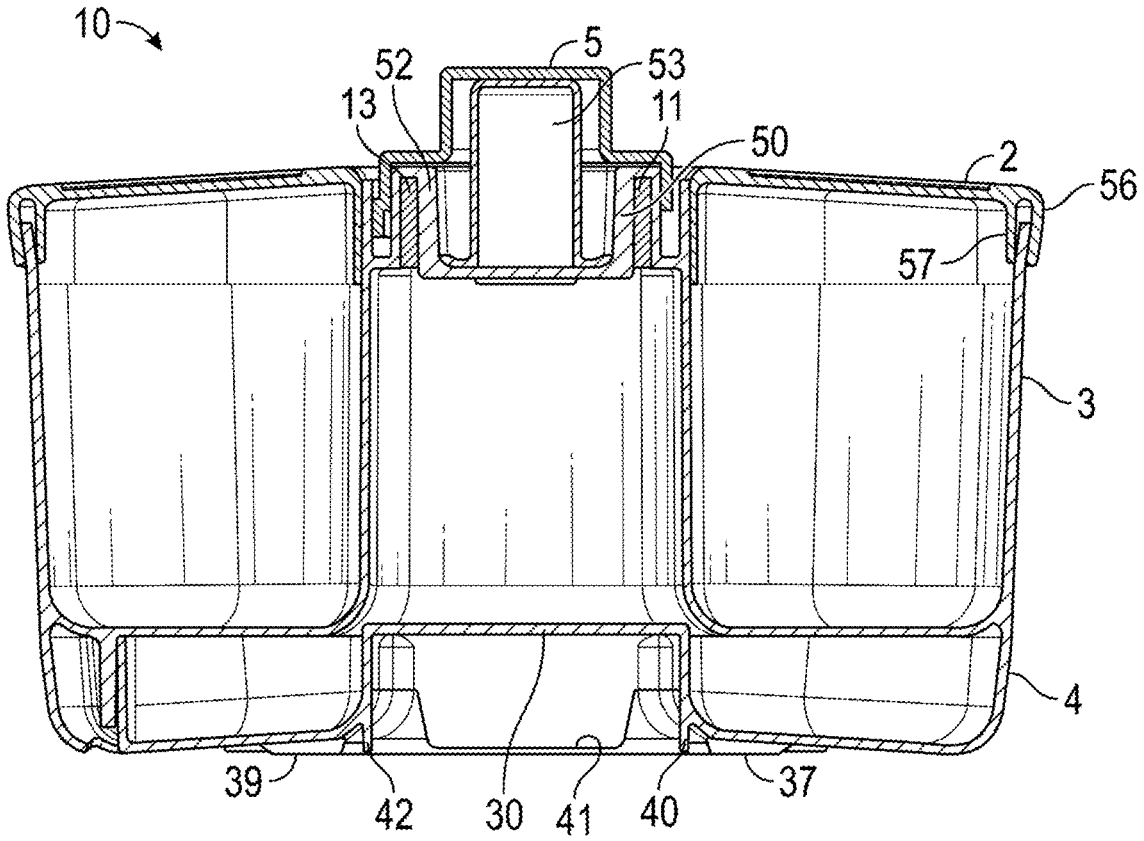
FIG. 29 is a cross sectional side view for a triple compartment embodiment, the invention showing aspects of the lid and rotary locking cap.
Figure 30:
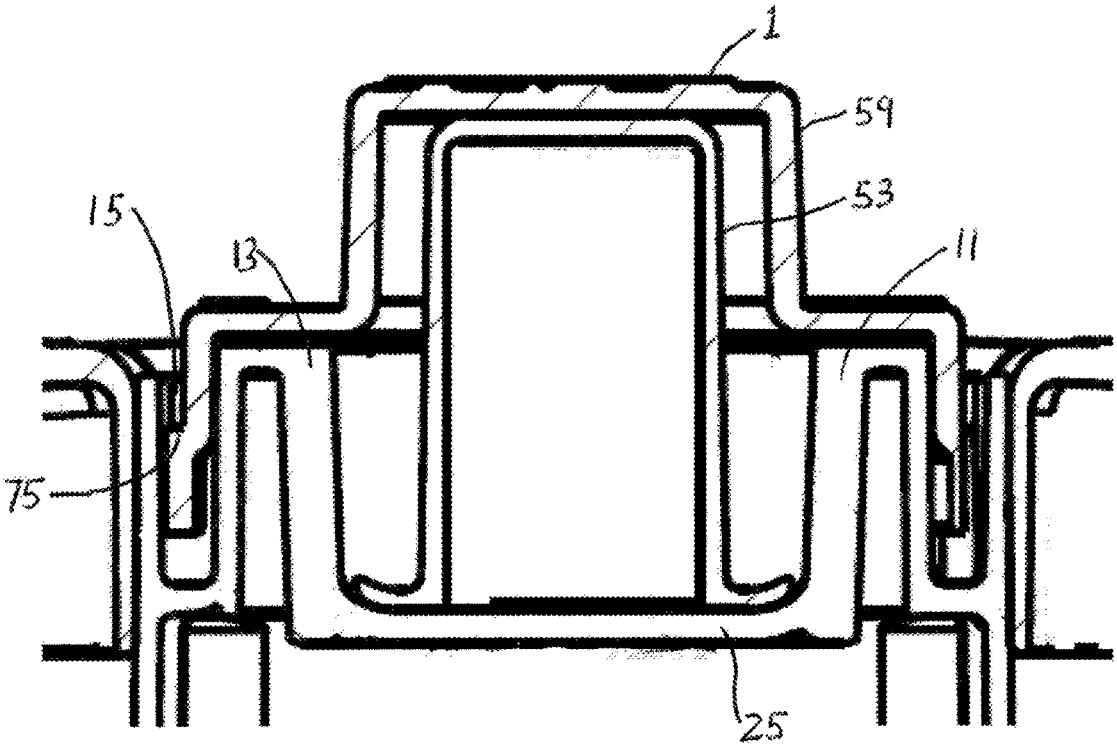
FIG. 30 is a close up cross sectional drawing of the rotary cap, and king post of the multi lid element for a triple compartment embodiment.

In still further aspects, the locking cap, multi-lid element, main container body, and lower supplement tray all work together seamlessly. As shown in FIG. 29, the central area of lower tray 4 is raised forming substrate 30. This central area is raise with respect to the bottom of the tray for the purpose accommodating the locking cap grip dial 5 when the safe is stacked, one upon the other. The central facing walls of the tray have arc projections 40, 41, and 42 that further assist the supplement safe to remain stable when stacked as the projections fit about the gap between the compartment lids and the locking cap. FIG. 30 is a close up of the locking cap arrangement cross section. As displayed, the locking cap is held in place by locking cap ridges lip 75 being held underneath the locking cap keepers 15. Further it can be seen that the king post 53 of the multi-lid element creates back pressure on the locking cap ridge lip 75 by pressing against locking cap 1 grip dial 59.

Figure 31:
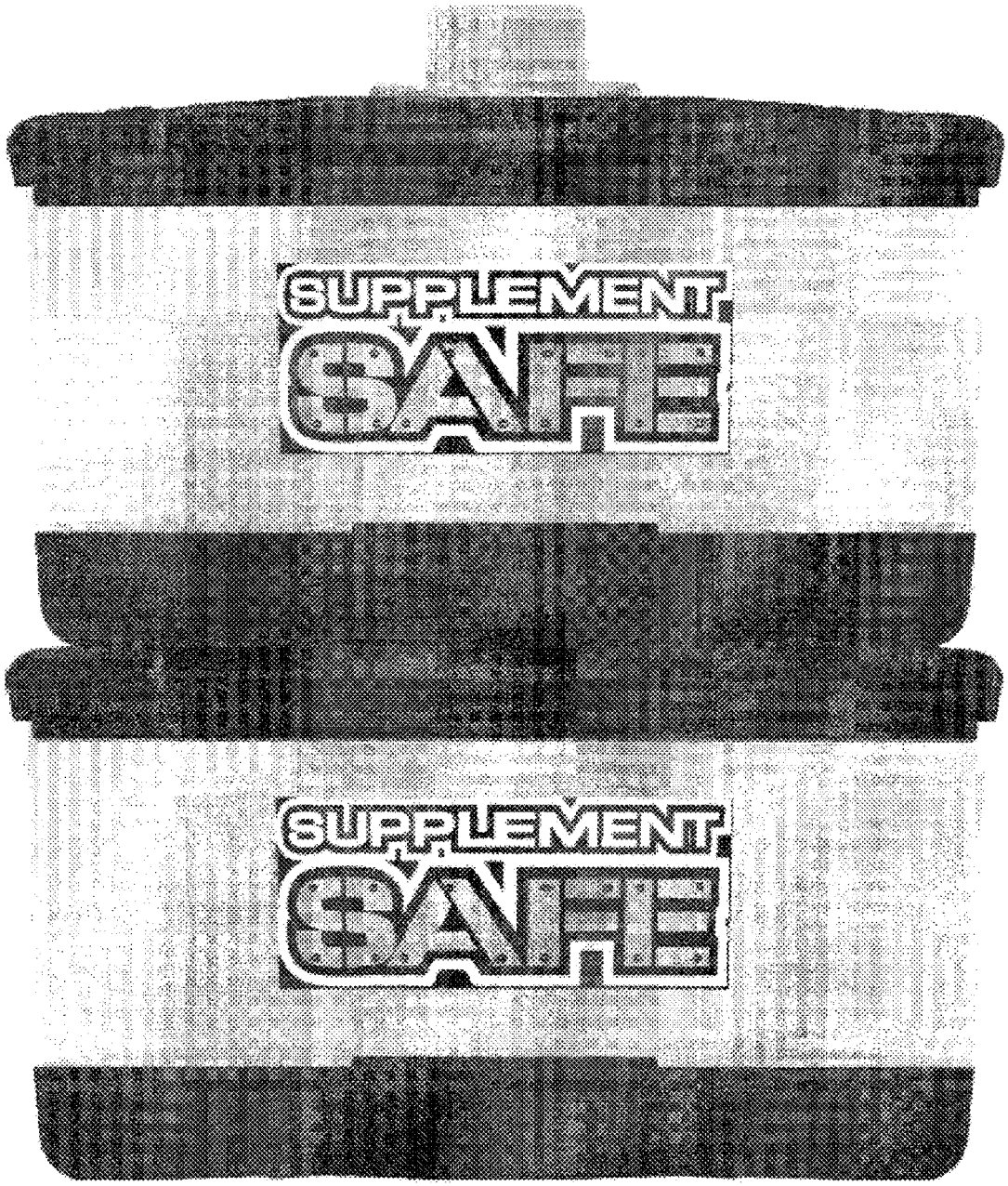
FIG. 31 is a side view of a triple compartment embodiment, the invention shown stacked one upon the other.
Figure 32:
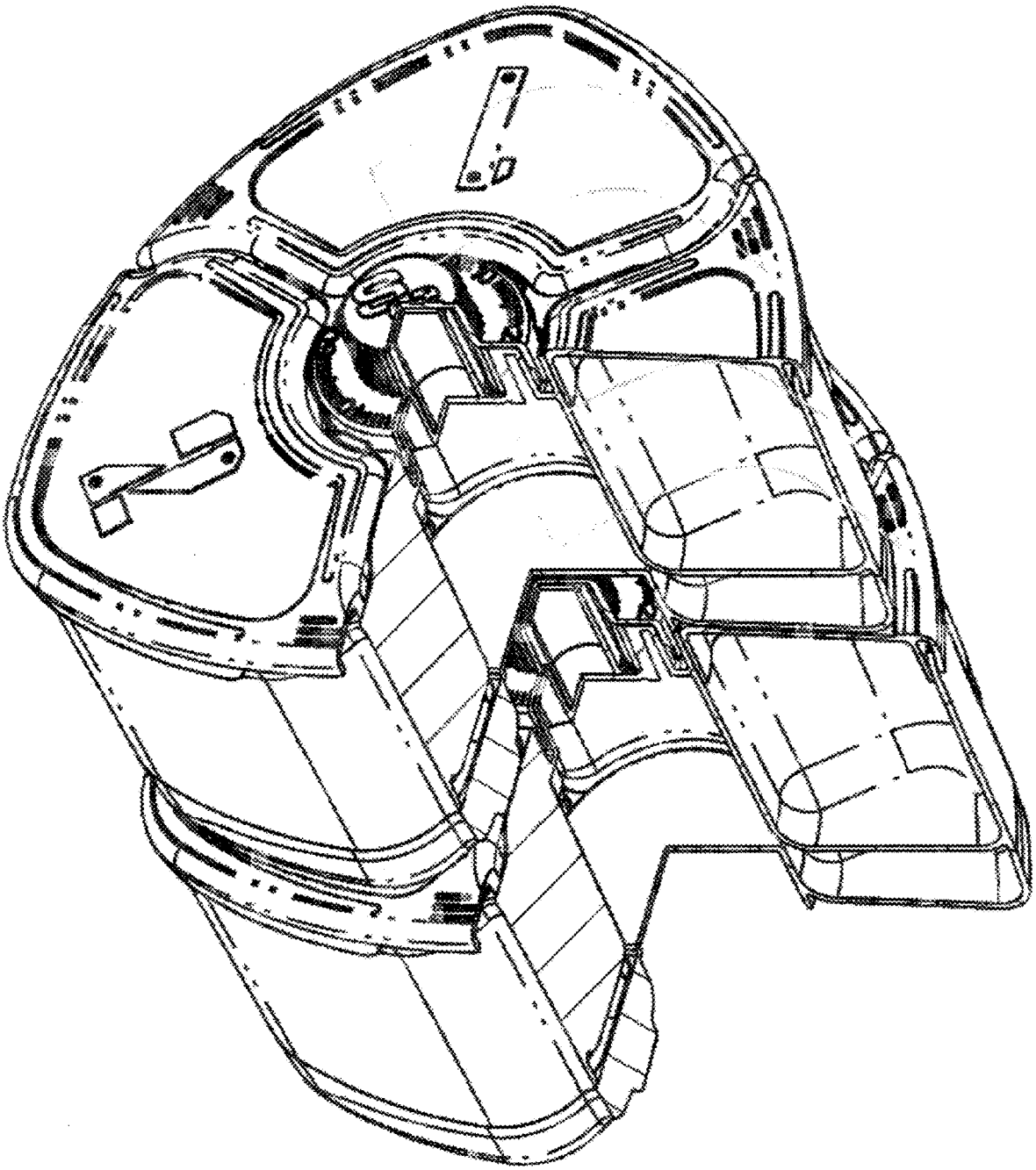
FIG. 32 is a three quarter cross sectional view of two stacked supplement safes for a triple compartment embodiment.
Figure 33:
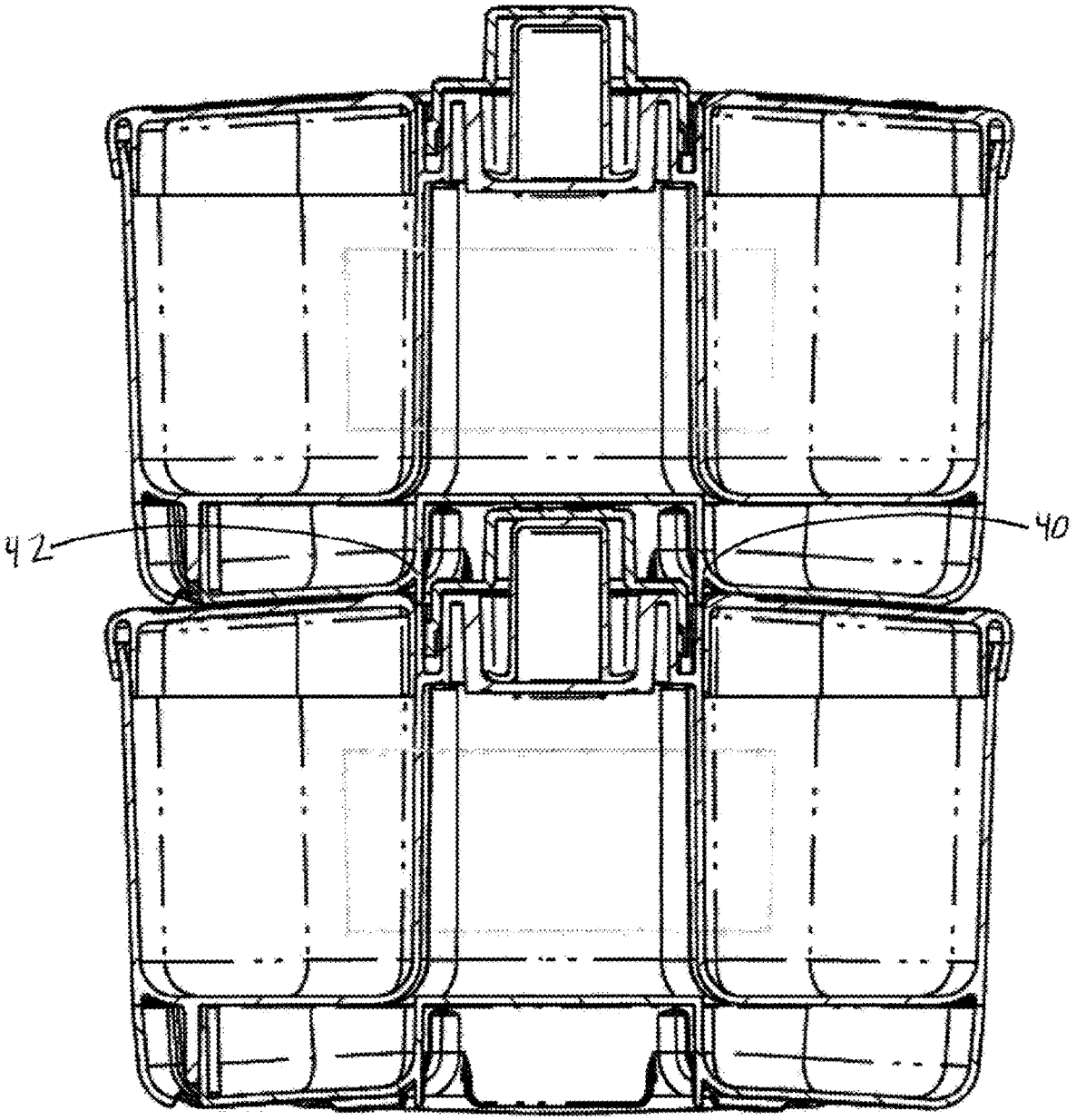
FIG. 33 is a cross sectional view of two stacked supplement safes showing how the rotary cap of the lower safe fits within the underside central recess of the upper safe.

As shown in FIGS. 31, 32, and 33, the supplement safe can be readily stacked, one upon the other, and in a fashion that is inherently stable and secure. Specifically, arc projections 40, 41, and 42 fit between the central facing compartment lids edges and the locking cap while the fins 37, 38 and 39 fit between the facing edges of adjacent compartment lids. This capability is the same for each embodiment of a different number of compartments. Additionally, the bottom of the tray is slightly curved so as to match the slight curvature of the lid tops. This feature further provides for stacking stability. Finally, the locking cap grip knob is of a diameter that when stacked one upon the other, the positioning of the grip knob within the lower tray central core also helps to stabilize the stacked safes.

Figure 42:
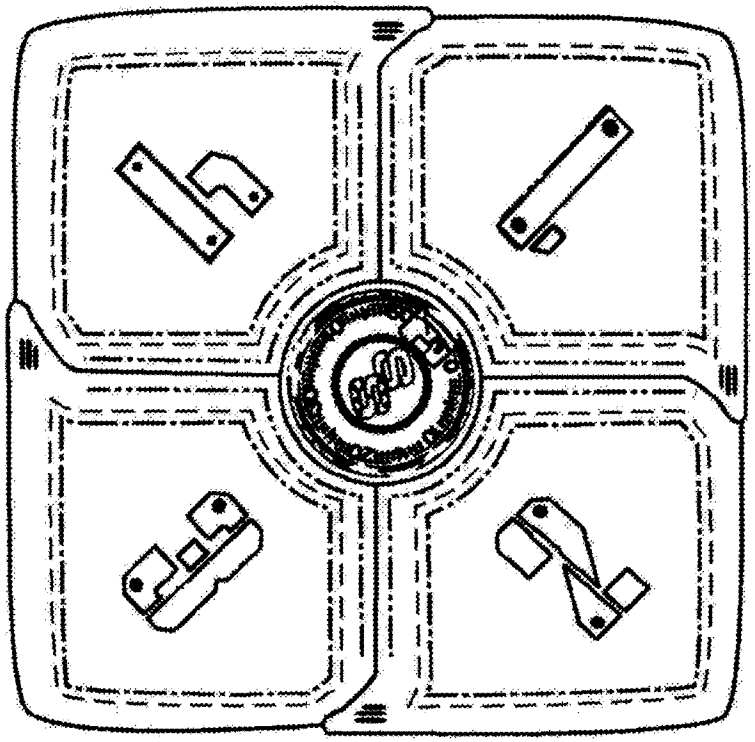
FIG. 42 is a top view of a four compartment embodiment of the supplement safe.
Figure 44:
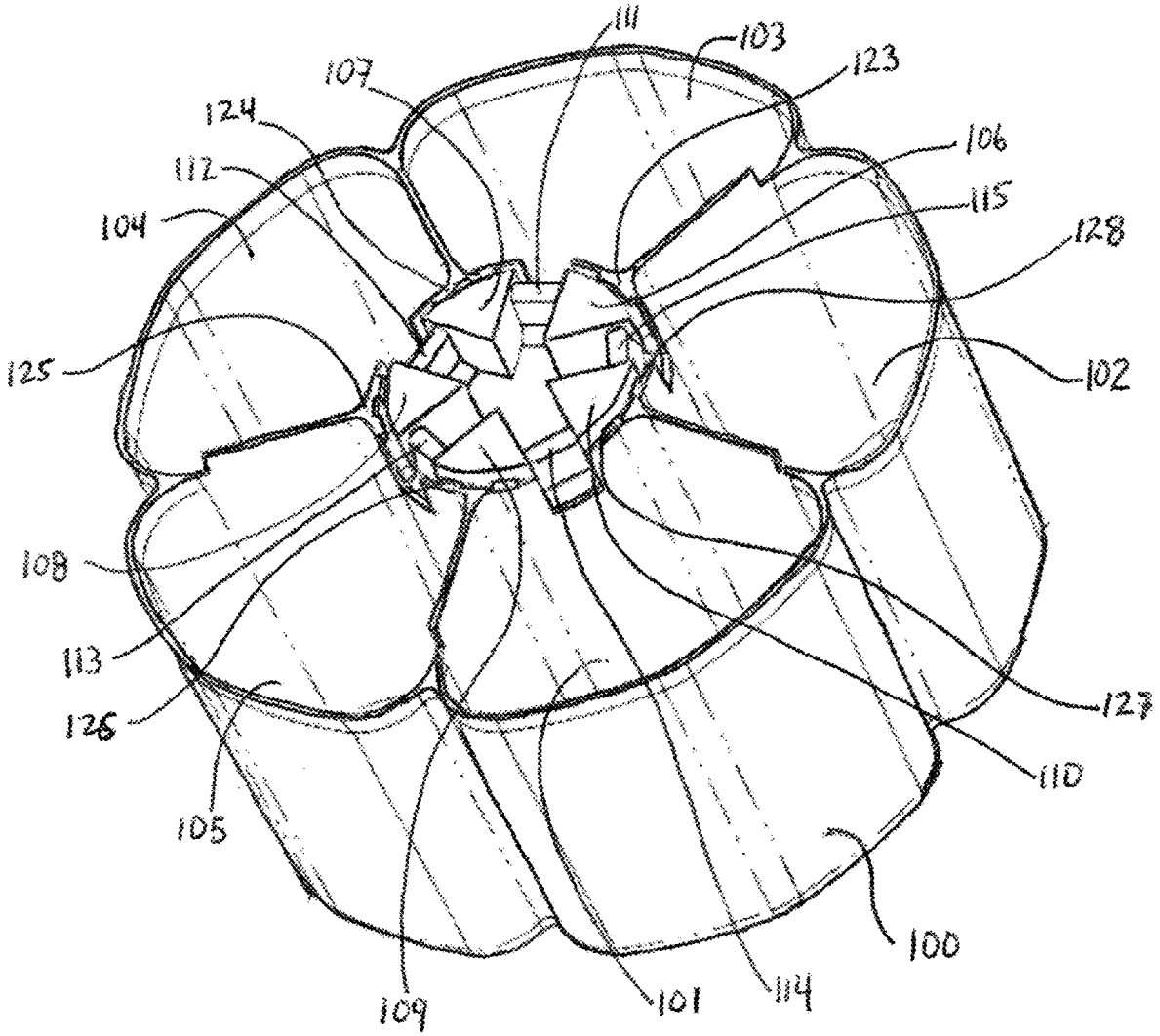
FIG. 44 is a three quarter view of a five compartment version of the main container showing the five separate compartments and keeper elements for keeping the locking cap in place.

For further clarity as to the universal nature of the novel locking/unlocking design, we describe here specific features of the five compartment version. Specifically, as shown in FIG. 44, the main body of the container 100 has several preferred features, specifically, the designed shape of the overall container being generally pentagonal with, in the presently displayed embodiment, five separate chambers 101, 102, 103, 104 and 105 for storing dietary supplement materials such as protein powders and the like. In particularly preferred embodiments, the separate chambered portions are further shaped with a slight triangularity, each with rounded outer corners and including a slight pointedness along the middle of the outer circumference that provides for both an ergonomic benefit to the user in providing for a direct cross-sectional grip pressure application of the hand as well as to provide a natural pouring spout. These features are also consistent with the single chamber, double chamber, four, five, six and seven chambered embodiments. As one of skill in the geometric arts, it is clear that the overall shape of the four chambered embodiment will be square-like (FIG. 42) with requisite rounded outer corners, the five chambered embodiment will be pentagonal-like, the six chambered will be hexagonal-like, and the seven chambered will take on a heptagon-like shape, each with common features that assist ergonomic utility.

As further illuminated in FIG. 44, the main body is formed at its upper central area, to comprise, for the five chambered version as depicted, five support towers 106, 107, 108, 109 and 110. The support towers are situated so as to span and be aligned symmetrically with the division walls between the five separated chambers. This positioning and spacing arrangement is similar for each of the other embodiments of lesser or greater number of chambers. The towers are separated from the inner container walls by a gap sufficient to insert the locking cap as described for the three chambered version.

Situated between each of said five towers in the five compartment version and connected therewith are lid-band tensioning risers 111, 112, 113, 114 and 115 (FIG. 44). The lid-band tensioning risers are designed to terminate their height below the tops of the five support towers. In preferred embodiments, the tensioning risers force the lid-bands 116, 117, 118, 119 and 120 (FIG. 45) of the multi-lid element 121, as depicted for the five compartment version, when assembled into the main container body 100, to travel from their respective connections to the central king post 122 up and over the top of the tensioning riser and when the locking cap is also in place, the lid-bands will, depending upon the positioning of the locking cap, either be forced to bend down around the bottom of the locking cap, or be free from contact with the locking cap bottom. The net effect of the lid-band risers 111, 112, 113, 114 and 115 is to cause each of the lids to be restricted in the ability to be removed from the main container body by causing a net "shortening" effect on the lengths of each lid band. With the lid bands restricted underneath the locking cap, the lid cannot be removed from the compartment opening of the main container because the band is holding the lid tight. Alternatively, when the locking cap is rotated such that the lid band is exposed, the lid can be opened and lifted up and out of the way of the compartment opening. Each embodiment comprising the different number of compartments has the same or similar feature regarding the lid-bands, their construction and their manner of being bent down over the lid-band tensioning risers by the locking cap.

Figure 48:
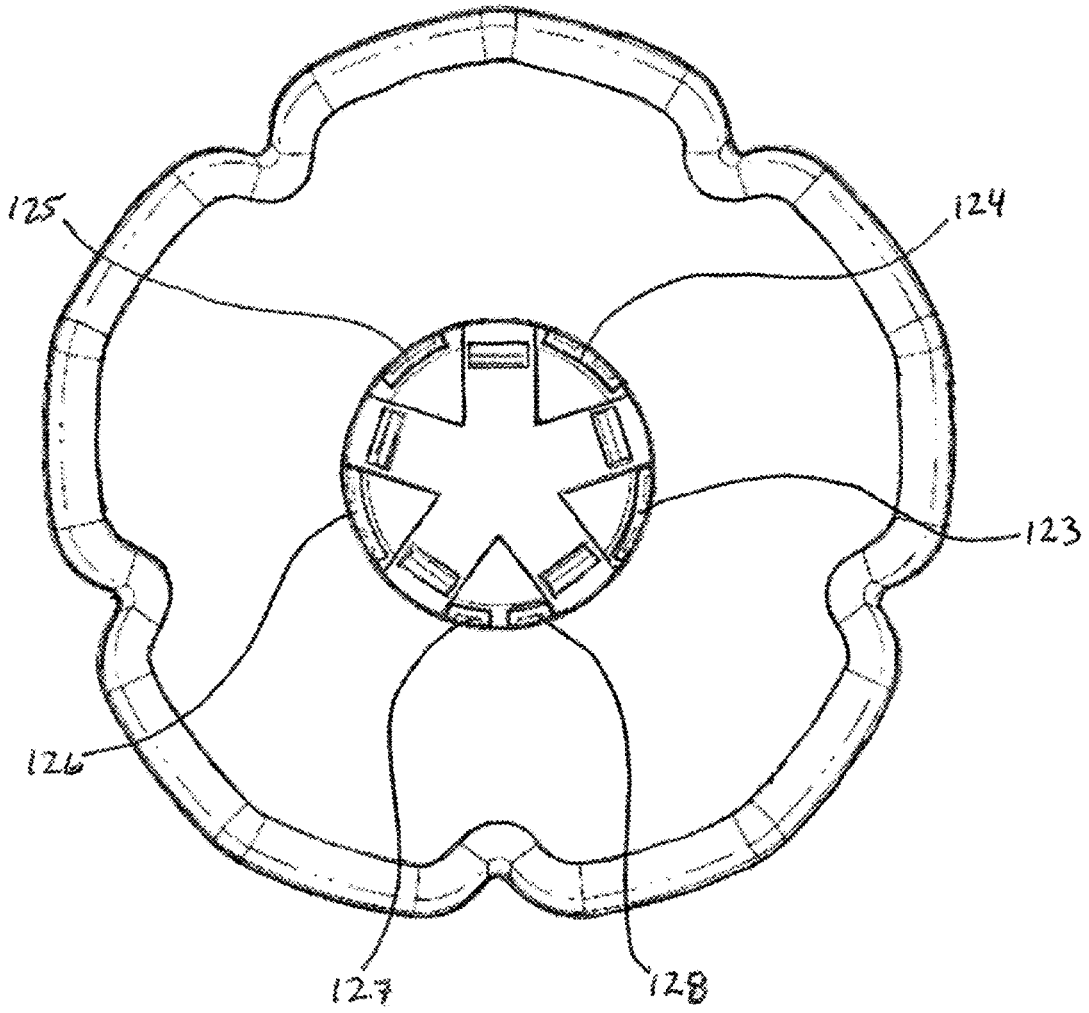
FIG. 48 is a bottom up view of the five compartment embodiment showing the position of the keeper tabs for keeping the locking cap in place.

In additional features of the main container body, there are spaced projections 123, 124, 125, 126, 127 and 128 (locking cap keepers), as shown in FIGS. 44 and 48 for the five compartment embodiment that in a first aspect function to keep the locking cap in place by the undersurface of said keepers engaging the upper surface of spaced projections designed about the cap circumference, and second, are designed asymmetrically with respect to one another (in conjunction with matching asymmetrically placed cap projections) so as to provide for maintaining the locking cap in place except for a single rotational positioning of said locking cap wherein said cap will disengage from the main container body. By asymmetrically is meant that the sets of locking cap keepers about the center of the main container though symmetrically spaced apart according their respective geometries (triangular three compartment, square four compartment, pentagonal five compartment, hexagonal six compartment and heptagonal seven compartment) the arc length of the projections making up the keepers can vary between each set. Such configuration allows for a single position in which the dial can be rotate and be removed from the container, namely that the dial ridges include arc lengths that at least in one position with respect to one keeper set are the same dimensions.

It is noted as indicted in FIG. 48 that in this five compartment example, there are no elements for attaching a bottom tray in the flooring of the compartments as in the three compartment version. This aspect is an alternate embodiment wherein there can be no bottom tray as a bottom tray element can be optional on the supplement safe.

Figure 43:
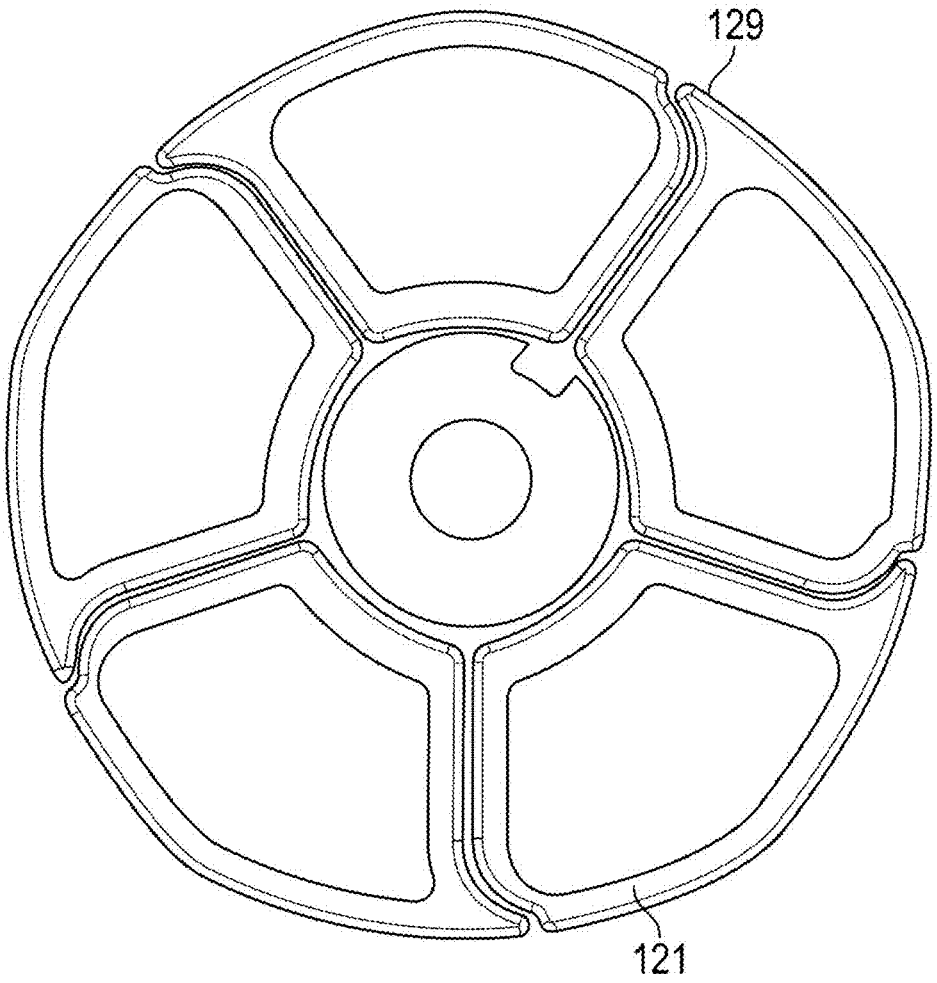
FIG. 43 is a top view of a five compartment embodiment of the supplement safe.
Figure 45:
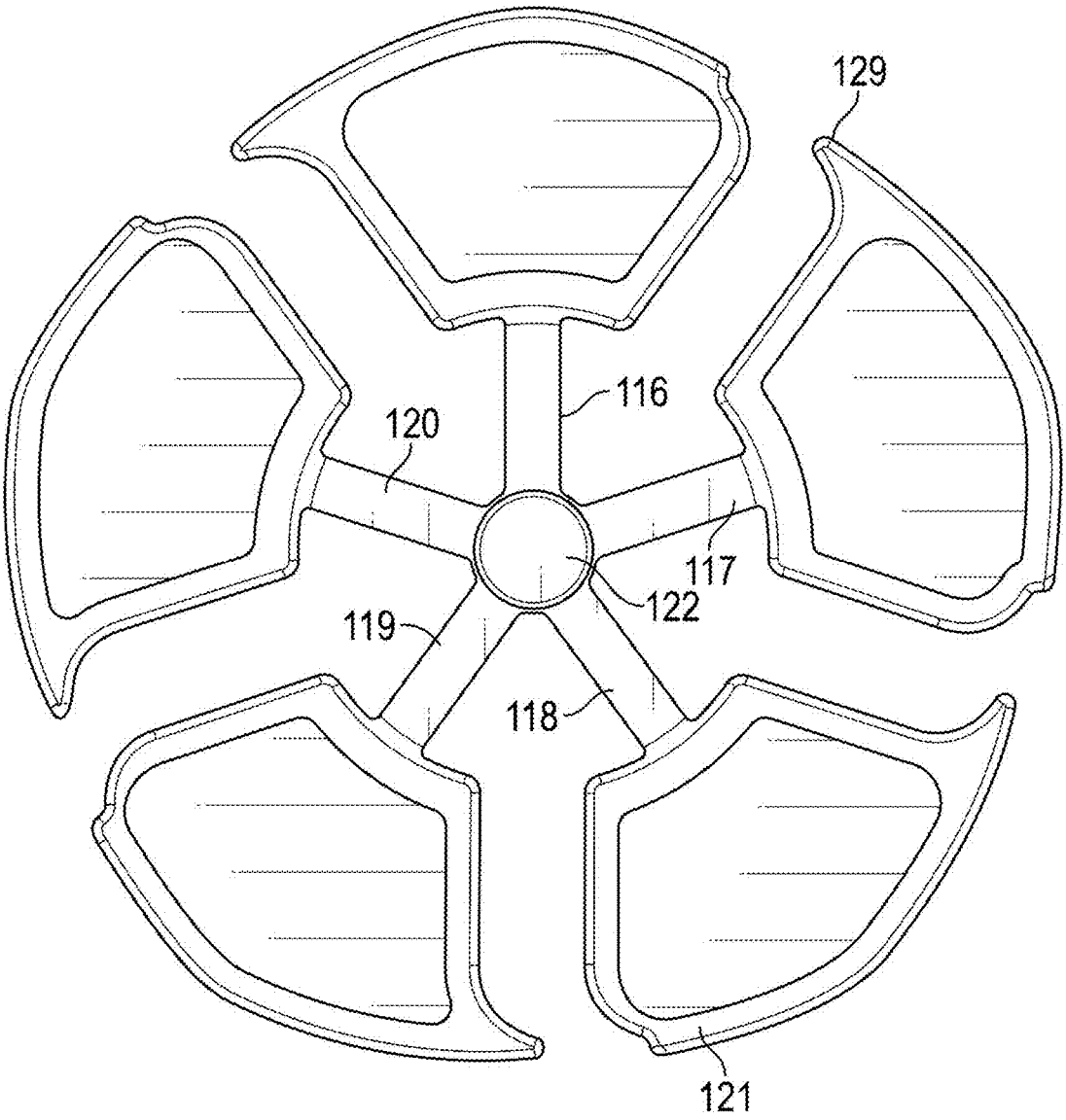
FIG. 45 is a top view of the lid element for a five compartment embodiment of the supplement safe.

Regarding multi-lid element 121 as shown in FIGS. 43 and 45, the lid element comprises a central king post 122 (FIG. 45) comprising a height from its base sufficient to contact the undersurface of the locking cap when the lid element is seated into the main container central core. Such contact provides for, in part, for forcing lid bands to be fixed as to their centrally oriented position and aligned to run parallel to and up and over the top of the lid band risers.

Further novel features of the lids for the five compartment version includes thumb/finger grip wings 129 on each lid which provide for not only easy leverage to work open the lid from the compartment but is symmetric with the triangular design in that the grips are tucked into the architecture of the overall circumference of the safe so as to not be easily snagged by a foreign object and resist opening inadvertently. This thumb finger tab feature is found in each of the various embodiments comprising one, two, three, four, five, six and seven chambered versions.

Figure 46:
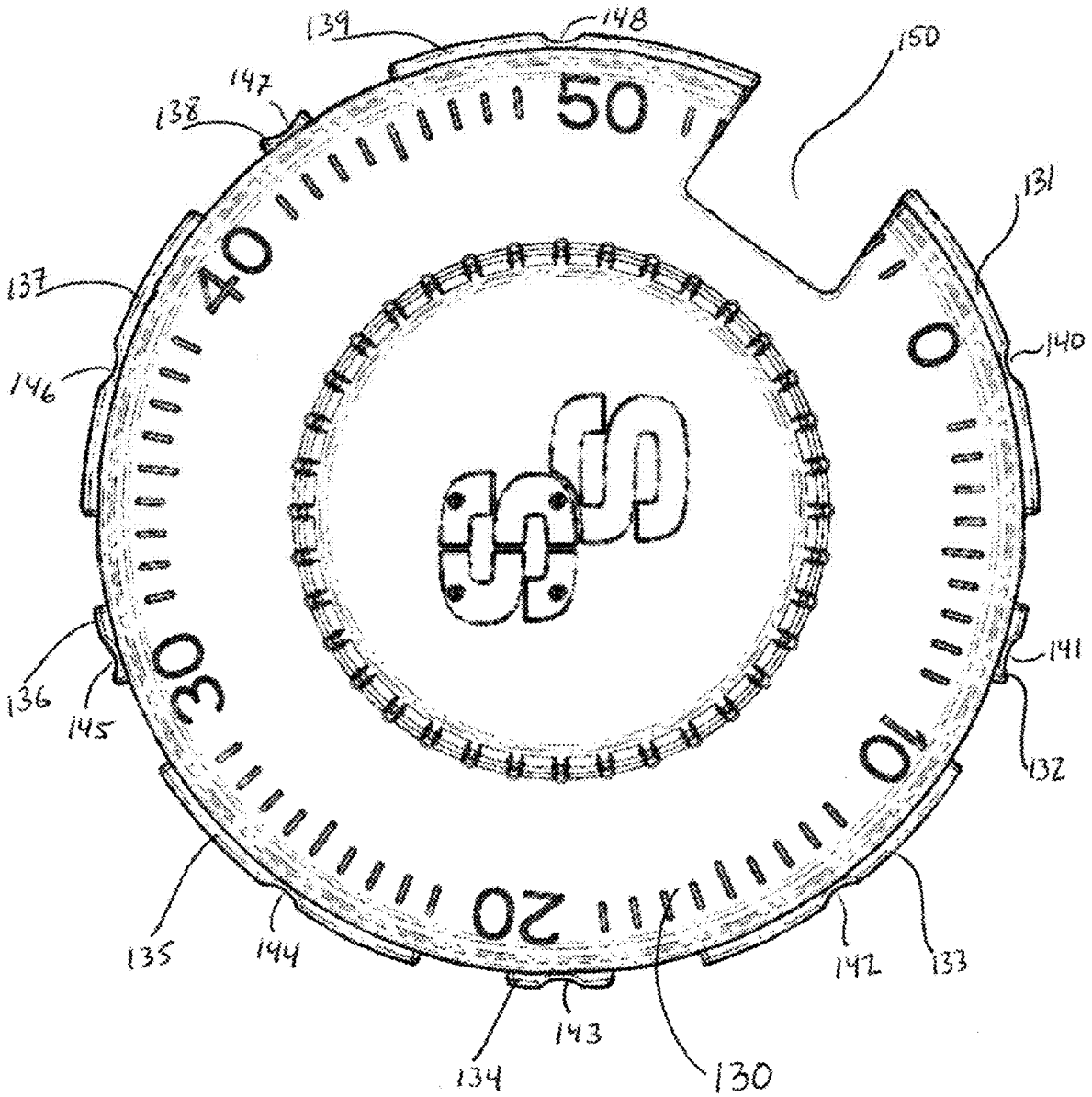
FIG. 46 is a top view of the locking dial for a five compartment supplement safe.
Figure 47:
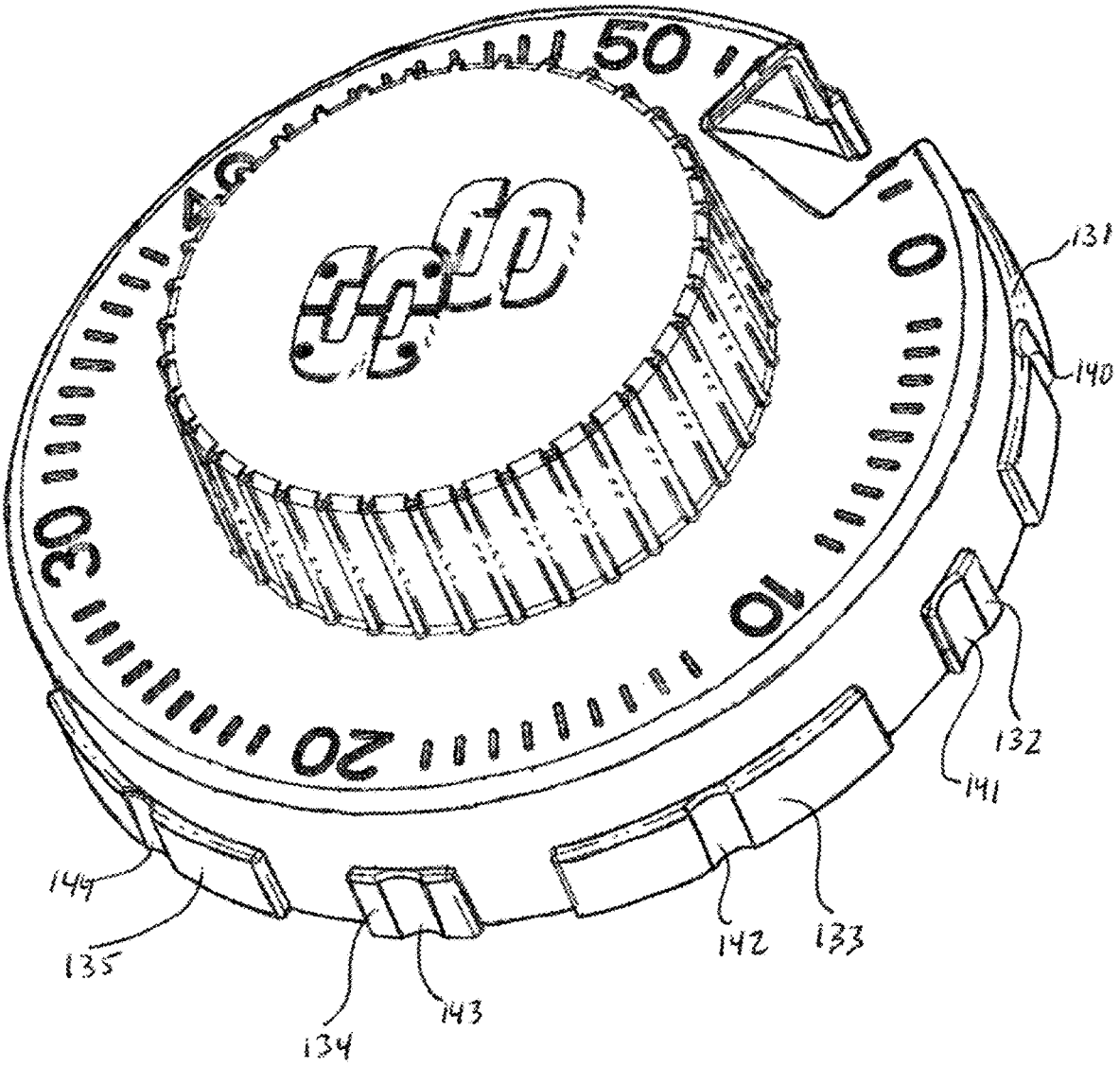
FIG. 47 is a three quarter view of the locking dial for a five compartment supplement safe.

Turning to the locking cap 130 features and functions, FIG. 46, shows a top view of the locking cap for the five compartment embodiment comprising a diameter designed to complement both the support towers and lid band risers and wherein there are spaced ridges 131, 132, 133, 134, 135, 136, 137, 138 and 139 that interact with elements on the main container body to keep the locking cap in place. In particularly preferred embodiments, the spaced ridges 131, 132, 133, 134, 135, 136, 137, 138 and 139 are positioned at predetermined arcs about the circumference of the cap. As with the three compartment version as disclosed above, these ridges have upper surfaces that contact the under surface of locking cap keeper elements 123 to 128. Further, the ridges 131, 132, 133, 134, 135, 136, 137, 138 and 139 each possess a ratchet recess 140, 141, 142, 143, 144, 145, 146, 147 and 148 that interact with spaced singular bumps or ratchet-like ridges (not shown) formed or otherwise associated with the inside or center facing side of the container walls on the medial line between each of the three compartments. As with the three compartment version depicted in FIG. 34, these bumps lie below the overhang of the asymmetrically sized and spaced locking cap keepers 123 to 128. Each embodiment of different numbers of compartments will possess similarly arranged locking cap ridges, locking cap keeper elements, and ratchet bumps and ratchet recesses on their respective locking caps and inside or center facing side of the container walls as will be understood by one of skill in the art. Thus it will be clear to one of skill in the arts that there will be degrees of position of the dial within the housing comprising the main container that will allow for removal of the dial as no portion of the keepers will ride over the cap ridges, and other degrees of position that will allow the gap in the dial to be positioned so as to allow opening of the invention lids, and still other degrees of position wherein no lids can be opened.

In additional features of the locking cap, said cap is specifically designed to comprise a cut out section 150 (FIG. 46). As stated earlier, the cut out section functions to allow for the lid bands to become exposed and able to move so as to allow the lids to be removed from the compartment tops. In a particularly preferred embodiment, for the five compartment embodiment, there are five formal positions to which the locking cap can be rotated for opening a particular compartment, four positions wherein the lids will be all locked shut, and one position wherein the locking cap can be removed and the multi lid top also removed.

Considering the greater scope of the intended invention and elements thereof, the novel locking system can be used with other types of closing systems whether or not they incorporate lids with lid bands and risers for the locking of multiples of lids, doors, hatches, etc. The cut out section of the dial can be used to align with container openings that possess lids that are for example hinged and wherein the hinge cannot open unless the dial is positioned to uncover the hinge by the cut out section. Thus, there are multiple uses of this locking system as any number of further systems for keeping an element that acts to lock or shut something can be used in conjunction with the instant radial system that when the dial is properly set to a predetermined degree within the housing, the locking element will release or engage a locking means.

Figure 49:
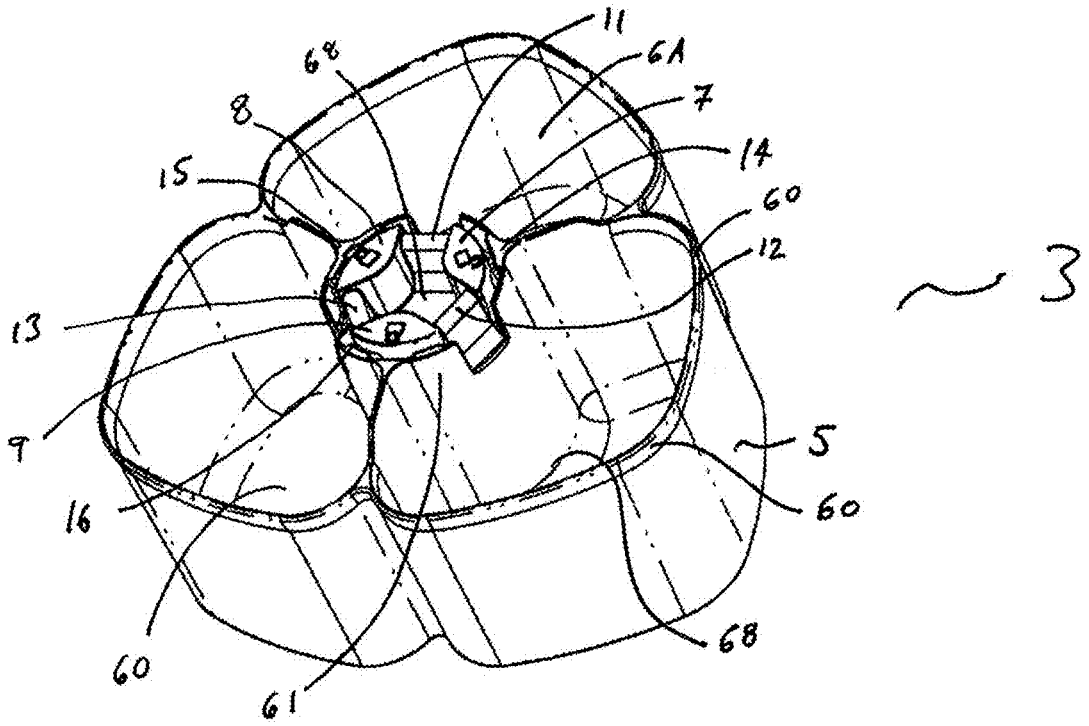
FIG. 49 and FIG. 50 show three dimensional views of an alternative embodiment of a 3-compartment supplement tray adapted to be attached to another tray positioned below it via series of interlocking tabs and slots.

A representative alternative design to the device shown in FIG. 4 is illustrated in part in FIGS. 49-57, below. As shown in FIG. 49, the main body is designed at its upper central area to comprise, for the three chambered version as depicted, three support towers 7, 8, and 9, that rise from a flooring 25 that spans the central core 24 (FIG. 50) of the main container body. The three support towers are situated so as to span and be aligned symmetrically with the division walls between the three separated chambers. The towers further function by their positioning to either provide for locking the container or completely opening and disassembling the locking cap and multi-lid element from the main container body, depending upon its rotated position.

Situated between each of the three towers and connected therewith are lid-band tensioning risers 11, 12, and 13. In preferred embodiments, the tensioning risers force the lid-bands of a multi-lid element (not shown) to travel from their respective connections to a central king post up and over the top of the tensioning riser. When a locking cap (not shown) is also in place, the lid-bands will, depending upon the positioning of the locking cap, either be forced to bend down around the bottom of the locking cap, or be free from contact with the locking cap bottom.

Figure 50:
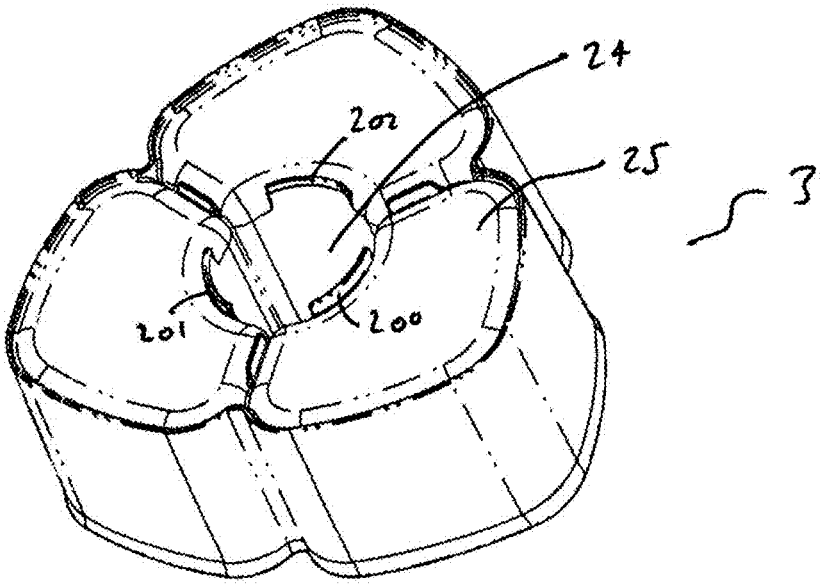
Figure 51:
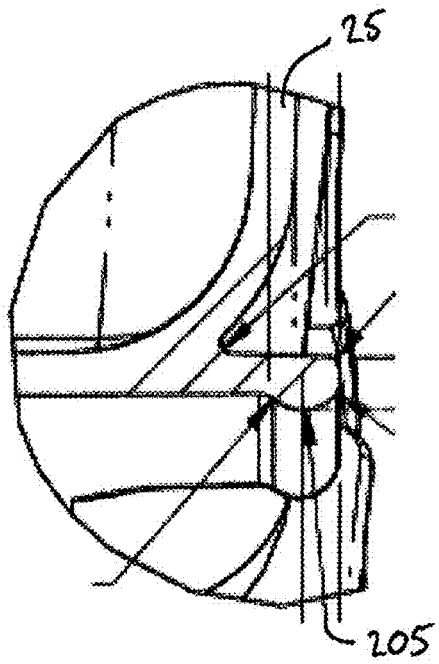
FIG. 51 is a cross sectional view of an interlocking tab for releasably connecting one tray to another.

As shown in FIG. 50, about the periphery of the central core 24 of the tray 3 several tabs 200, 201, 202 extend downward from the lower surface of the floor 25. These tabs are designed to engage slots in the central portion of another tray 4 (FIG. 53) designed to be attached to the main tray depicted in FIG. 49. In this embodiment, the upper and lower trays are attached to one another simply by pressing them together with sufficient force to urge the retaining features 205 (FIG. 51) of the tabs 200, 201, 200 into the slots 210, 211, 212 of the lower tray 4. As depicted in FIG. 54, the bottom section 220 comprises a multi-chambered interior, wherein each chamber may be numbered. Fins 37, 38, and 39 may also be situated between each compartment protruding from the underside 220 of the tray, which are designed to assist in vertical stacking of multiple, preferably, interlocking (by any suitable configuration), trays. Generally, in use, when a user wants to access contents in the lower tray 4 as described in the this embodiment, s/he only need to apply sufficient force to detach the lower tray and its lid (not shown) from the upper tray 3. Other features of the bottom tray 4 include a central surface 30 that has a diameter dimensioned sufficient to span the diameter of main container body central cavity 24 (see, e.g., FIG. 53).

Figure 52:
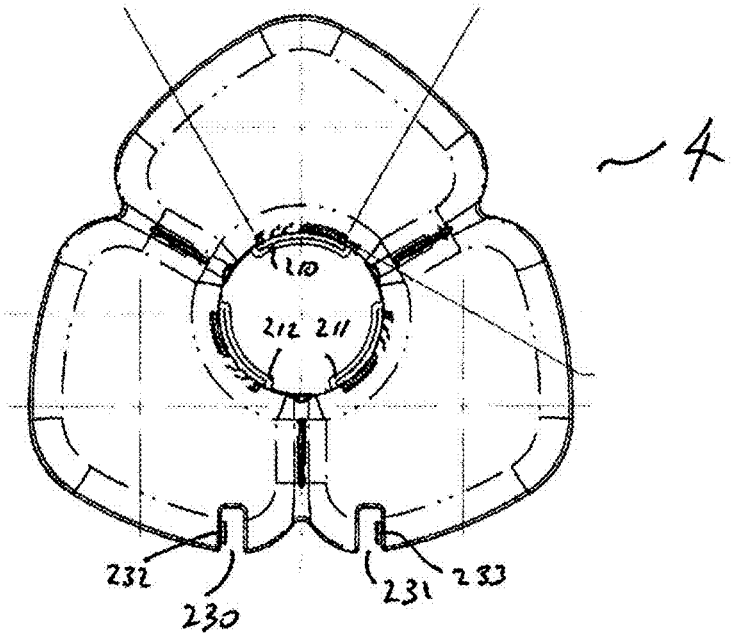
FIG. 52 is a bottom view of an alternative embodiment of a lower supplement tray having a triple compartment for storage of consumable products.
Figure 53:
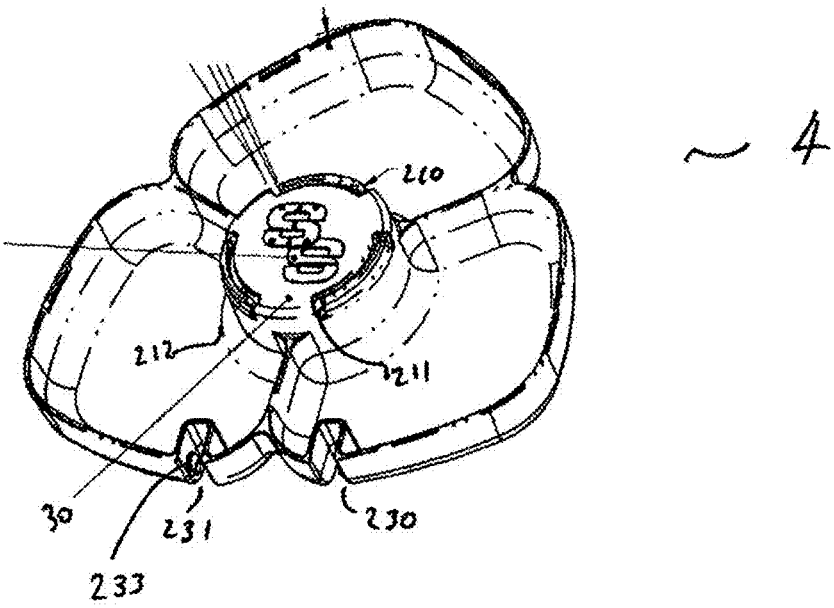
FIG. 53 and FIG. 54 are three dimensional views of such a tray from above and below.
Figure 54:
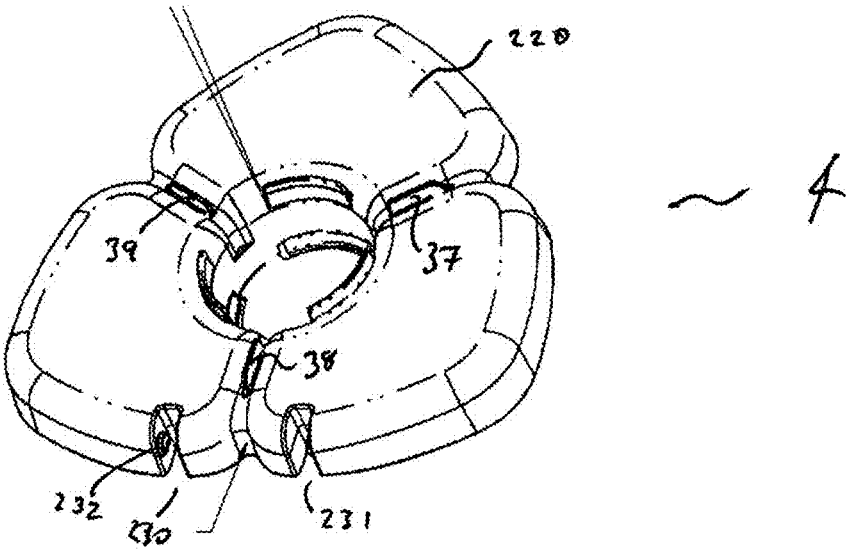
Figure 55:
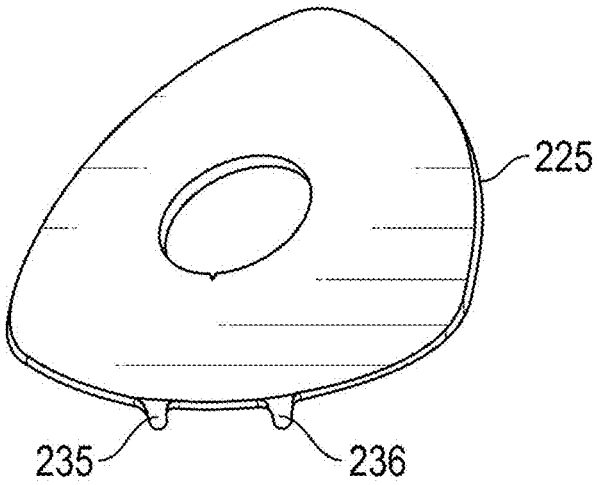
FIG. 55 is a three dimensional view of a representative lid for a tray as shown in FIG. 52-FIG. 54.
Figure 56:
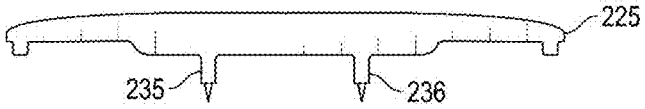
FIG. 56 is an end-on view of such a lid.
Figure 57:
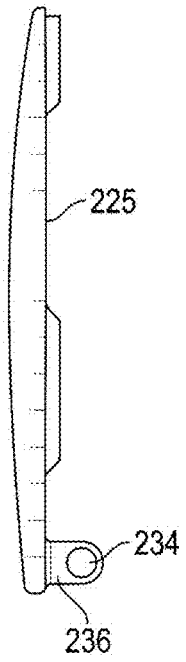
FIG. 57 is a side view of such a tray.

FIGS. 55-57 show a representative embodiment of a hinged lid 225 for a lower tray 4 as shown in FIGS. 52-54. In this embodiment, the hinged lid 225 is a unitary and is designed to, when opened, provide a user access to each of the three compartments in the lower tray 4. Lower tray 4 includes slots 230, 231 that have outwardly protruding pivot points 232, 233 adapted to movably mate with hinge openings 234, 235 in hinge elements 235, 236 of the lid 225 when the lower tray and lid are snapped together.

Turning now to examples of how the supplement safe can be used by a supplement user in a dietary regimen, it should first be understood supplements are now administered according to scientific standards. For example, with respect to protein intake, the recommended dietary allowance for a protein supplement is calculated to be about 0.8 grams per kilogram of body weight, which translates to about 0.36 grams per pound of body weight. Given that the typical adult male is about 170 to 250 pounds and adult women are roughly between 100 and 150 pounds, the daily intake of protein is recommended to be in the range of 61 to 90 grams total protein for an adult male and 36 to 54 total grams for an adult female. These figures match published data suggesting that inactive women require on average 46 grams of protein per day while inactive men should intake a minimum of 56 grams to avoid nutritional deficiencies. Additional data from the National Strength and Conditioning Association (NSCA) suggests that active female and male individuals and individuals performing endurance and strength training require a higher protein intake in the range of 0.40 to 0.60 grams per pound of body weight and even up to 0.80 gram for full time athletes. This translates to 68 g to 150 g per day for active adult males and 40 g to 90 g for active adult females. For full time athletes, total protein intake per day can reach as high as 136 g to 200 g.

Considering the above protein intake figures, weightlifters and bodybuilders typically consume about 1 to 1.5 g of protein per pound of bodyweight to build lean muscle mass. Those numbers translate to 170 g to 375 g of protein intake for adult male athletes weighing between 170 and 250 pounds. Thus, consistent with the supplement regimens used by those actively engaged in a consistent strength training program, it can be seen that the body requires not only additional protein each day beyond what the average person requires, that protein requirement is necessary to be administered throughout the day to help repair, maintain and build new muscle tissue that is being torn down by the performance of intense resistance training.

Regarding the current invention, in a first example, the supplement safe, particularly the multi-compartment versions, is capable of carrying a nutritional 'weekly' dosage of protein powders, as well as pill form supplements, for a person in the beginning stages of training, i.e., a person who trains one to two times per week. Additionally, the supplement safe can carry a 'daily' requirement of multiple doses of protein and pill form supplements for more advanced to professional athletes such as bodybuilders and individuals taking weight gainers. A supplement safe with, for example, three powder compartments, easily holds 60 g of protein each for compartments having a volume of one half cup. Thus, for a person requiring 200 grams of protein intake per day, the total dosage can be divided at 66 grams per compartment to be then accurately and timely consumed at three times during a daily cycle. Likewise, pill form supplements can be taken at the same three times per day schedule as such supplements are recommended in the regimen. For example, the typical pill form supplementation for persons who workout is at least one multi-vitamin, an omega fatty acids (fish oil) supplement, a Co-Q10 (anti-oxidant) supplement, and creatine and other amino acid supplements. It is also to be understood that supplements are in one sense of the word not unlike medicines. Some people will also be taking actually prescribed medicines with their supplements. Thus, there is a need to make sure that one is taking the supplements intended for their regimen and not that of someone else.

The protein powder is typically administered pre-workout and post-workout, typically as a protein shake. With the supplement safe, the person can have their daily or weekly requirement organized and readily available with them in the gym or workout environment. The lockable feature also keeps the contents of the safe compartments from inadvertently opening.

Examples of how the supplement safe can be employed by individuals training for fitness and overall wellness as well as bodybuilders are disclosed below.

A beginner regimen could include at breakfast a multi-vitamin, CoQ-10, and Omega 3 fatty acid supplement, a mid-morning protein shake and following workout or in the afternoon, a second protein shake with creatine, and finally at bedtime a multi-vitamin and melatonin.

A more advanced or progressive schedule for the beginner health, wellness and/or exercise enthusiasts would likely employ a supplement schedule wherein the individual will ingest a protein shake upon waking up. Then with breakfast they would take CLA (conjugated linoleic acid) and a multi-vitamin. Between breakfast and lunch the individual would ingest a second protein shake. At lunch time the person would ingest a turmeric anti-oxidant supplement, such as Astaxanthin. After workout another protein shake with a measure of creatine powder. At dinner the person would ingest a fat burner supplement such as omega 3 fatty acid and before bed a supplement with trace minerals and branch chain amino acids.

As will be readily understood, for the three compartment version, the beginner can easily carry a supply for a single day or as much a one weeks supply of each supplement ingredient. Specifically, the pre-breakfast shake powder could be maintained in main cylinder compartment number 1 and the multi-vitamin and omega 3 supplement could be placed in the bottom compartment in tray numbered 1. The mid-morning protein shake powder could be placed in main cylinder compartment labeled 2. The lunch time antioxidant could be placed also in the bottom tray labeled 1 or in a second tray 2. The third shake with creatine could be stored in the third main cylinder compartment while the bedtime supplements could be stored in a third bottom tray. Thus, the bodybuilder would have all supplement items together in one convenient location and dispensing device.

For an Intermediate level fitness trainer or bodybuilder, the supplement schedule might comprise the following. At wake up, the individual would ingest a protein shake, such as for example, Whey protein. At breakfast, the person would take a multi-vitamin, a joint formula supplement and an omega 3 fatty acid. Between breakfast and lunch the individual would ingest a protein shake with creatine powder while at lunch they would take a joint formula and omega 3 supplements. At thirty minutes after working out they would ingest creatine and a post workout shake followed at dinner with DIM (diindolylmethane) capsules and a multi-vitamin. Finally, at bed time they would take protein and an HGH supplement. The greater number of compartments will accommodate such intermediate and advanced fitness workouts.

The supplement safe is able to carry the above series of supplements for example such as placing the wake up protein powder in main cylinder compartment 1, the breakfast multi-vitamin, joint formula and omega 3 fatty acid supplements in bottom tray labeled 1, the midmorning shake and creatine in main compartment labeled 2 and the joint formula and omega 3 supplements in bottom tray 2. The post workout creatine and protein powder would be stored in main cylinder chamber 3. Finally, the dinner and bed time supplements can be kept in bottom tray 3. Thus, with such an individual's supplement regimen, the full daily supplement elements are conveniently available in one device.

For an experienced bodybuilder, the supplement routine could comprise a quick protein/simple carb shake upon waking up followed 30 minutes later by ingesting creatine powder and nitric oxide. This would be followed at breakfast with a (for men athletes) ingesting a testosterone formula supplement, an omega 3 fatty acid, a multi-vitamin, and a cortisol blocker supplement. Mid-morning the individual would ingest a protein shake followed at lunch with another testosterone formula supplement, a joint formula supplement as well as another omega 3 and cortisol blocker. This would be then followed one hour after lunch with a nitric oxide intake, and another protein shake in the afternoon while for dinner another testosterone formula, joint formula, omega 3 fatty acid, and cortisol blocker supplements. This would be followed one hour later with a creatine powder, and nitric oxide boost while before bed, they would ingest another protein shake.

Again, the supplement safe can be used to accommodate the experienced body builder in that the wakeup shake would be stored in main cylinder compartment 1. The creatine powder could be in cylinder compartment 2. The breakfast supplements could be in bottom tray compartment 1. The mid-morning and after lunch protein shakes would be in main cylinder compartment 3 and lunch supplements in bottom tray 2. The dinner supplements in bottom tray 3. The after dinner creatine and protein could be stored in remaining compartments or taken from the manufacturer's container when the user is refilling the safe for the next day.

Female athletes and body builders have the same types of supplement schedules, for example a female fitness athlete could have a supplement regimen as follows. At breakfast they would ingest a multi-vitamin and 1 digestive enzyme and fat burner. Mid morning they would ingest a low carb protein with 5 gm of L-Glutamine. At lunch they would take 500 mg of vitamin C, 1 digestive enzyme, and 1 serving of EFA's (essential fatty acids). After lunch a second low carb protein shake would be ingested with 5 gm of L-Glutamine and a fat burner supplement. At dinner they would take vitamin C, 1 digestive enzyme, and 1 serving of EFA's. Finally at pre bedtime they would take 1 scoop of low carb protein and multi-vitamin digestive enzymes, and branch chain amino acids.

As will readily be understood the supplement safe can easily accommodate such a supplement routine. The breakfast supplements would be maintained in the bottom compartment labeled 1, the mid-morning, afternoon and bedtime proteins could be stored in main cylinder compartments 1, 2, and 3, and the lunch and dinner time supplements would be stored in bottom compartments 2 and 3, respectively. The bed time supplements in pill form could be kept in bottom compartment 3. If the supplement safe version were that of a six chambered version, a two day supply could be kept in one locked safe, for example.

In yet another example, the supplement safe can also be used to carry daily doses for those who are taking supplements for detoxification treatments, such as colon, liver or other internal detoxification routines. Specifically, one recommended detox program suggests a regimen that is highly specific. The supplement schedule is as follows: for days 1-5 the person is to take in the morning two A capsules and one half scoop of product fiber. During the day they are to take two B capsules before lunch or dinner and three C capsules with lunch or dinner. In the evening the regimen is for two D capsules before bed and one cup of product tea. From 6-30 days the person is to take four A capsules one scoop of product fiber in the morning and during the day four B capsules before lunch or dinner and three C capsules with lunch or dinner, followed by two D capsules before bed and one cup of product tea. During days 31-35 the person is on a five day break from taking capsule A and tea while still taking the rest as previously. From days 36 to 60 the person is to self administer four A capsules and one scoop of product fiber in the morning, four B capsules before lunch or dinner and three C capsules with lunch or dinner during the day, and two D capsules before bed and one cup of product tea. Continuing from days 61 to 65 the person is to take a second five day break from capsule A and product tea while continuing the remainder as before. Finally, from days 66-90 the person to ingest four A capsules and one scoop of product fiber in the morning, four B capsules before lunch or dinner and three C capsules with lunch or dinner during the day and last but not least two D capsules before bed and one cup of product tea. Over such an expansive time period of taking supplements, here even for treatment reasons, it has not been easy for the average person to keep the regimen clear and missing administration periods is common. However, with the supplement safe the person is best served because of the ability to keep the entire daily or multiple daily supplies of capsules and powders together in numbered compartments. In the above example, there is enough capacity in the supplement safe for four days, the powders and pills utilizing one main compartment chamber and one bottom compartment chamber, respectively, per day. Thus, a person can fill the chambers by either pouring directly through the opening in the main cylinder top or, by aligning the top's keeper tabs with the indentations on the cylinder's keeper lips and popping off the main top, the person can fill the chambers likely more easily. Subsequently, the user can then, or wait till later, either pour out the powder or alternately pour reconstitution liquid, typically water, directly into the compartment openings. The lids can be closed and the liquid and powder shaken up and poured out as a liquid. As stated earlier the dry contents of the other compartments cannot become contaminated. Thus, the supplement safe provides the opportunity to have a means for keeping track of, and an accounting of, dose taking and the person can more efficiently maintain his or her supplementary routine.

In still further embodiments, the supplement safe of the invention is contemplated to be made of a molded plastic which can be of any useful density of polyethylene or polypropylene-based plastic or the like having a stiff to semi-resilient consistency, as one of skill in the arts will understand. Moreover, the plastic can be manufactured in any variety of colors and can be translucent or transparent. In yet another embodiment, the nature of the generally triangular shape and size along with the rounded compartment corners provides for easy grasping with the hand. Further, the lids can be easily accessed by use of uniquely formed thumb/finger pull wings or tabs formed at one of the outer corners of the triangular lids yet designed so as to fit within the triangularity of the over all safe shape of each compartment. Additionally, the triangular shape accommodates a natural pouring spout for each compartment as well as easy cleaning due to the curved design of the internal compartment corners. Still further, the shaping of the safe, having a slight curvature to the top surface of the lid, also comprises a slight curvature to the bottom surface of the supplement tray so that when the safe is stacked one upon the other, the top surface of the lid component of one safe will contact the bottom surface of the tray of another safe above in a vertical stack of safes. This aspect provides yet further stability to the stacking ability of the invention. Still further, the safe can accommodate multiple days worth of supplements and can be used as a travel aid for storing and planning the dispensing and administration of supplements on any situation requiring travel away from home. Additionally, the safes can be of any color to provide additional variety to the supplement safe which will provide still a further benefit as a supplement user can have safes of different colors designated for different supplement programs.

All of the devices, articles, and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the method described herein without departing from the spirit and scope of the invention. More specifically, the described embodiments are to be considered in all respects only as illustrative and not restrictive. All similar substitutes and modifications apparent to those skilled in the art are deemed to be within the spirit and scope of the invention as defined by the appended claims.

All patents, patent applications, and publications mentioned in the specification are indicative of the levels of those of ordinary skill in the art to which the invention pertains. All patents, patent applications, and publications, including those to which priority or another benefit is claimed, are herein incorporated by reference to the same extent as if each individual publication was specifically and individually indicated to be incorporated by reference.

The invention illustratively described herein suitably may be practiced in the absence of any element(s) not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that use of such terms and expressions imply excluding any equivalents of the features shown and described in whole or in part thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

We claim:

1. A closable container comprising:

a) a first container having a top end and a bottom end and comprising at least two walled inner compartments, each inner compartment having a wall with top and bottom ends, said bottom end of said main container's compartments being connected to a floor substrate;

b) a semi-resilient lid element removably attached to said top end of said first container, wherein the lid element comprises a plurality of interconnected lids, wherein there is a different lid for each inner compartment; and c) a locking system comprising a locking cap rotatably and removably connected with said top end of said first container, said locking cap capable of being rotated by a user between at least one locked position and at least one open position for each different each lid of the semi-resilient lid element and at least one removable position for the semi-resilient lid element;

d) optionally, a second container removably attached to said bottom end of said first container wherein said second container has at least one walled and floored compartment(s).

2. A closable container of claim 1 wherein said locking cap is held in place with said top end of said first container by a multiplicity of tab members spaced along an outer circumference of said locking cap underlying a multiplicity of ridge members positioned along an inner circumference of said first container.

3. A closable container of claim 2 wherein said cap is attached to said top end by said first container by said spaced tab members frictionally riding under said ridge members.

4. A closable container of claim 3 wherein said first container comprises a number of compartments therein selected from the group consisting of one compartment, 2 compartments, 3 three compartments, 4 compartments, 5 five compartments, 6 compartments, and 7 compartments.

5. A closable container of claim 1 wherein each compartment within said first container has a volume selected from the group consisting of one fourth cup, one half cup, one cup, and one and one half cup.

6. A closable container of ci wherein said compartment walls and said floor subs abut one another with rounded corners.

7. A closable container of claim 1 that further comprises a second container removably attached to said bottom end of said first container, wherein said second container has at least one walled and floored compartment(s), and wherein said second container optionally comprises walled compartments having curved corners between said walls and floor.

8. A closable container of claim 1 wherein said locking cap cannot separate from the first container unless alignment tabs on said cap are properly aligned with said ridge members configured about said inner circumference of said first container.

9. A closable container of claim 1 wherein said lid element comprises finger/thumb pull wings, wherein said pull wings are optionally recessed within an outer circumference of said lid elements.

10. A closable container of claim 1 wherein said first and second containers and lid element comprise an overall geometric shape selected group consisting of a triangle, square, opposing triangles, pentagon, hexagon, and heptagon.

11. A closable container of claim 1 wherein each compartment of said first container is predominantly triangular in shape wherein at least one corner of each of said compartments faces an outer circumference of said safe.

12. A closable container of claim 1, wherein the locking system comprises: a) a locking cap having a center, a radius and an outer circumference, wherein an arc section of said locking cap along said circumference is removed so as to form a shorter radius in said arc section from said center than the radius of said outer circumference; b) a multiplicity of ridges spaced along arc sections of said outer circumference of said locking cap, said ridges comprising raised portions of said outer circumference of said locking cap that are a greater radius from said center than said outer circumference, each of said ridges having a predetermined arc length; c) surrounding said locking cap a housing having a circular inner circumference wherein said inner circumference has a radius from said center that is greater than the radius of said ridges of said locking cap; d) a multiplicity of projection elements spaced along arc sections of said inner circumference of said housing, said projections comprising portions of said housing along said inner circumference that are a smaller radius from said center than said inner circumference of said housing but greater radius than said radius of said outer circumference of said locking cap, each of said projections having a predetermined arc length, said projections further positioned along said inner circumference so as to lie above and overlap the ridges of said locking cap; wherein said locking cap is releasably retained by said projections within said housing and wherein said locking cap can rotate within said housing to locking, opening, and releasing positions.

13. A closable container of claim 12 wherein the locking system of said locking cap can rotate within said housing and a top side of said ridges of said locking cap can frictionally and/or slidably contact a lower side of said projections of said housing.

14. A closable container of claim 12 wherein the locking system of said locking cap can be rotatably positioned to at least one degree of position within said housing wherein no portion of said ridges will lie below any portion of said projections and said locking cap can be separated from said housing.

15. A closable container of claim 12 wherein the locking system of said locking cap can be rotated to at least one degree of position within said housing wherein said arc section of said locking cap that is removed to form a shorter radius in said arc section from said center than the radius of said outer circumference is positioned allow a closed opening to open.

16. A closable container of claim 15 wherein there is at least one portion of projections along said inner circumference overlaying at least one portion of said ridges along said outer circumference of said locking cap.

17. A closable container of claim 12 wherein the locking system of said locking cap can be rotated to at least one degree of position within said housing wherein said arc section of said locking cap that is removed to form a shorter radius in said arc section from said center than the radius of said outer circumference is positioned keep a closed opening from opening.

18. A closable container of claim 17 wherein there is at least one portion of projections along said inner circumference of said housing overlaying at least one portion of said ridges along said outer circumference of said locking cap.

19. A closable container of claim 12 further comprising a multiplicity of ratchet bumps at spaced arc positions along the inner circumference of said housing and at least one indentation of lesser radius than that of said ridges in a plurality of said projection elements, said ridges indented sufficient to slidably and frictionally engage at least one ratchet bump.

20. A method storing a one or more consumable products, optionally a daily requirement of a plurality of dietary supplements, comprising placing a first consumable product, optionally a measured amount of a powder form of a first dietary supplement, in at least one of a plurality of individual compartments of a closable container according to claim 1, and, after closing a lid of the compartment(s) into which the first consumable product, locking the lid of said compartment(s) using the of a rotary locking system of the closable container.

* * * * *